US006720508B2

(12) United States Patent
Moriyama et al.

(10) Patent No.: US 6,720,508 B2
(45) Date of Patent: Apr. 13, 2004

(54) DOOR SWITCHES

(75) Inventors: Hiroyuki Moriyama, Kyoto (JP); Shingo Akiyama, Kyoto (JP); Takashi Niwa, Kyoto (JP); Sueaki Honda, Kyoto (JP); Minoru Yoshii, Kyoto (JP); Hiroyuki Kajio, Kyoto (JP); Hidemitsu Takenaka, Kyoto (JP); Kazuki Kawata, Kyoto (JP); Tetsuhiko Miyoshi, Kyoto (JP)

(73) Assignee: Omron Corporation, Kyoto (JP)

( * ) Notice: Subject to any disclaimer, the term of this patent is extended or adjusted under 35 U.S.C. 154(b) by 44 days.

(21) Appl. No.: 10/175,506

(22) Filed: Jun. 17, 2002

(65) Prior Publication Data

US 2003/0005732 A1 Jan. 9, 2003

(30) Foreign Application Priority Data

Jul. 6, 2001 (JP) ..... 2001-206936
Jul. 31, 2001 (JP) ..... 2001-231677

(51) Int. Cl.[7] ..... H01H 29/16
(52) U.S. Cl. ..... 200/200; 200/43.04; 200/61.62
(58) Field of Search ..... 200/200, 43.04, 200/43.09, 43.01, 61.62, 17 R, 334

(56) References Cited

U.S. PATENT DOCUMENTS 5,420,385 A * 5/1995 Cooper ..... 200/43.07
5,622,253 A * 4/1997 Wecke et al. ..... 200/43.07
5,703,339 A * 12/1997 Rapp et al. ..... 200/17 R
5,821,484 A * 10/1998 Schulze et al. ..... 200/17 R
5,959,270 A * 9/1999 Wecke et al. ..... 200/43.07
6,194,674 B1 * 2/2001 Fukui ..... 200/43.04
6,307,167 B1 * 10/2001 Kajio et al. ..... 200/43.11

* cited by examiner

*Primary Examiner*—K. Lee
(74) *Attorney, Agent, or Firm*—Beyer Weaver & Thomas LLP

(57) ABSTRACT

A switch includes a switching mechanism, an operating mechanism with a key which normally causes the switching mechanism to be in a switched-off condition when it is pulled out and to be displaced against a biasing force to be in a switched-on condition when the key is inserted, and a locking mechanism for maintaining the switching mechanism locked in the switched-on condition and releasing it from the locked condition if a load greater than a specified magnitude is applied to the key while the switching mechanism is locked such that the switching mechanism is set back in the switched-off condition. The switching mechanism may be contained in a head case attached to a main case containing the operating mechanism. The main case also includes a forcing mechanism which tends to force the switching mechanism in the switched-off condition. Normally when the head case is attached to the main case, the forcing mechanism is released from its forcing function but when the head case is removed from the main case, the forcing mechanism functions to displace the switching mechanism into the switched-off condition.

18 Claims, 41 Drawing Sheets

DOOR SWITCHES

BACKGROUND OF THE INVENTION

This invention relates to switches such as limit switches and key switches usable for doors that are electromagnetically locked.

A key switch is often used on a door to a work area with power machine tools for switching power on and off by detecting the opening and closing of the door. A key is usually operated on the door while the main part of the door switch is set on a fixed frame at the doorway such that the power source for the machine tools is switched on when the door is closed and the key is inserted into a keyhole provided to the main part of the switch and switched off when the door is opened and the key is pulled out from the main part.

FIG. 15A and FIG. 15B show such a key switch with a main case 71 containing a plunger 70 which is upwardly biased by way of a spring (not shown) and a head case 73 provided with a key hole 74, and a rotary cam 72 contacting the upper end of the plunger 70 connected to the main case 71. As the cam is rotated to displace the plunger 70, a mobile terminal (not shown) associated with the plunger 70 contacts or moves away from a fixed terminal, thereby switching on and off the switch mechanism. FIG. 15A shows a key 75 not yet inserted into the keyhole 74 and the plunger 70 remaining in the pushed-in condition against the biasing force thereon such that the switch is in the switched-off condition. When the key 75 is inserted into the keyhole 74 and the door is closed, the cam 72 has rotated and the plunger 70 is released from the pushed-in condition, thereby allowing the mobile terminal to contact the fixed terminal to bring the switch into the switched-on condition.

A key switch thus structured remains in the switched-off condition unless the key 75 is inserted because the cam 72 inside the head case 73 keeps the plunger 70 pushed in. If the head case 73 is removed for a maintenance work or happens to be knocked away accidentally from the main case 71 by an external force, the force pushing in the plunger 70 may be diminished, allowing the plunger 70 to be moved by the biasing force thereon and to bring about the switched-on condition.

Thus, at the time of a maintenance work when the head case 73 is removed from the main case 71, say, for replacing a damaged head case with a new one or changing the direction of insertion of the key, the machine tools under the control of the switch may be inadvertently switched on. A similar situation may come about when wires are being connected to the main case 71 while the head case 73 is disconnected from the main case 71. Thus, it has been a common practice to switch off a source switch situated somewhere else before such work is carried out and to switch on the source switch after the work has been completed.

If an excessive force is applied to the head case 73 as the door is opened or closed and the head case 73 becomes removed from the main case 71, the door may open while the machine tools remain switched on. This may happen, for example, when the door is not provided with a door stopper and is closed with a bang such that the impulsive force of the closing is directly communicated to the head case 73. If the door is sufficiently heavy, the impulse may be sufficiently large to displace the head case 73. Moreover, when the door is closed while the key is deformed, the key 75 may hit the head case 73 without being inserted into the keyhole 74, causing the head case 73 to fly off the main case 71.

In the case of a key switch with an electromagnetic interlocking mechanism, adapted to lock its switching mechanism when the door is closed, if the electromagnetic lock is used as a lock for the door without using a hook or a latch, the head case 73 may become removed from the main case 71 when the door is forcibly opened without releasing the electromagnetic lock because the cam inside the main body is not allowed to rotate by the switching mechanism and the key is being forcibly pulled with the door while being hooked to the cam.

There are two kinds door switches for electromagnetically locking. With the mechanical lock type, the door becomes automatically locked when it is closed by a locking mechanism by a biasing force and the door is released from the locked condition by passing a current through a solenoid. With the solenoid lock type, the door is not immediately locked when it is closed and its locked condition continues only while a current passes through a solenoid to overcome the biasing force which keeps the locking mechanism in an open condition, the opening of the door becoming allowed by stopping the current through the solenoid.

With either kind, if the door is forcibly opened without carrying out the proper unlocking process while the door remains locked, the cam inside is forcibly rotated with the key pulled. As a result, the cam or the plunger operated thereby may be damaged and the cam may rotate to open the door. Thus, the power circuit may remain switched on although the door is open, the machine tools in the work area being kept running.

SUMMARY OF THE INVENTION

It is therefore an object of this invention to provide a switch capable of operating correctly even if the head case is inadvertently removed from the main body without causing the switching mechanism to operate erratically.

It is another object of this invention to provide a switch capable of operating correctly even if the key is forcibly pulled out while the switch is locked.

In one aspect, the invention relates to a switch characterized as comprising a main case including a switching mechanism and a forcing means and a head case containing an operating mechanism for the switching mechanism, wherein the head case is normally attached to the main case, the switching mechanism is subjected to a biasing force, the switching mechanism and the operating mechanism are correlated such that the switching means is kept in a first switched condition (or the switched-off condition) by opposing against the biasing force when no external operation is being effected on the operating mechanism, the switching mechanism is displaced by the biasing force and is set in a second switched condition (or the switched-on condition) when an external operation is effected on the operating mechanism, the forcing means serves to set the switching mechanism in the first switched condition by a forced displacement operation on the switching mechanism, the forcing means is released from the forced displacement operation when the head case is properly connected to the main case, and the forcing means carries out the forced displacement operation when the head case is not properly connected to the main case.

In the above, "no external operation being effected on the operating mechanism" means that nothing is being done to operate the switch, for example, by inserting a key if the switch is a key switch. The condition that the head case and the main case are not properly connected may occur when at least a portion of the head case is separated from the main case. Thus, according to this aspect of the invention, the forcing means does not operate when the head case and the main case are normally attached but when they become separated either intentionally or accidentally, this function is activated and the switching mechanism is forcibly maintained in the first switched condition in spite of the biasing force thereon to switch it to the second switched condition.

According to a preferred embodiment of the invention, the aforementioned switching mechanism includes fixed terminals, mobile terminals, a mobile member supporting these mobile terminals and a returning spring applying a force on the mobile member so as to bring about the second switched condition (or the switched-on condition) where the mobile terminals contact the fixed terminals. The first switched condition (or the switched-off condition) is where the fixed terminals and the mobile terminals are separated and is realized by displacing the mobile member against the biasing force of the returning spring. The operating mechanism comprises a plunger which contacts the mobile member, and the forcing means serves to forcibly displace the plunger. The plunger and the mobile member may be formed integrally or may be separable components. If the switch is so structured that power is supplied to machine tools, for example, when the switch is in the second switched condition, the forcing means of this invention can prevent waste of power when the head case becomes inadvertently separated from the main case.

The forcing means may be formed with a forcing member for forcing the plunger and a biasing member for biasing this forcing member towards the plunger, the forcing member being retracted against the forcing member to a retracted position not preventing the plunger from being displaced when the head case is normally connected to the main case, and the biasing member causing the forcing member to forcibly displace the plunger against the returning spring when the head case is separated from the main case. Such a forcing member may be adapted to undergo a reciprocating (swinging) motion or a rotary motion to push the plunger into undergoing a forcible displacement, depending on the kind of biasing force on the switching mechanism and the condition of stroking.

According to another embodiment of the invention, the forcing member comprises a spring member having an operating part which exerts a force on the plunger and being adapted to be elastically deformed by contacting a portion of the head case connected to the main case such that the operating part is moved to a retracted position not interfering with the displacement of the plunger. The operating part serves to cause the plunger to be forcibly displaced against the force of the returning spring when the spring member becomes separated from the portion of the head case. By using such a spring member as the forcing means of this invention, it becomes unnecessary to provide a dedicated force-providing means and hence the structure of the switch can be made simpler and the production cost can be reduced. The spring member may be provided with a lever contacting a portion of the head case such that the elastic deformation of the spring member can be controlled by the lever ratio so as to retract the operating part to a specified retracted position. By using such a lever, even a strong spring member can be easily deformed. The spring member may preferably be formed by a plate spring with the operating part and the lever formed integrally because the number of components for the production can be reduced and the assembly work becomes simpler, thereby reducing the production cost even further. The spring member may be firmly attached to the main body by suitable means such as by self-locking nuts or screws. This makes it convenient when the head case is completely removed from the main case, for example, for a maintenance work because the spring member does not become thereby displaced from the main case.

According to still another embodiment of the invention, the head case is made connectable to the main case in a plurality of different connection conditions such that the switch can be operated from different directions and the spring member can be elastically deformed under any of these connecting conditions by contacting a portion of the head case connected to the main case.

The aforementioned forcing member may be a cam, the biasing member being a spring. The cam is held at a non-interfering position so as not to prevent the plunger from being displaced when the head case is connected to the main case and is biased by the biasing spring to cause the plunger to be forcibly displaced against the returning spring when the head case is separated from the main case. In this case, the biasing spring is provided solely for providing a biasing force. Thus, there is a greater degree of freedom in selecting its strength and position, and its desired function can be performed even if the biasing force on the switching mechanism is relatively large.

According to still another embodiment of the invention, the switching mechanism includes fixed terminals, mobile terminals, a mobile member supporting the mobile terminals, a returning spring applying a force on the mobile member so as to bring about the second switched condition where the mobile terminals contact the fixed terminals elastically, the first switched condition being realized by moving the mobile member against the force of the returning spring to separate the mobile terminals away from the fixed terminals. The operating mechanism comprises a plunger which contacts the mobile member, and the forcing means includes a link for applying force directly on the mobile terminals elastically supported by the mobile member so as to forcibly separate the mobile terminals from the fixed terminals. With a switch according to this embodiment, the forcing means does not function if the head case is correctly connected to the main case, and the switching mechanism functions normally. If the head case is separated from the main case, the mobile member is displaced such that the switched condition is changed but the mobile members elastically supported by the mobile member are prevented from being displaced by the forcing means and from contacting the fixed terminals. Thus, although the mobile member is displaced, the switching mechanism is maintained in the first switched condition with the mobile terminals separated from the fixed terminals. Since the plunger is not prevented from being displaced and the link is used to directly prevent the displacement of the mobile terminals elastically supported by the mobile member, only a force large enough to overcome the biasing force for elastically pressing the mobile terminals to the fixed terminals is required in order to forcibly displace the mobile terminals. In other words, the required force is much smaller than that for preventing the plunger from being displaced. Thus, the reaction force from the forcing means to the head case when the head case is connected to the main case is reduced, and the attachment of the head case becomes easier.

The operating mechanism in the head case may preferably be a rotary cam which allows to be operated by a key inserted from outside.

A switch as described above may be conveniently used as a door switch at the entrance to a work area having automatic machine tools installed because even if the head case is removed accidentally from the main case, the switching mechanism is prevented from switching to the second switched condition (or the switched-on condition) while the door is opened.

In another aspect, the invention relates to a switch comprising a switching mechanism which can normally be at a switched-on position in a switched-on condition or at a switched-off position in a switched-off condition, an operating mechanism with a key to be inserted and pulled out to switch the switching mechanism between these conditions and a locking mechanism for normally maintaining the switching mechanism locked in the switched-on condition but releasing it from the locked condition if the key is forcibly pulled out while the key is in the locked condition. Under a normal condition, the locking mechanism functions such that the key cannot be pulled out when the switching mechanism is locked in the switched-on condition but if the key is forcibly pulled out while the key is in the locked condition, the locked condition is mechanically and forcibly released and the switching mechanism is returned to the switched-off condition. The switching mechanism may be structured with fixed terminals, mobile terminals opposite the fixed terminals, a mobile member supporting the mobile terminals and a returning spring, the switching mechanism being in a switched-on condition when the mobile member is displaced by the returning spring to thereby cause the mobile terminals to contact the fixed terminals, the switching mechanism being in a switched-off condition when the mobile member is displaced against the returning spring to thereby separate the mobile terminals from the fixed terminals. The key for the operating mechanism normally causes the switching mechanism to be at the switched-off position in the switched-off condition when it is pulled out and to be displaced against the returning spring to the switched-on position in the switched-on condition when it is inserted. With such a safety feature, damage to the components of the operating mechanism such as a rotary cam and a plunger can be prevented even if the key is pulled out inadvertently or accidentally while the switch is in the locked condition.

According to a preferred embodiment of the invention, such a switch may comprise a plunger formed either integrally with or separately from the mobile member and adapted to be displaced by the operating mechanism and to move the mobile member in coordination therewith, the locking mechanism functioning so as to cause the locked condition by engaging a locking member either with the mobile member or with the plunger, at least a portion of the locking member being more easily breakable than the mobile component engaged with the locking member so as to be damaged and to release the locked condition if a load greater than a specified magnitude is applied thereto. In the above, a portion of the locking member being more easily breakable means that it is either more fragile or weaker than the plunger or the mobile member such that it is easily bent, deformed or broken off. With such a more easily deformable or breakable portion provided, the locking member is damaged at such a predictable portion so as to be released from performing the locking function and a damage to components essential to the switching operation such as the rotary cam operated by the key and the plunger can be reliably avoided. In other words, only the locking member will be required to be replaced.

The locking member of the locking mechanism may be made engageable with the plunger, and the portion of the locking mechanism which engages with the plunger may be caused to bend or deform the locking member or break off when subjected to a load greater than a preset magnitude. Under a normal condition, the locking member thus structured will properly engage with the plunger and prevent the key from being pulled out but if the key is forcibly pulled out while the switch is locked, the locking member is deformed, bent at the position ("the engaging part") where it engages with the plunger, becoming separated from the plunger such that the locked condition is released and the key becomes removable. Thus, the switching mechanism returns to the switched-off condition in which it should normally be if the key is not inserted. This embodiment can be realized easily and inexpensively because the desired function can be provided merely by changing the shape of a prior art locking member to make is bendable or breakable.

The engaging part of a deformed locking member may be adapted to engage with the mobile member or the plunger at the switched-off position to prevent the mobile member from being displaced to the switched-on position by the biasing force. In this way, if the key is forcibly pulled out while the switch is locked, the engaging part of the bent and deformed locking member at the switched-off position engages with the mobile member or the plunger to keep it at the position. Thus, even if the key is inserted again, the switched-on condition is not brought about, and the damaged condition of the switch is easily ascertained for a repair work.

According to a preferable embodiment, when the engaging part of the mobile member is bent and deformed, it is prevented by contacting the mobile member or the plunger at the switched-on position from moving to the normal locking position. If the key is forcibly pulled out while the switch is locked, the locking member is released from the locked condition, say, by means of an electromagnetic solenoid and, even if the key is inserted again and the switched-on condition is brought about, the locking member with its engaging part bent and deformed cannot advance to the normal locking position. A contact point for monitoring the switching of the locking mechanism to the locking position is connected in series with the switching mechanism such that power cannot be introduced even if the key is inserted again after it is once pulled out forcibly while the switch is locked. In other words, once the key is forcibly pulled out to damage the switch, the locking member becomes unable to advance to its normal locking position. With the use of such a monitoring contact point, inadvertent introduction of power can be prevented.

According to still another embodiment, the locking member locks the switching mechanism in the switched-on position by contacting the mobile member and the contact part at which the locking member contacts the mobile member is made weaker so as to deform or break off by a load greater than a preset magnitude. If the key is forcibly pulled out while the switch is locked, the contacting part of the locking member contacting the mobile member is deformed or breaks off, the locked condition being released and the key being pulled out. Thus, the operating mechanism such as the rotary cam is not damaged and the switching mechanism is set in the normal switched-off condition normally brought about when the key is not inserted. This embodiment can be realized simply and inexpensively by modifying a portion of the locking member contacting the mobile member so as to bend or to break off.

The mobile member may be provided with a groove and the locking mechanism with a holding part which engages in this groove when the mobile member moves to the switched-off position after the contact part is deformed or broken off. In this manner, when the key is forcibly pulled out when the switch is locked, the holding part engages in the groove on the mobile member such that the mobile member which has been displaced to the switch-off position is maintained at this switched-off position and that the switched-on condition is not brought about even if the key is inserted again after it has once been pulled out forcibly. Thus, the damaged condition of the switch is easily ascertained and a repair work can be carried out quickly.

According to still another embodiment, the locking member contacts the mobile member to thereby lock the switching mechanism in the switched-on position, the locking member retracting against the returning spring to allow the mobile member to be displaced to the switched-off position. According to this embodiment, if the key is forcibly pulled out while the switch is locked, the locking member is retracted against the biasing force thereon and hence the locked condition is released. The rotary cam and the plunger are not damaged and the switching mechanism returns to the switched-off condition as it normally should when the key is not inserted. This desired function is achievable inexpensively, say, by merely forming a cam surface at the contacting part such that the locking member will be retracted when an excessively large load is applied.

The displaced mobile member may be further so arranged to become engaged to and held by the locking member when a load greater than a preset magnitude is applied. With this arrangement, if the key is forcibly pulled out while the switch is locked, not only is the locking member retracted against the biasing force thereon and the switching mechanism returns to the switched-off condition, but the mobile member retracted to the switched-off position is engaged to and held by the mobile member which has been retracted so as not to move to the switched-on position even if the key is inserted again. Thus, the damaged condition of the switch can be easily ascertained and a repair work can be quickly carried out.

According to a preferred embodiment, there are a plurality of plungers or mobile members. The locking mechanism locks the switching mechanism by engaging the locking member with one of the mobile members or plungers. The engaged one of the mobile members or plungers is deformed so as to unlock the switching mechanism when a load greater than a specified magnitude is applied to the key while the switching mechanism is locked. Such plungers may be formed either integrally with the mobile member or separately. With a switch thus formed, the mobile member or the plunger to which the locking member is engaged is damaged if the key is forcibly pulled out while the switching mechanism is locked. The locked condition is released and the key is pulled out. Thus, neither the rotary cam nor the plunger will be damaged and the switching mechanism is set in the normal switched-off condition.

According to still another embodiment of the invention, an electromagnetic solenoid is provided for locking and unlocking the switching mechanism and the terminals undergo switching operations accordingly as the switching mechanism is locked and unlocked. Such a switch can be conveniently used as a door switch at the entrance to a work area with machine tools for switching power on and off for these machine tools.

BRIEF DESCRIPTION OF THE DRAWINGS

Throughout herein, components that are substantially the same or at least similar or equivalent are indicated by the same symbols and may not necessarily be described or explained repetitiously for the convenience of the disclosure even if these components are components of different embodiments.

DETAILED DESCRIPTION OF THE INVENTION

Figure 1:
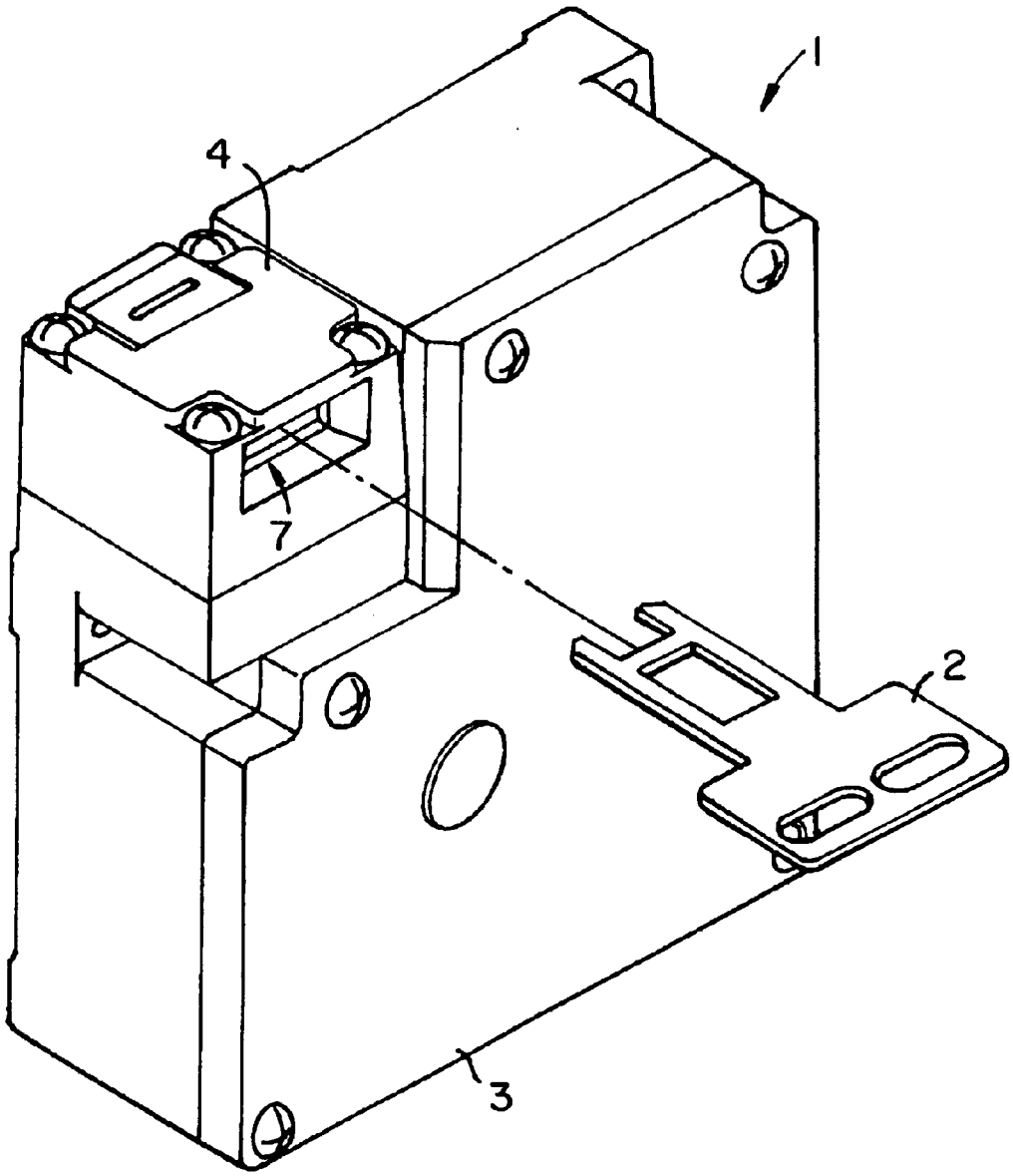
FIG. 1 is a diagonal view of a key switch embodying this invention.

FIG. 1 shows a key switch embodying this invention which may function as a door switch, say, at the entrance to a work area with machine tools, comprising a main body 1 with or without an interlocking mechanism adapted to be affixed to a frame at such an entrance and a key 2 to be inserted to open or close a door.

Figure 2:
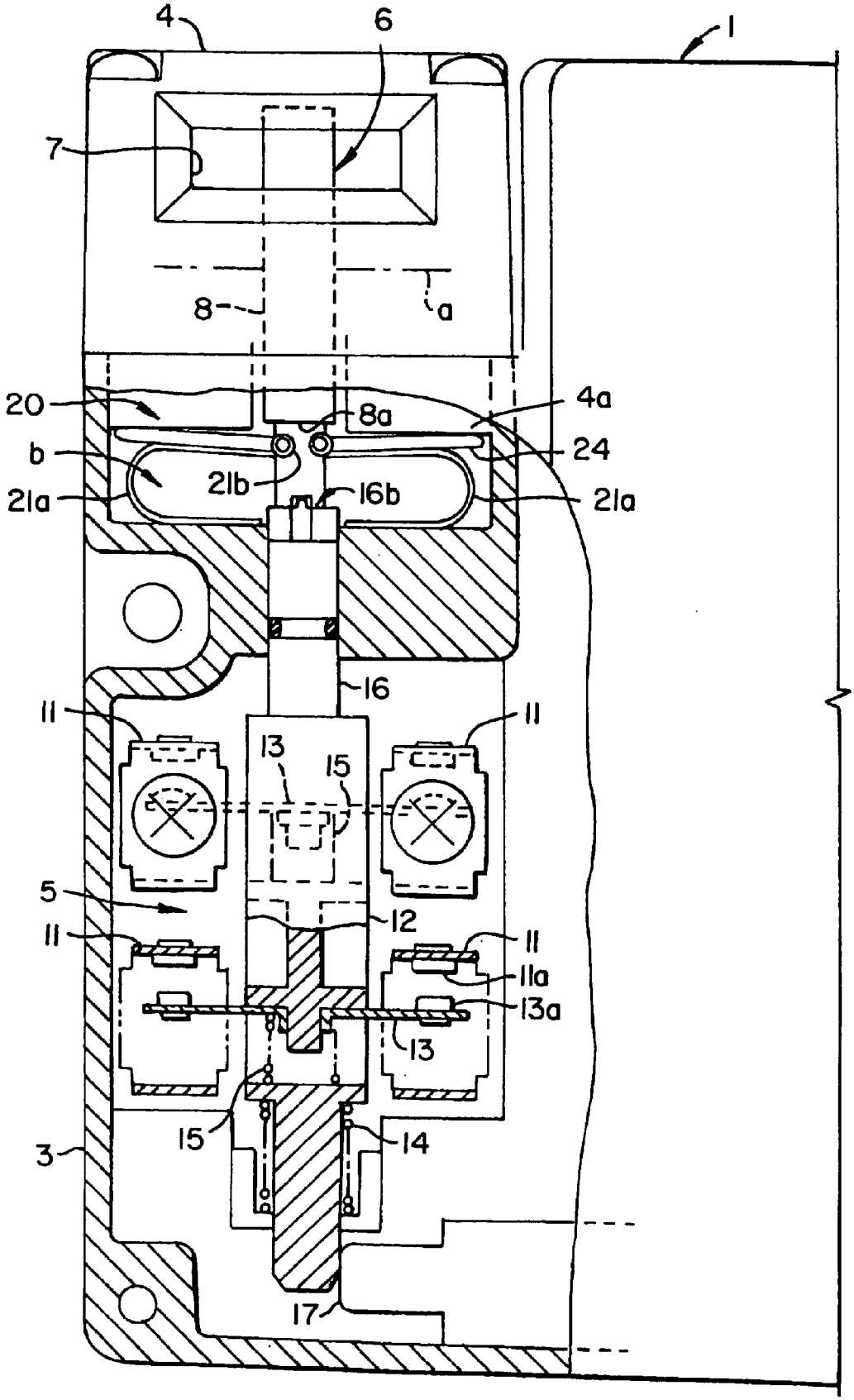
FIG. 2 is a front view of the key switch of FIG. 1 for showing its interior structure when the key is pulled out.

The main body 1 includes a main case 3 and a head case 4 connected to the main case 3 by screws. As shown in FIG. 2, a switching mechanism 5 is contained inside the main case 3 on the left-hand side and a locking mechanism (not shown) is on the right-hand side. The head case 4 also contains an operating mechanism 6 for operating the switching mechanism 5, and a keyhole 7 is formed on its front surface.

The switching mechanism 5 is comprised of two pairs of fixed terminals 11 affixed to the main case 3 and two pairs of mobile terminals 13 supported by an upwardly and downwardly mobile member 12 biased upward by a returning spring 14. Each mobile terminal 13 is elastically supported by a stroke-absorbing spring 15 so as to be able to be backwardly displaced.

FIG. 2 shows the switch in the switched-off condition with the mobile member 12 moved downward against the biasing force of the returning spring 14. At this moment, mobile contact points 13*a* at both ends of each mobile terminal 13 are separated from fixed contact points 11*a* at both ends of each of the fixed terminals 11 such that a power circuit connected to the external connecting parts of the fixed terminals 11 is switched off. When the mobile member 12 is moved upward by the biasing force of the returning spring 14, each mobile contact point 13*a* contacts the corresponding one of the fixed contact points 11*a* to switch on the power circuit. The upper end of the mobile member 12 is connected to a plunger 16 which penetrates into the head case 4 to be opposite to the operating mechanism 6.

Figure 3:
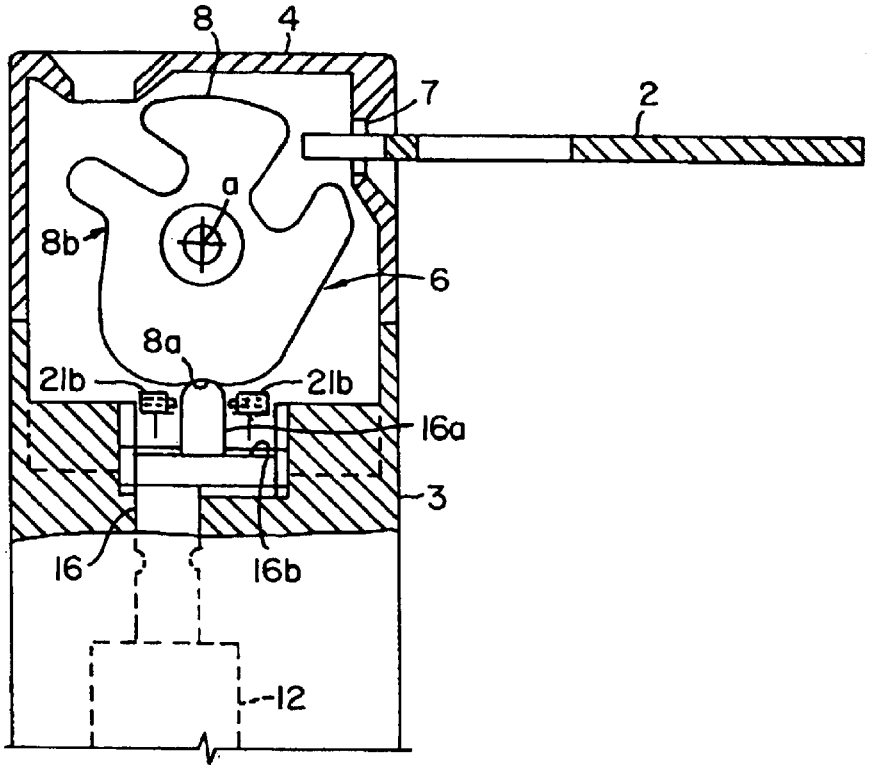
FIG. 3 is a vertical sectional side view of the head case when the key is pulled out.

The operating mechanism 6 includes a rotary cam 8 supported rotatably around a horizontal axis "a" and shaped such that it can be rotated in positive and negative directions as the key 2 is pushed in and pulled out of the keyhole 7. As shown in FIGS. 2 and 3, its shape is such that the plunger 16 is pushed downward by a large-diameter part 8*a* of the rotary cam 8 against the biasing force of the returning spring 14 when the key is pulled out such that the mobile member 12 is displaced downward and the switch is placed in the switched-off condition.

Figure 5:
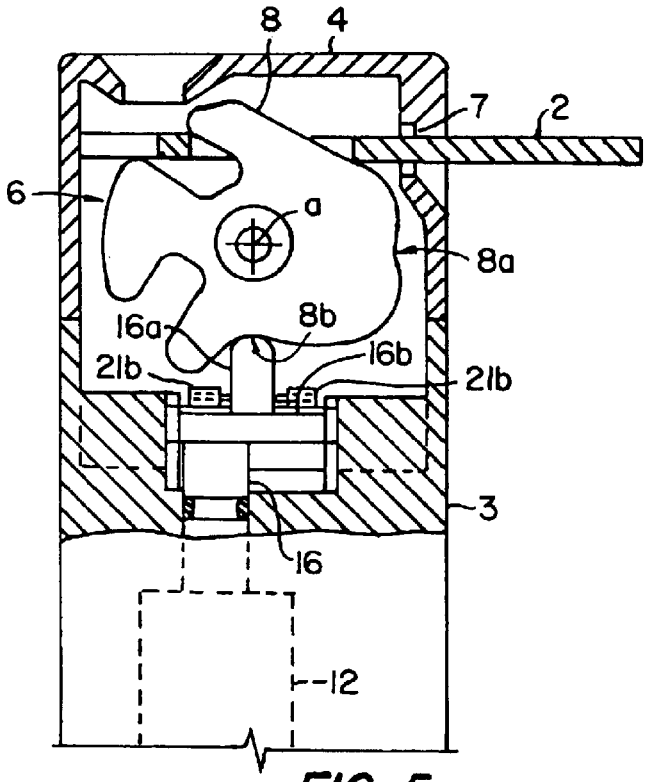
FIG. 5 is a vertical sectional side view of the head case when the key is inserted.
Figure 4:
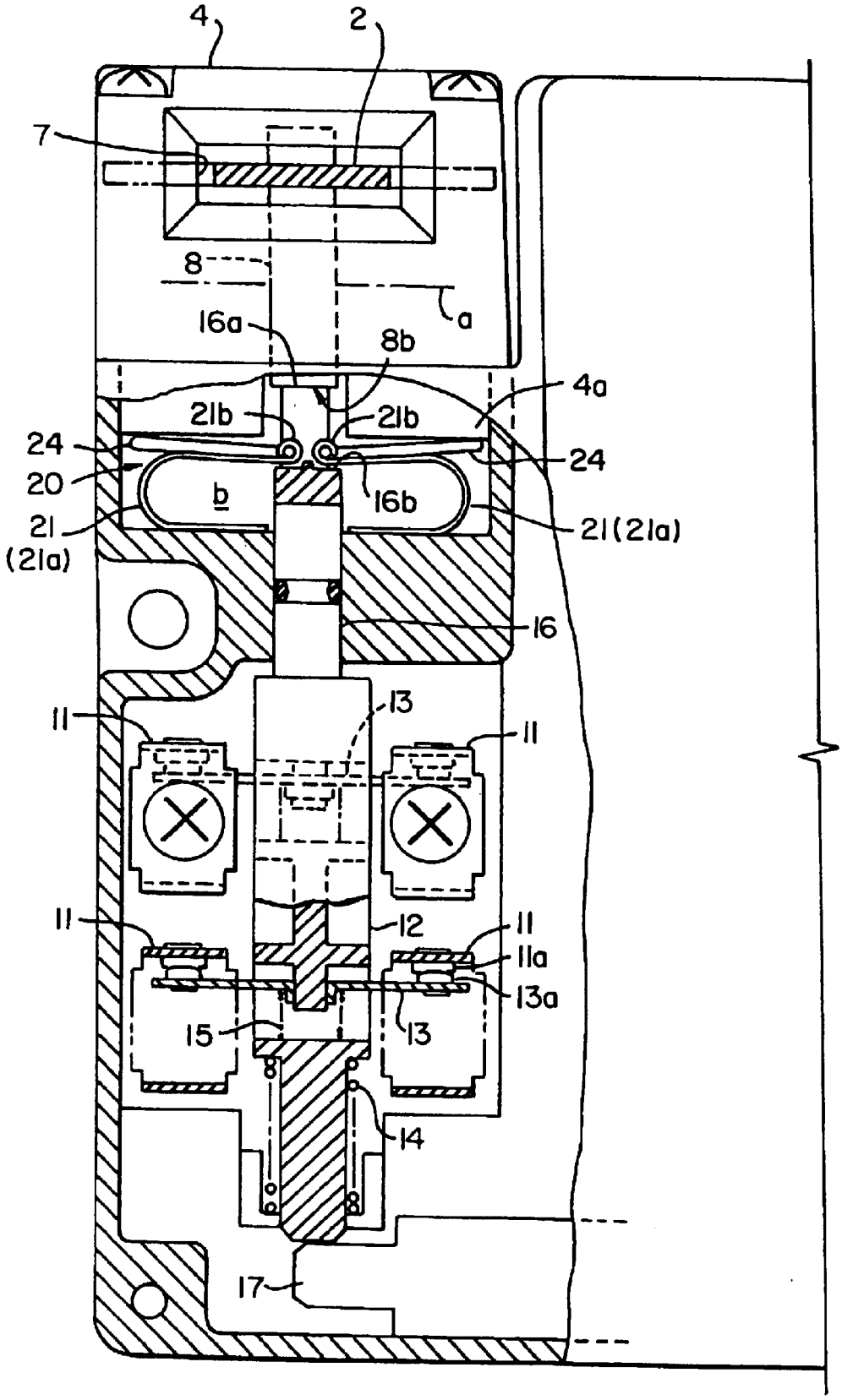
FIG. 4 is a front view of the key switch of FIG. 1 for showing its interior structure when the key is inserted.

When the key 2 is inserted and the rotary cam 8 is rotated in the counterclockwise direction with reference to FIG. 3, the plunger 8 engages with an indentation 8*b* on the rotary cam 8, as shown in FIGS. 4 and 5, and becomes upwardly movable. The mobile member 12 is therefore displaced upward and the switched-on condition is realized. Thus, even if the contact points become bonded together, they can be forcibly separated by forcibly pushing down the mobile member 12 by means of the rotary cam 8.

When the key 2 is pulled out and the switch is in the switched-off condition, the rotary cam 8 is prevented from rotating by means of a locking member (not shown) such that the rotary cam 8 will not be operated by any means other than the key 2. When the key 2 is inserted, this locking member is retracted by the key 2 and the cam 8 becomes rotatable and, as the key 2 is further pushed in, the switch is switched on.

When the switch is in the switched-on condition, the locking member 17 is moved under the mobile member 12 by a biasing force so as to prevent the mobile member 12 from becoming displaced downward and the rotary cam 8 from rotating in the reverse direction. This prevents the key 2 from being pulled out. If an operation to stop the machine tools in the work area is effected outside the work area, the locking member 17 is retracted, say, by means of a solenoid, and the key 2 becomes retractable and hence the door becomes openable.

The structure described above is not particularly different from conventional switches, but the present invention is characterized as providing means for preventing the switching mechanism 5 from switching from a switched-off condition to a switched-on condition when the head case 4 is separated from the main case 3. Some examples of carrying out this function are described below.

FIGS. 2–7 show an example characterized as an operating room "b" formed near the top of the main case 3, closed by the engagingly connected head case 4 and containing a forcing means 20 for displacing the plunger 16 into it against the biasing force of the returning spring 14.

Figure 7:
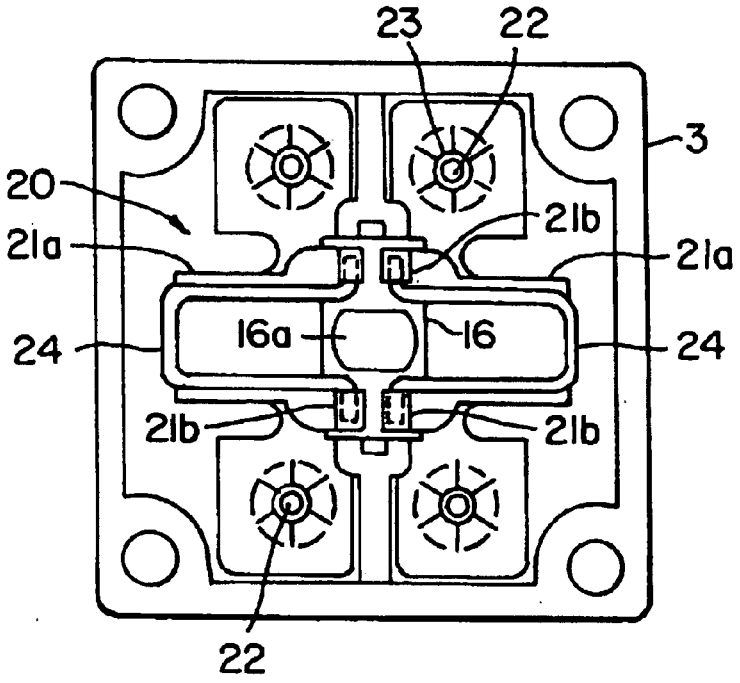
FIG. 7 is a plan view for showing an example of forcing means according to this invention.

The forcing means 20 comprises a pair of right-hand and left-hand spring members 21 for forcibly displacing the plunger 16 which is disposed between these spring members 21 so as to be vertically movable. The spring members 21 are formed by punching out from and bending a plate spring and are attached to connector pins 22 standing on the bottom surface of the operating room "b" through connector openings 23, as shown in FIG. 7. Each spring member 21 has an operating arm 21*a* bent and extended towards the plunger and a pair of operating parts 21*b* is formed by bending the free end part of each spring member 21 engagingly connected to the tip of an operating lever 24 formed by bending a linear member in a U-shape such that the operating lever 24 is disposed on the upper surface of the operating arm 21*a*.

Figure 6:
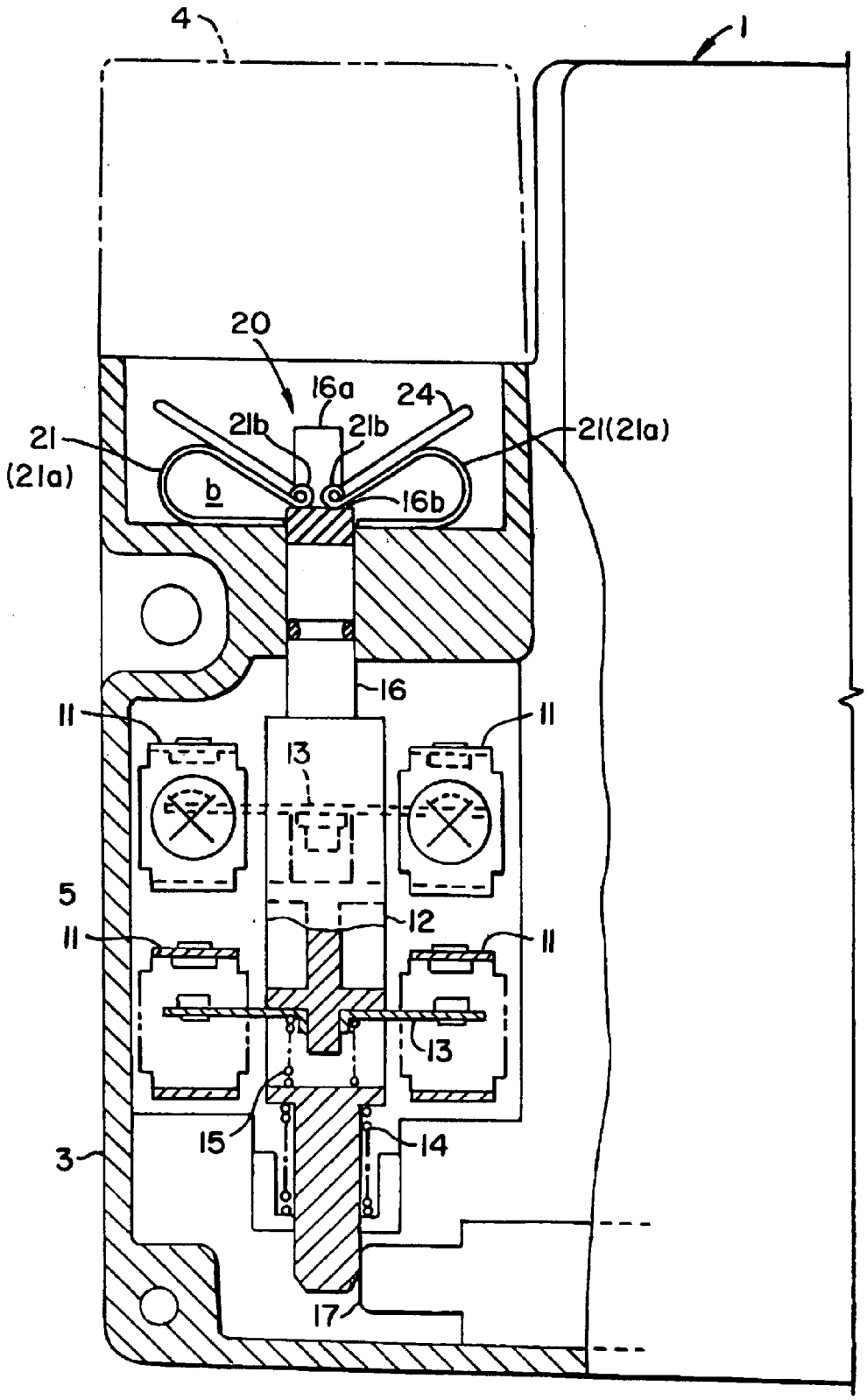
FIG. 6 is a front view of the key switch of FIG. 1 for showing its interior structure when the head case is removed.

The spring member 21 is set such that, when it is in a free condition as shown in FIG. 6, its operating part 21*b* will be positioned near the bottom surface of the operating room "b". The plunger 16 has an operating end part 16*a* at the top, facing the outer peripheral surface of the rotary cam 8 from below, and an upwardly facing step part 16*b* is formed immediately below, opposite the operating part 21*b* of the operating arm 21*a*.

When the head case 4 is properly set on the top end of the main case 3, as shown in FIG. 2, a part 4*a* of the head case 4 pushes down the free ends of the operating lever 24 at each of the spring members 21 such that the operating arms 21*a* of the spring members 21 are deformed upward and the operating parts 21*b* of the operating arms 21*a* are displaced upward. When thus displaced upward, the operating parts 21*b* are at sufficiently retracted positions for allowing the plunger 16 to move upward so as to bring about the aforementioned switched-off condition. The plunger 16 moves upward or downward, depending on the direction of rotation of the rotary cam 8, such that the switching mechanism 5 can function in the intended manner.

If the head case 4 is removed from the main case 3 for the purpose of maintenance or knocked off the main case 3 accidentally, the operating arms 21*a* of the spring members 21 are freed from the compressive force from the part 4*a* of the head case 4 and elastically return to their natural forms such that the operating parts 21*b* move downward. The elastic returning force of the operating arms 21*a* is arranged to be stronger than the upwardly biasing force of the returning spring 14 operating on the mobile member 12 such that the operating parts 21*b* press the plunger 16 downward against the upwardly facing step part 16*b*, while returning downward by its elastic returning force, thereby forcibly preventing the plunger 16 from becoming displaced upward. Thus, even if the head case 4 is removed from the main case 3, the upwardly biased plunger 16 is prevented from moving upward by the forcing means 20 such that the switched-off condition as shown in FIG. 6 can be maintained.

Since the spring members 21 are attached to the connector pins 22 standing up from the bottom surface of the operating room "b" inside the main case 3, the spring members 21 do not become separated from the main case 3 even if the head case 4 is completely separated from the main case 3, for example, for carrying out a maintenance work. The head case 4 may be connected to the main case 3 in different directions in order to vary the direction of the keyhole 7 such that the key 2 can be inserted in different directions but a lower portion of the head case 4 can compress the free end part of the operating lever 24 of each spring member 21 no matter in what direction the head case 4 is connected to the main case 3.

The head case 4 need not become separated completely from the main case 3. If the head case 4 is tilted, for example, such that at least a portion of it is separated from the main case 3, the operating arm 21*a* of the spring member 21 can maintain the switched-off condition by becoming released from the compressive force of the head case 4.

Figure 9:
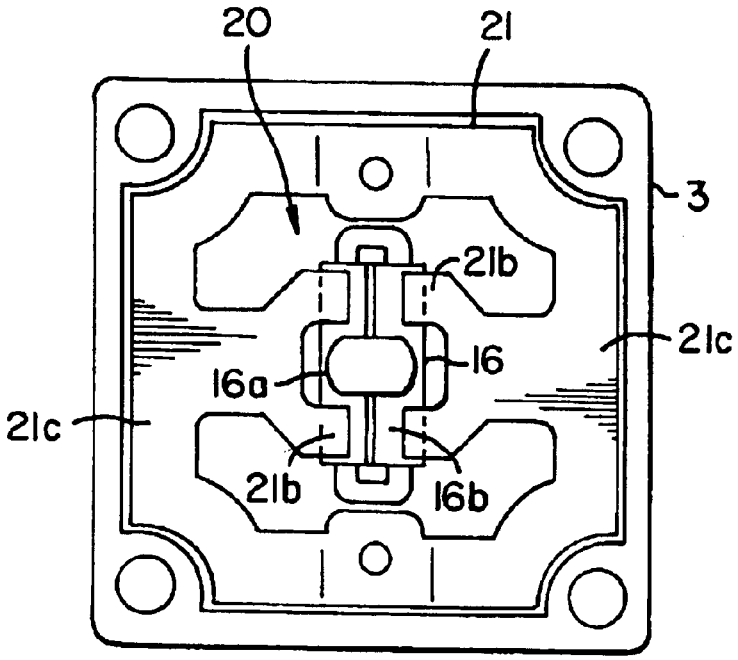
FIG. 9 is a plan view for showing another example of forcing means.
Figure 8:
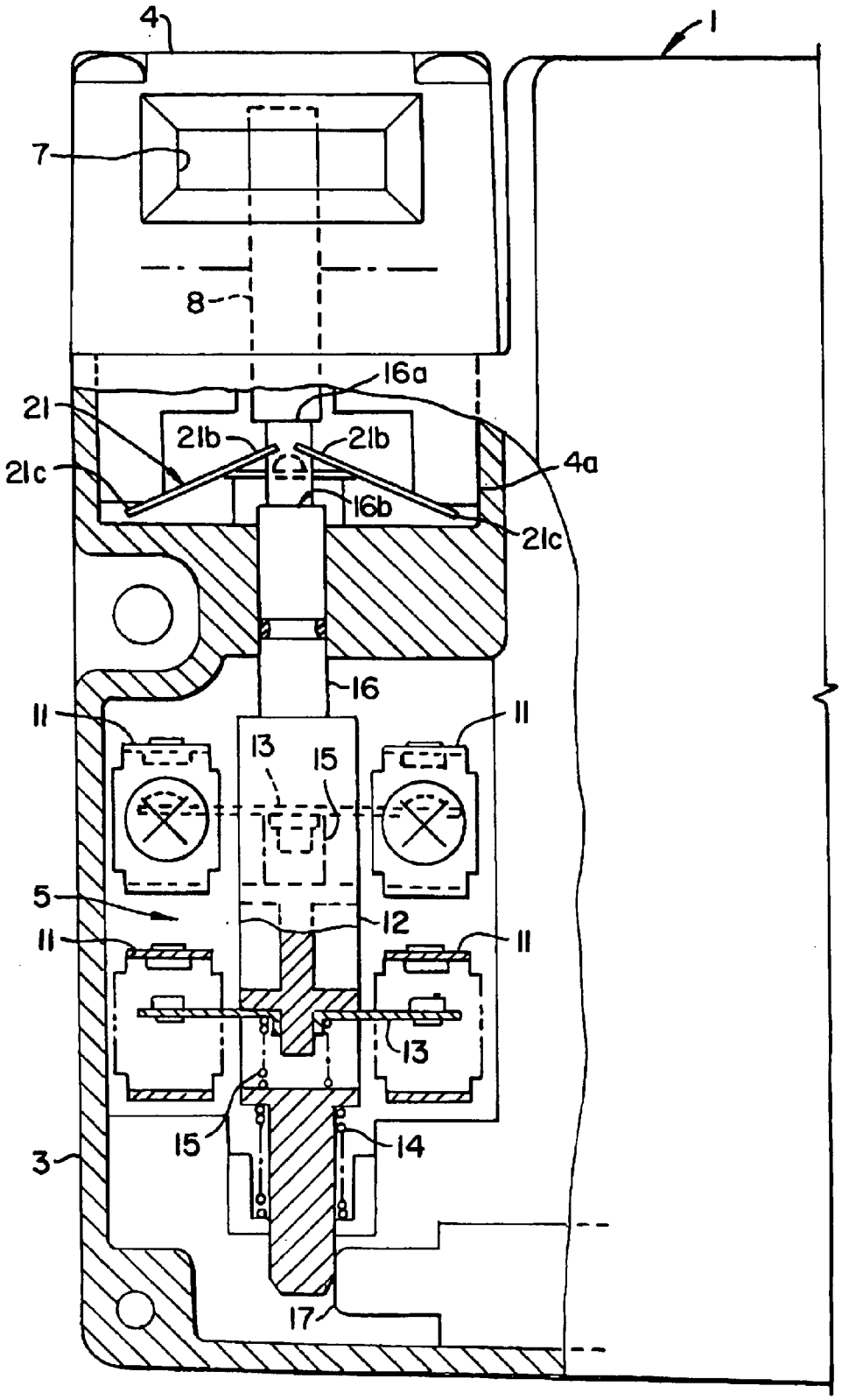
FIG. 8 is a front view for showing the interior structure of a key switch provided with forcing means of another form when the key is pulled out.
Figure 10:
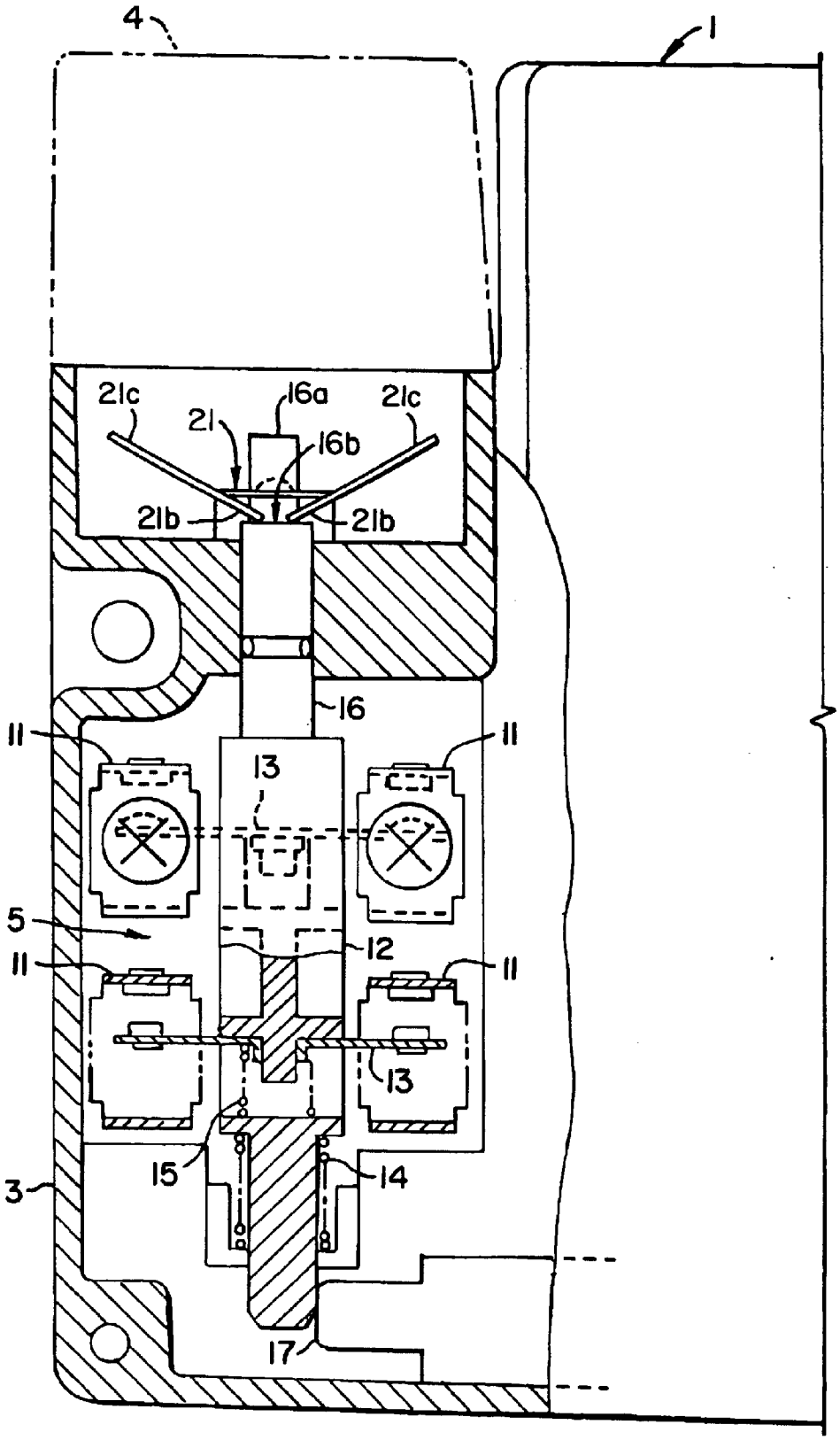
FIG. 10 is a front view for showing the interior structure of another key switch.

FIGS. 8–10 show a deformed example of the spring member 21 forming the forcing means 20, characterized as having the spring member 21 formed of a single sheet of plate spring such that its operating part 21*b* opposite the step part 16*b* of the plunger 16 and the operating level 21*c* are formed integrally. In other aspects, this spring member 21 is structured in the same way as the spring member described above with reference to FIGS. 1–7. With this example, too, when the head case 4 is properly engaged with and connected to the upper end of the main case 3, the operating parts 21*b* of the spring members 21 become retracted as shown in FIG. 8 to allow the plunger 16 to move sufficiently for changing the switched condition (on or off) with a part 4*a* of the head case 4 pressing down the operating levers 21*c*. If the head case 4 becomes separated from the main case 3, the operating parts 21*b* of the spring members 21 are freed from the compression by the part 4*a* of the head case 4 and move downward to press the plunger 16 by its step part 16*b* to forcibly prevent the plunger 16 from moving upward by the biasing force thereon and to maintain the switched-off condition.

Figure 11A:
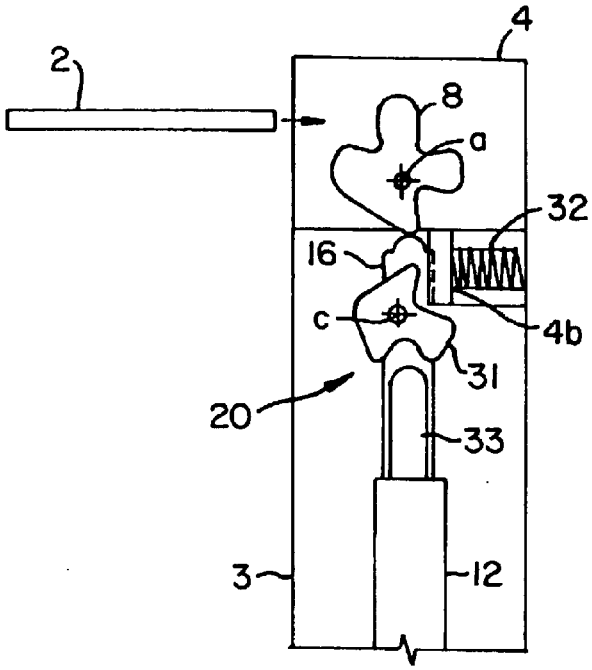
FIGS. 11A, 11B and 11C (together referred to as FIG. 11) are schematic side views for showing the operation of a key switch provided with a third example of forcing means.
Figure 11B:
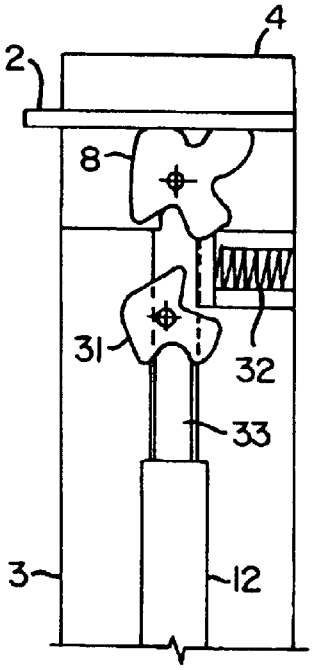
Figure 11C:
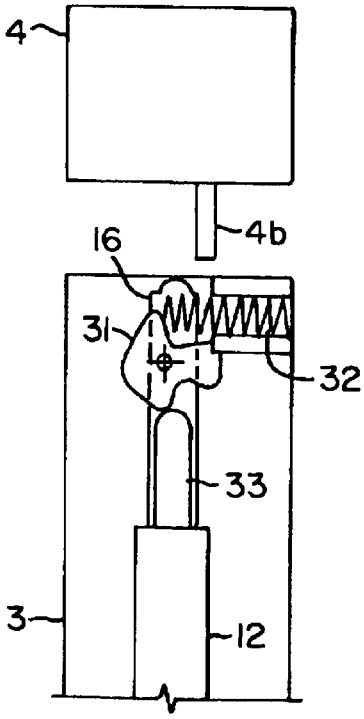

FIG. 11 shows another form of the aforementioned forcing means 20, comprising a cam 31 which is rotatable around a horizontal axis "c", a spring 32 applying a biasing force on this cam 31 in the counter-clockwise direction, a plunger 33 to be forcibly displaced which is disposed opposite to the upper end of a mobile member 12 so as to be movable upward and downward by the rotation of the cam 31. When the head case 4 is properly engaged with and connected to the upper end of the main case 3 in this example, a protrusion 4*b* from the head case 4 receives the tip of the spring 32 such that the biasing force of the spring 32 does not operate on the cam 31. In this situation, the plunger 33 is positioned so as to allow the mobile member 12 to move upward and downward, as shown in FIGS. 11A and 11B. If the head case 4 is separated from the main case 3, the spring 32 is freed from the constraint by the protrusion 4*b* and causes the cam 31 to rotate in the counter-clockwise direction by its biasing force, as shown in FIG. 11C. The rotating cam 31 pushes the plunger 33 downward to forcibly prevent the mobile member 12 from moving upward by the biasing force, thereby maintaining the switched-off condition.

Figure 12A:
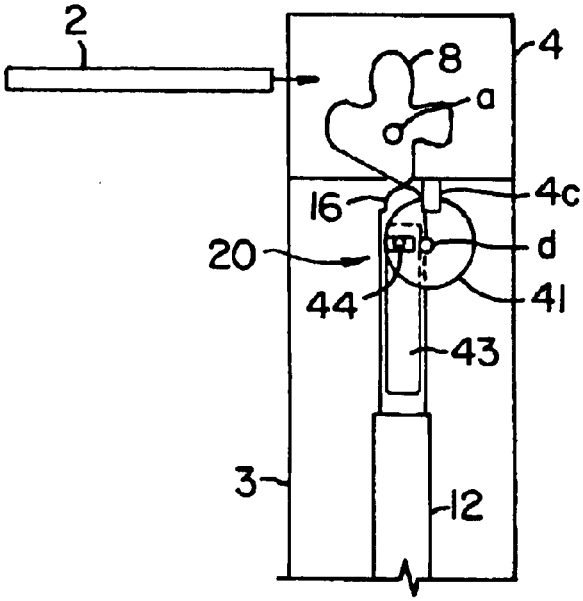
FIGS. 12A, 12B and 12C (together referred to as FIG. 12) are schematic side views for showing the operation of a key switch provided with a fourth example of forcing means.
Figure 12B:
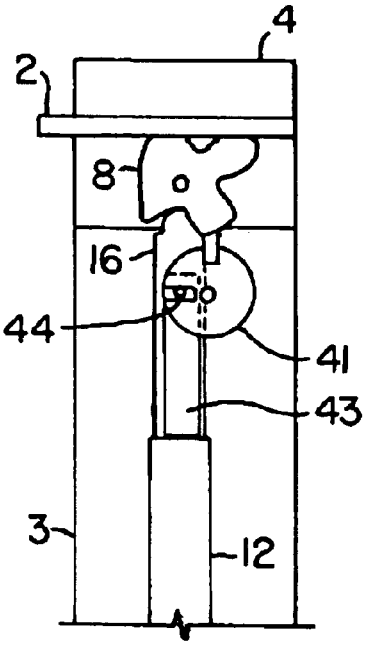
Figure 12C:
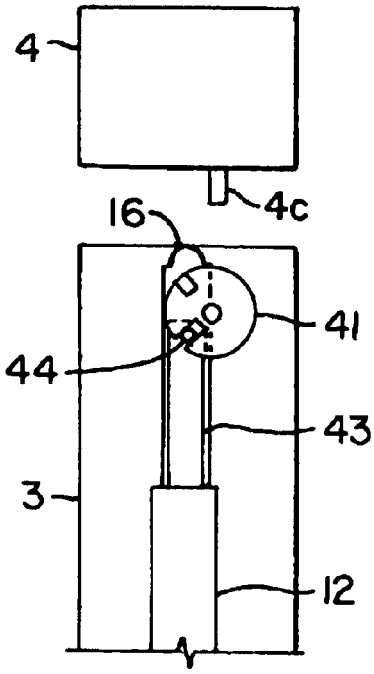

FIG. 12 shows still another form of forcing means 20, comprising a cam 41 which is rotatable around a horizontal axis "d", a torsion spring (not shown) biasing the cam 41 in the counter-clockwise direction and a plunger 43 disposed so as to contact the top end of a mobile member 12 and to forcibly displace it, the cam 41 being disposed so as to engage with a pin 44 on the plunger 43. With this example, when the head case 4 is properly engaged with and connected to the upper end of the main case 3, a protrusion 4*c* from the head case 4 engages with the cam 41 and prevents the cam 41 from rotating and the plunger 43, engaged to the cam 41 through the pin 44, is maintained at such a height that would allow the mobile member 12 to move upward and downward, as shown in FIGS. 12A and 12B. When the head case 4 is separated from the main case 3, as shown in FIG. 12C, the cam 41 is freed from the constraint by the protrusion 4*c* and is caused to rotate in the counter-clockwise direction by the biasing force of the torsion spring, pressing the plunger 43 downward and thereby forcibly preventing the mobile member 12 from moving upward by the biasing force thereon. The switched-off condition is thus maintained.

Figure 13A:
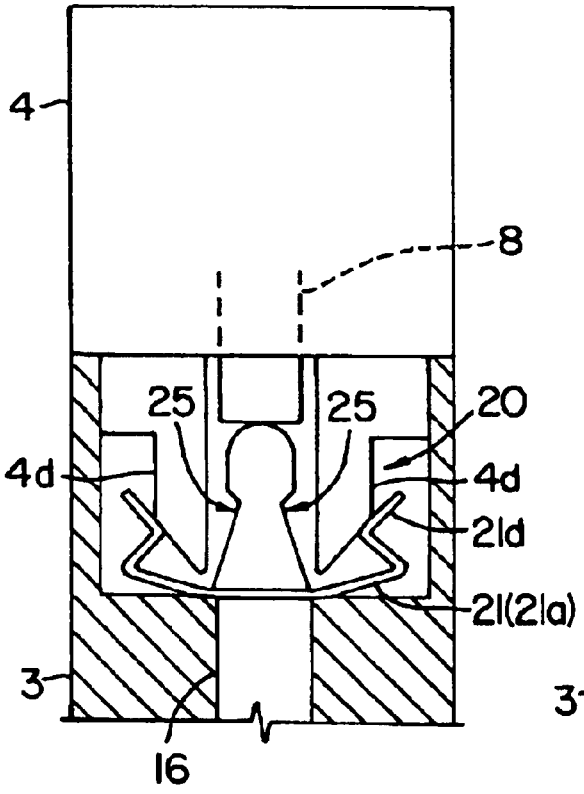
FIGS. 13A and 13B (together referred to as FIG. 13) are schematic side views for showing the operation of a key switch with a fifth example of forcing means.
Figure 13B:
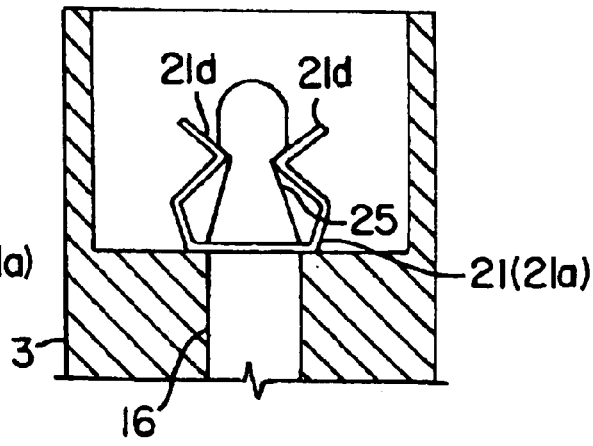

FIG. 13 shows still another kind of forcing means 20 comprising a spring member 21 made by punching from and bending a plate spring and attached to the bottom surface of the operating room "b" and an upwardly and downwardly movable plunger 16 disposed at the center part of the spring member 21. The spring member 21 has a pair of operating cantilever arms 21*a* extended and bent towards the plunger 16, and the free end of each operating arm 21*a* is bent in a hill-shape to form an operating part 21*d*. The outer periphery of the plunger 16 where it faces these operating parts 21*d* is indented to form a cam 25. With this example, when the head case 4 is properly engaged with and connected to the upper end of the main case 3, a protrusion 4*d* from the head case 4 is forcibly pushing and thereby opening the operating arms 21*a* of the spring member 21 as shown in FIG. 13A such that the plunger 16 is freely movable upward or downward therebetween corresponding to the rotation of the rotary cam 8 and to thereby switch on and off the switch. When the head case 4 is separated from the main case 3, the operating arms 21*a* are freed from the constraint by the protrusion 4*d*, as shown in FIG. 13B, and return to their natural positions, engaging with the indented cam 25 around the plunger 16 and thereby pressing the plunger 16 downward and forcibly preventing the mobile member 12 from moving upward by the biasing force thereon. Thus, the switch is maintained in its switched-off condition.

Figure 14A:
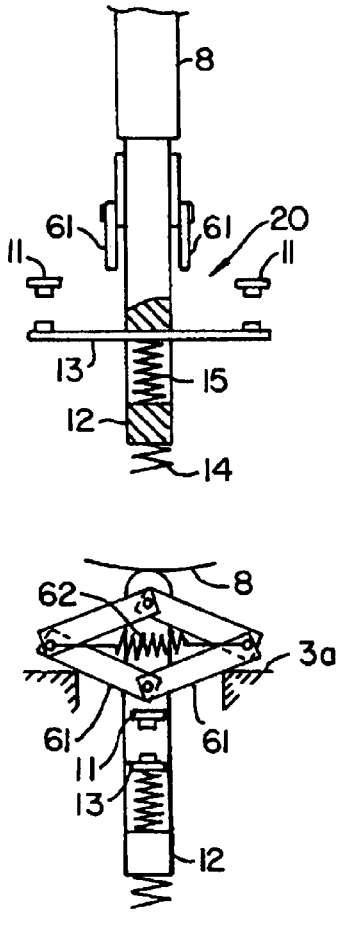
FIGS. 14A, 14B and 14C (together referred to as FIG. 14) are schematic side views for showing the operation of a key switch with a sixth example of forcing means.
Figure 14B:
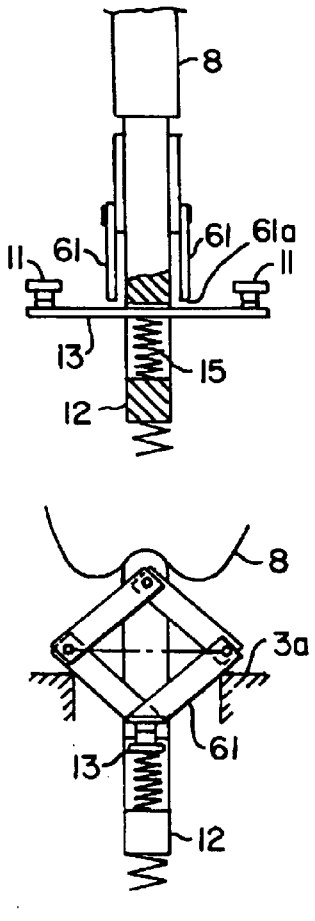
Figure 14C:
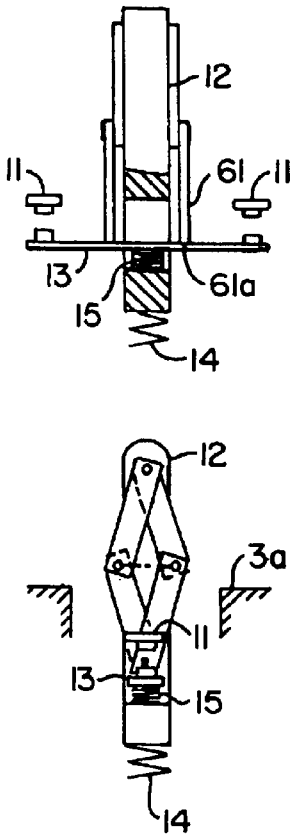
Figure 15A:
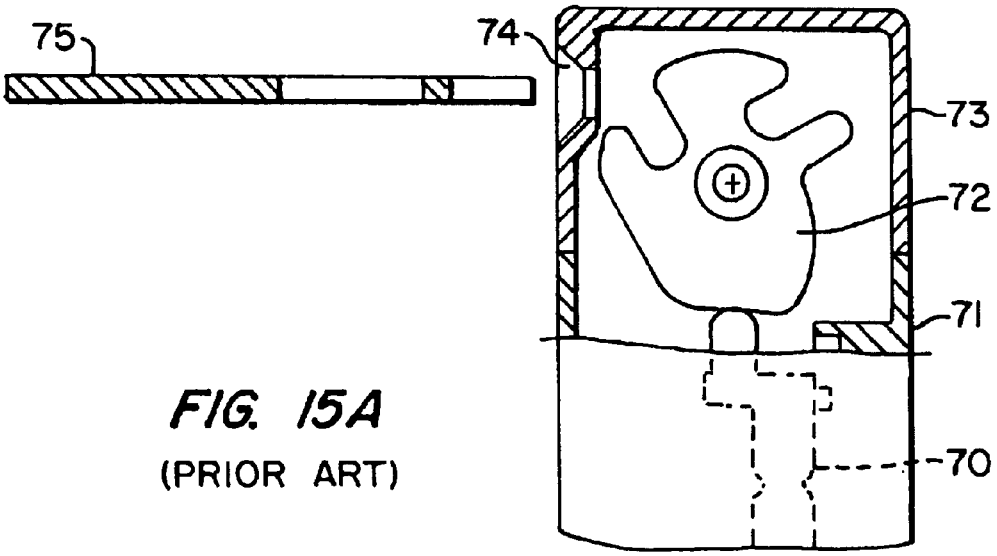
FIG. 15A (PRIOR ART)
FIGS. 15A and 15B (together referred to as FIG. 15) are side views of a prior art key switch.
Figure 15B:
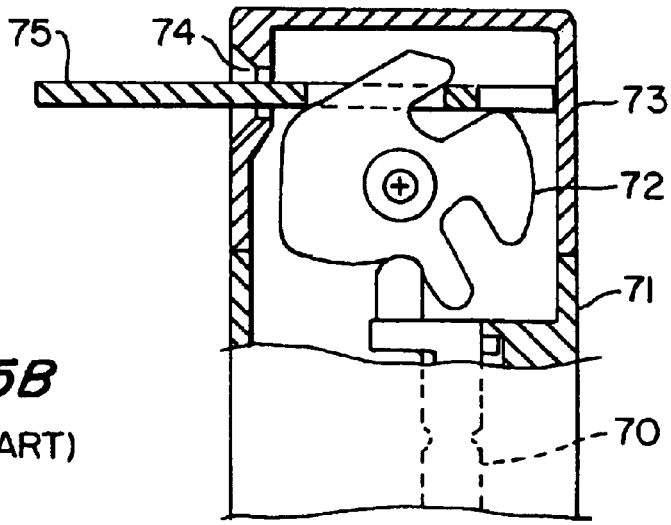
FIG. 15B (PRIOR ART)

FIG. 14 shows still another kind of forcing means 20 comprising two pairs of extendable links 61 in the shape of a pantograph attached to the mobile member 12 and a spring 62 for applying a biasing force to the links 61 to maintain them in an extended condition such that the lower end parts 61*a* of the links 61, disposed opposite the top of the mobile terminal 13, will move upward and downward as the links 61 are extended and retracted. With this example, when the head case 4 is properly engaged with and connected to the upper end of the main case 3, the links 61 contact a contacting member 3*a* provided to the main case 3 as shown in FIG. 14A and are prevented from extending downward. Even if the key is inserted to cause the rotary cam 8 to be rotated and the mobile member 12 is displaced upward, as shown in FIG. 14B, the downward displacement of the links 61 contacting the contacting member 3*a* is small, and the upwardly displaced mobile terminal 13 does not interfere with the lower end parts of the links 61. Thus, the mobile terminal 13 moves freely upward to securely contact the fixed terminal 11. If the head case 4 is separated from the main case 3, the mobile member 12 is freed from the constraint by the rotary cam 8 and would become displaced upward by a distance greater than necessary to bring about a switched-on condition but the links 61, freed from the contact with the contacting member 3*a*, extend downward sufficiently such that their lower end parts 61*a* push down the mobile terminal 13 against the biasing force of the spring 15, thereby preventing its contact with the fixed terminal 11. Thus the switched-off condition is maintained.

Although a limited number of examples have been shown above, the invention is not intended to be limited by these examples. Many modifications and variations are possible within the scope of the invention. Firstly, the spring members 21 described above need not be made from a plate spring but may be made of an elastic linear material. Secondly, the cams 31 and 41 described above need not be rotary cams. Sliding cams may be substituted therefor. Thirdly, the peripherally formed cam 25 shown in FIG. 13 may be formed as a protrusion. Fourthly, the present invention may be applied not only to key switches but also to limit switches structured so as to be operated by means of a lever provided to the head case 4. Fifthly, although the examples were described above for normally closed switches, they can be applied to switches having both normally open and normally closed contact points.

According to the embodiments of the invention described above, therefore, a switching mechanism can be maintained in the switched-off condition (or a "first switched condition") by a forcing means even if the head case is separated from the main case. Thus, even if the first switched condition is the switched-off condition (and a second switched condition is a switched-on condition), machine tools in a work area are not inadvertently switched on when the head case becomes accidentally or intentionally removed from the main case. This makes it unnecessary to turn off a main switch somewhere else before carrying out a maintenance work requiring the removal of the head case and hence the present invention improves the efficiency of maintenance operations. If the present invention is used for a door switch, as mentioned above, situations can be avoided where a door is allowed to open while machine tools are operating inside a work area. Since the forcing means is operated on a plunger, the switching mechanism itself does not have to be modified. In other words, prior art switching mechanisms can be used to produce a switching mechanism according to this invention.

Figure 16:
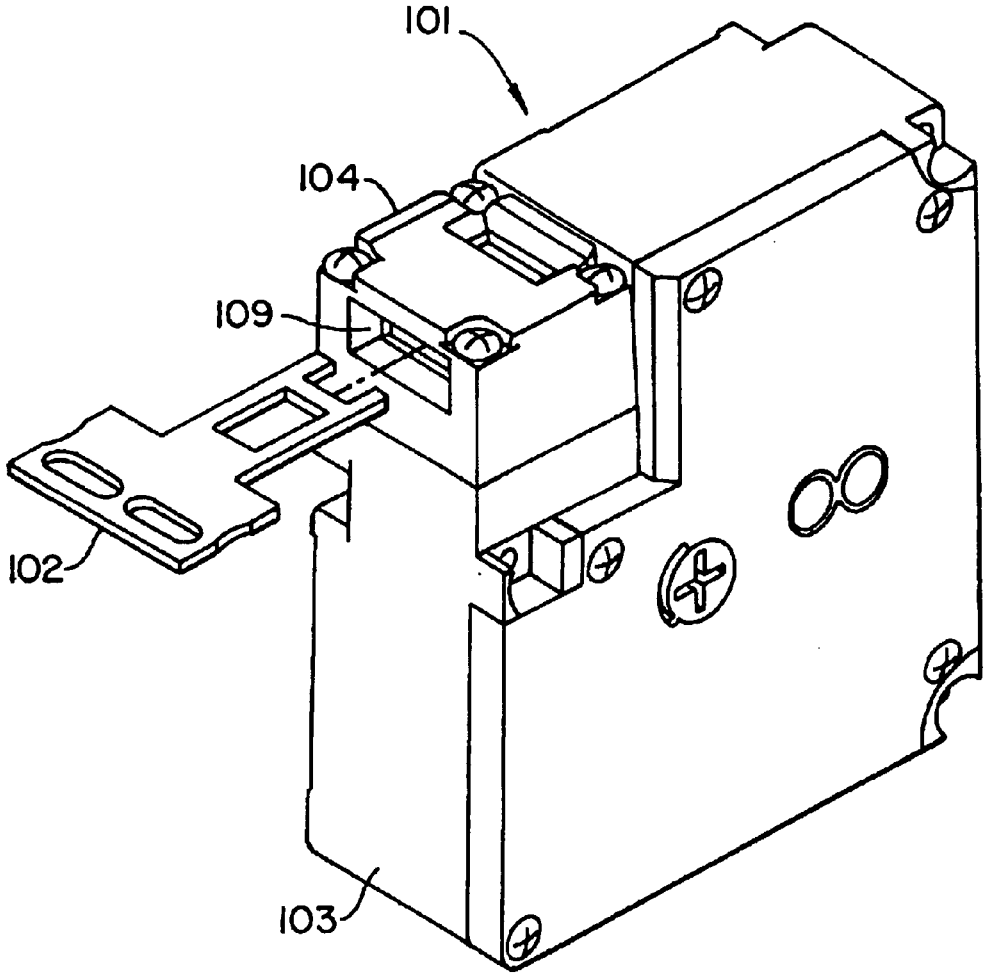
FIG. 16 is a diagonal external view of another key switch embodying this invention.

As explained above, this invention relates also to switches which will not be released from a locked condition to inadvertently change the switched condition (switched-on or switched-off condition) when the key has been forcibly pulled out while in the locked condition. Examples of such a switch will be described next. FIG. 16 shows the external view of such a switch, also adapted to be installed, for example, at the entrance to an automated work area with machine tools. Although it is similar to the one shown in FIG. 1, FIG. 16 is referenced and explained for the completeness of disclosure.

As shown in FIG. 16, the switch includes a main body 101 with an interlock to be attached to a fixed frame at an entrance and a key 102. The main body 101 comprises a main case 103 and a head case 104 to be screwed to the left-hand top part of the main case 103. As will be described below, the main case 103 contains a switching mechanism 105, a locking mechanism 106 and a monitoring mechanism 107. The head case 4 contains a rotary cam 108 as an operating mechanism for the switching mechanism 105 and has a keyhole 109 formed on its front surface. An aspect of the invention relates in particular to the structure of the locking mechanism. Various locking mechanisms according to different embodiments of this invention will be described in what follows.

FIGS. 17–21 show a key switch equipped with a locking mechanism 106 according to a first embodiment of the invention. The switching mechanism 105 is inside the main case 103 on the left-hand side and directly below the head case 104, comprising three pairs of fixed terminals 111 and three mobile terminals 113 supported by an upwardly and downwardly mobile member 112 biased upward by a returning spring 114. Each mobile terminal 113 is elastically supported by a stroke-absorbing spring (not shown) so as to be retractable.

Figure 17A:
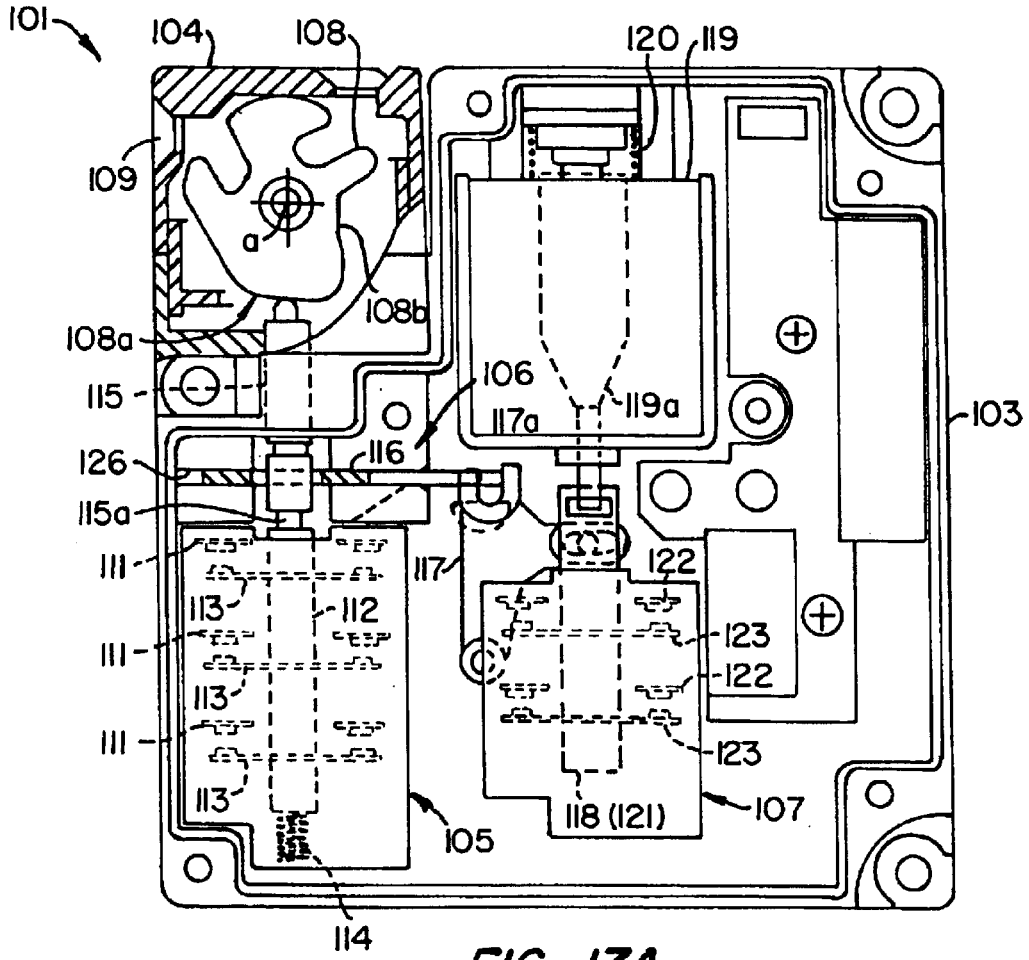
FIG. 17A is a front view of a key switch with a locking mechanism according to a first embodiment of the invention.
Figure 17B:
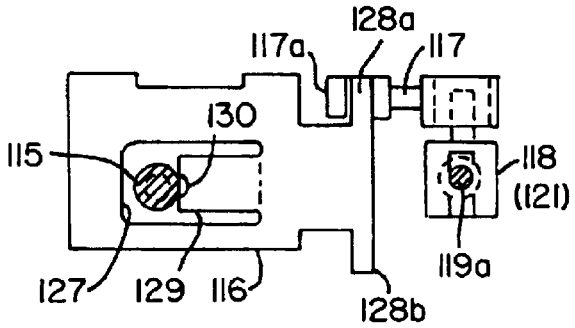
FIG. 17B is a plan view of its locking mechanism and FIG. 17C is a circuit diagram of the switch, FIGS. 17A, 17B and 17C being together referred to as FIG. 17.
Figure 17C:
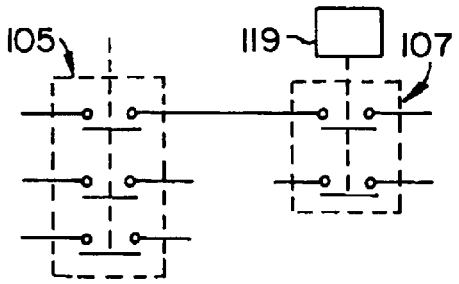

FIG. 17 shows the switch in the switched-off condition, with the mobile member 112 displaced downward against the biasing force thereon from the returning spring 114. At this moment, each mobile terminal 113 is separated from the corresponding fixed terminal 111 such that a power source circuit connected to one of the pairs of fixed terminals 111 is switched off. When the mobile member 112 is upwardly moved by the biasing force of the returning spring 114, each mobile terminal 113 comes into contact with the corresponding one of the fixed terminals 111 such that a switched-on condition is brought about. A plunger 115 is in contact with the top end part of the mobile member 112 and protrudes inside the head case 104 to contact the outer peripheral surface of the rotary cam 108.

The rotary cam 108 is rotatably supported around a horizontal axis "a" and its outer periphery is so shaped as to cause the cam 108 to rotate in the positive or negative direction as the key 102 is inserted into or pulled out of the keyhole 109. When the key 102 has been pulled out, as shown in FIG. 17, a large-diameter part 108*a* of the cam 108 causes the plunger 115 to be pushed downward against the biasing force of the returning spring 114, displacing the mobile member 112 downward, and the switched-off condition is thereby realized. If the key 102 is inserted and the rotary cam 108 is rotated in the clockwise direction with reference to FIG. 18, the plunger 15 engages with a small-diameter part 108*b* of the rotary cam 108 and becomes mobile upward. The mobile member 112 is thereby pushed upward by the biasing force thereon and a switched-on condition is brought about. Even if the contact points may become bonded together, they can thus be separated by forcibly pushing down the mobile member 112 by means of the rotary cam 108.

The locking mechanism 106 is of a mechanically biased type, comprising a locking member 116 made of a metallic plate applying a force on a lower part of the plunger 115, a crank lever 117 for causing the locking member 116 to slide sideways (left and right with reference to FIGS. 17A and 18A), a sliding member 118 for moving the crank lever 117 to swing in positive and negative directions and an electromagnetic solenoid 119 connected to this sliding member 118. As the core 119*a* of the solenoid 119 is upwardly displaced by a biasing spring 120, the locking member 116 is slidingly displaced to the left, which is the locking direction. When the solenoid 119 is activated such that its core 19*a* is displaced downward against the biasing spring 120, the locking member 116 is slidingly pushed to the right, which is the unlocking direction.

Figure 18A:
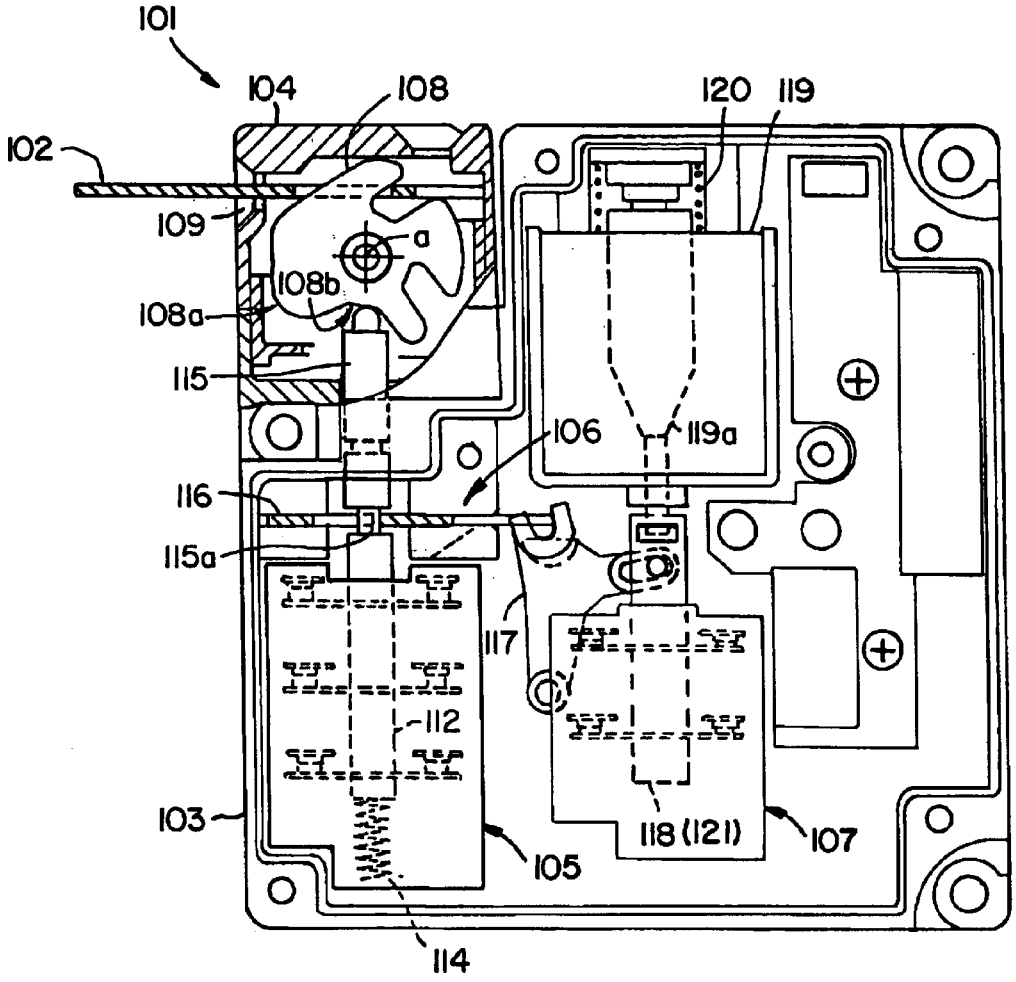
FIGS. 18A, 18B and 18C, together referred to as FIG. 18, are respectively a front view of the key switch of FIG. 17, a plan view of its locking mechanism and its circuit diagram when the key is inserted.
Figure 18B:
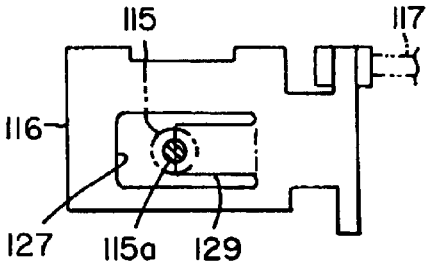

A mobile member 121 of the monitoring mechanism 107 is connected to the sliding member 118. When the sliding member 118 is at the unlocked position, as shown in FIG. 17, mobile terminals 123 held on the sliding member 118 opposite to two pairs of fixed terminals 122 of the monitoring mechanism 107 are separated therefrom. When the sliding member 118 is at the locked position, the mobile terminals 123 become electrically connected to corresponding ones of the fixed terminals 122. The locking member 116 is slidably supported in a guiding groove 126 formed inside the main case 103. An opening 127 for passing the plunger 115 through is provided on the left-hand side of the groove 126. Operating pin parts 128*a* and 128*b* are formed on the front and back sides at the right-hand end, and a yoke 117*a* at one end of the crank lever 117 is engagingly connected to the backward operating pin part 128*a*, The locking member 116 further includes a cantilever arm part 129 protruding towards the plunger 115 inserted through the opening 127, as shown in FIGS. 17B and 18B. The free edge of this arm part 129 has an indentation 130 adapted to engage with a small-diameter part 115*a* formed at a lower part of the plunger 115.

The solenoid 119 is not activated in the switched-off condition shown in FIG. 17, its core 119*a* being biased upward by the biasing spring 120. The crank lever 117 is swung in the counter-clockwise direction such that the locking member 116 is biased towards the left-hand side. Since the plunger 115 is pushed down to the switched-off position, the front edge (the tip) of the arm part 129 is pushed against a large-diameter part of the plunger 115 above the aforementioned small-diameter part 115*a*.

Figure 18C:
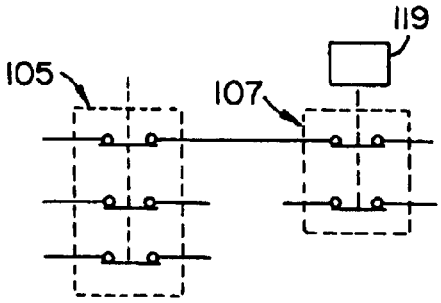

In the switched-off condition with the key 102 pulled out, the rotary cam 108 is prevented from rotating by means of a locking member (not shown) which prevents the rotary cam 108 from being operated by anything other than the key 102. As the key 102 is about to be inserted, this locking member is retracted by the key 102 such that the rotary cam 108 becomes rotatable. As the key 102 is further pushed in, the switched-on condition as shown in FIG. 18 is brought about.

As the key 102 is inserted to rotate the rotary cam 108 and to displace both the plunger 115 and the mobile member 112 upward such that the switched-on condition is realized, the small-diameter part 115*a* of the plunger 115 reaches the position opposite the locking member 116, and locking member 116 is pushed by the biasing force thereon and slides to the left until the indentation 130 on the arm part 129 engages the small-diameter part 115*a* of the plunger 115, thereby realizing a locked condition. This locked condition is maintained as the free edge of the arm part 129 contacts from below a step formed on the outer periphery of the plunger 115 defining its small-diameter part 115*a*, thereby preventing the plunger 116 from moving further downward and the rotary cam 108 from rotating in the reverse direction. Thus, the key 102 is prevented from being pulled out.

As the locking member 116 of the locking mechanism 106 advances to its normal locking position in this switched-on condition, the monitoring mechanism 107 also enters a switched-on condition. A set of circuits for the monitoring mechanism 107 is connected in series with a set of circuits of the switching mechanism 105 such that power becomes supplied to the machine tools of the work area as this series connection is closed.

When the key 102 is to be pulled out, the solenoid 119 is activated so as to retract its core 109*a* downward against the biasing spring 120 and to forcibly swing the crank lever 117 in the clockwise direction, The locking member 116 is retracted from its locking position to the right-hand side, and the front edge of the arm part 129 is separated from the small-diameter part 115*a* of the plunger 115 such that the plunger 115 is released from the locked condition. Thus, the key 102 becomes allowed to be pulled out and the door becomes openable.

The basic function of the locking mechanism 106 described above is fundamentally the same as that of prior art switches but switches according to this invention come to function differently as will be described below in detail when the door is forcibly opened without first releasing the locking mechanism.

Figure 19A:
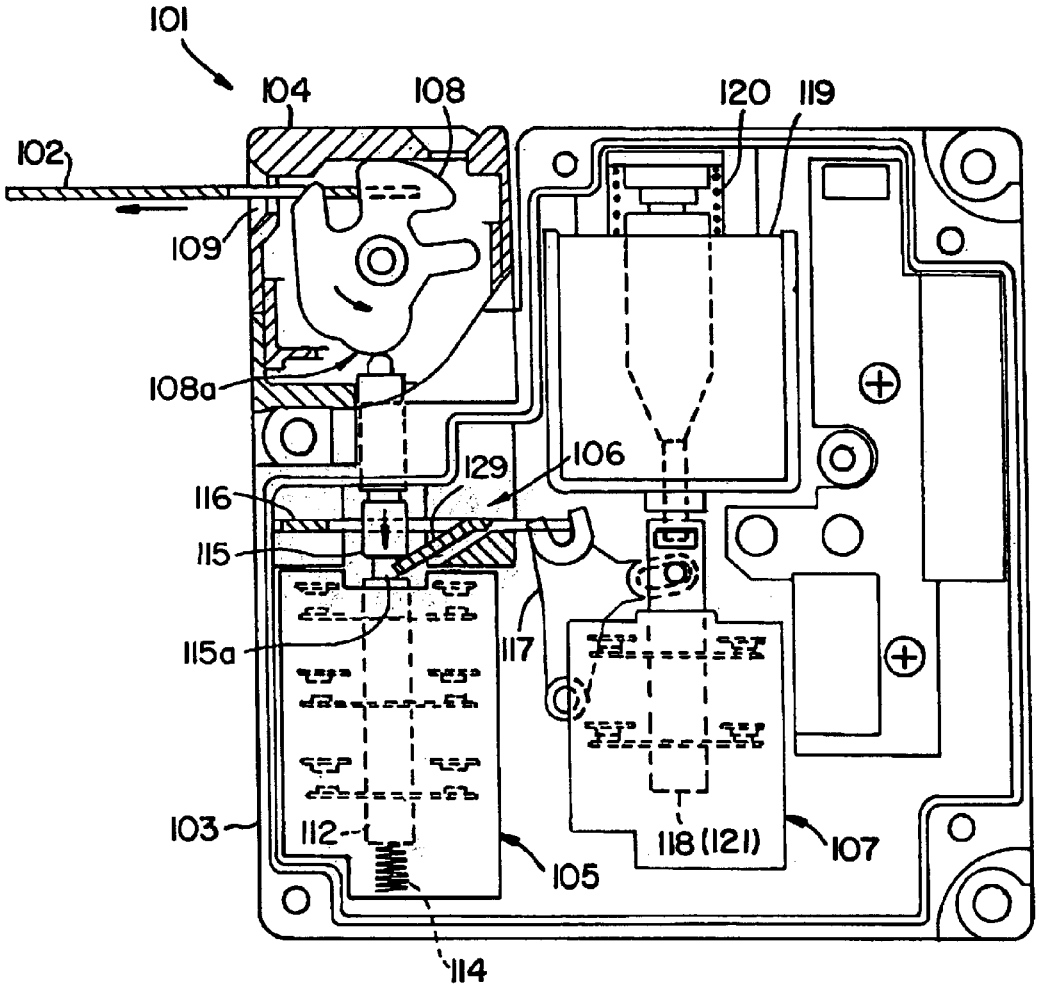
FIGS. 19A and 19B, together referred to as FIG. 19, are respectively a front view of the key switch of FIG. 17, a plan view of its locking mechanism and its circuit diagram when the key is forcibly pulled out.
Figure 19B:
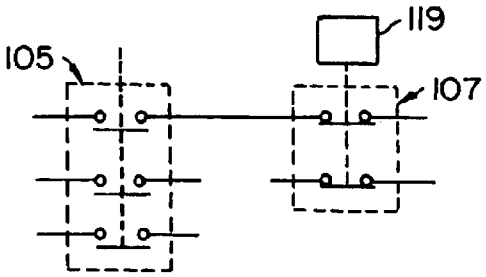

If the key 102 is pulled while the locking mechanism is locked in the switched-on condition as shown in FIG. 18, the rotary cam 108 is rotated in the counter-clockwise direction by means of the key 102 and a downward force is applied to the plunger 115 engaging the locking member 116. If the key 102 were being pulled out normally, the arm part 129 of the locking member 116 would be able to prevent the downward motion of the plunger 115, but if the key 2 is pulled out forcibly, say, by something heavy hitting the door accidentally, the front edge of the arm part 129 of the locking member 116 engagingly supporting the plunger 115 experiences a larger force than specified. As a result, the arm part 129 becomes deformed downward, as shown in FIG. 19, allowing the plunger 115 and the mobile member 112 contacting the plunger 115 to move downward until the switched-off position. Accordingly, the circuits connected in series with the circuits of the monitoring mechanism 107 are opened and the supply of power to the machine tools is interrupted.

Figure 20A:
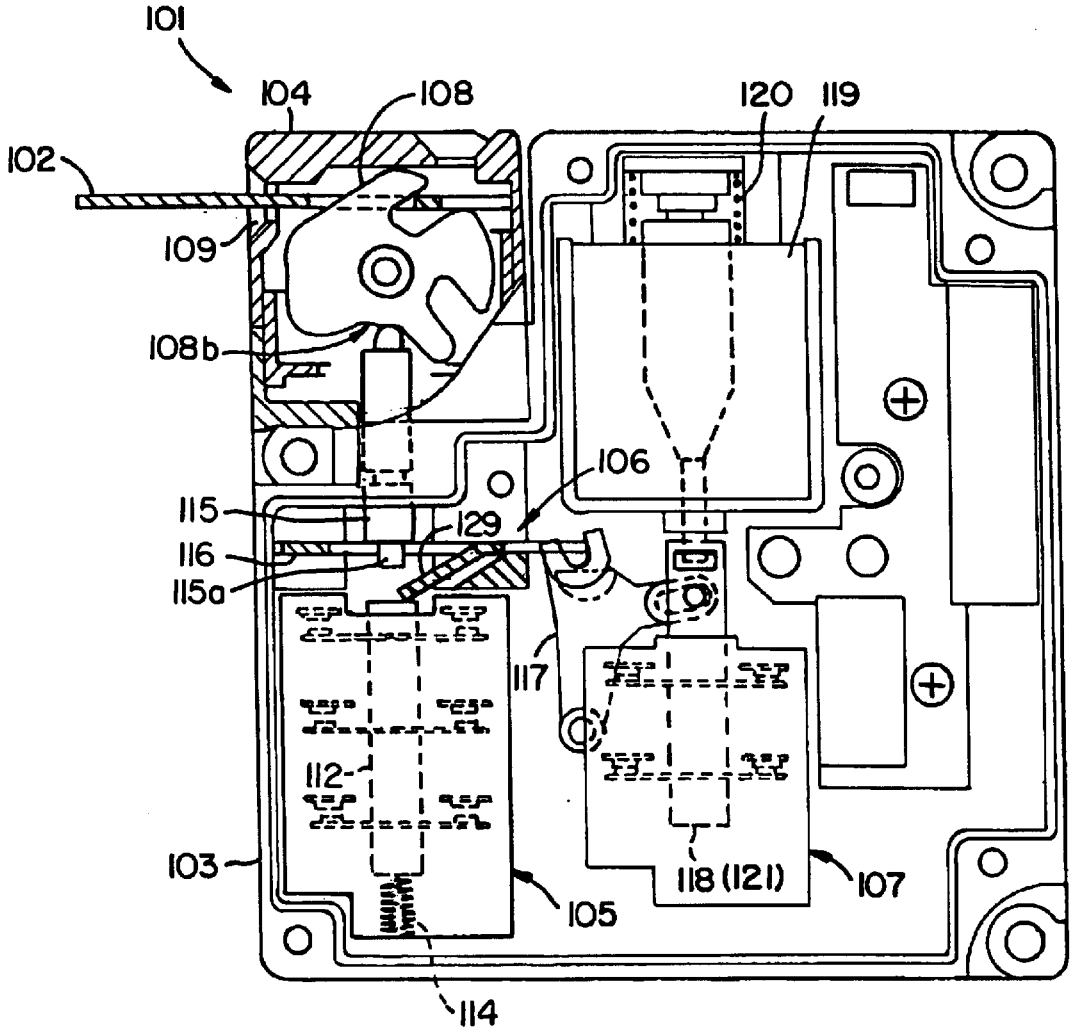
FIGS. 20A and 20B, together referred to as FIG. 20, are respectively a front view of the key switch of FIG. 17 and its circuit diagram when the key is forcibly pulled out and then inserted again.
Figure 20B:
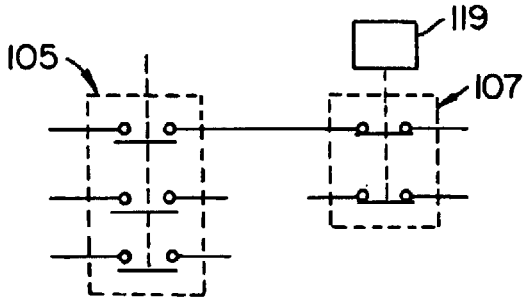
Figure 21A:
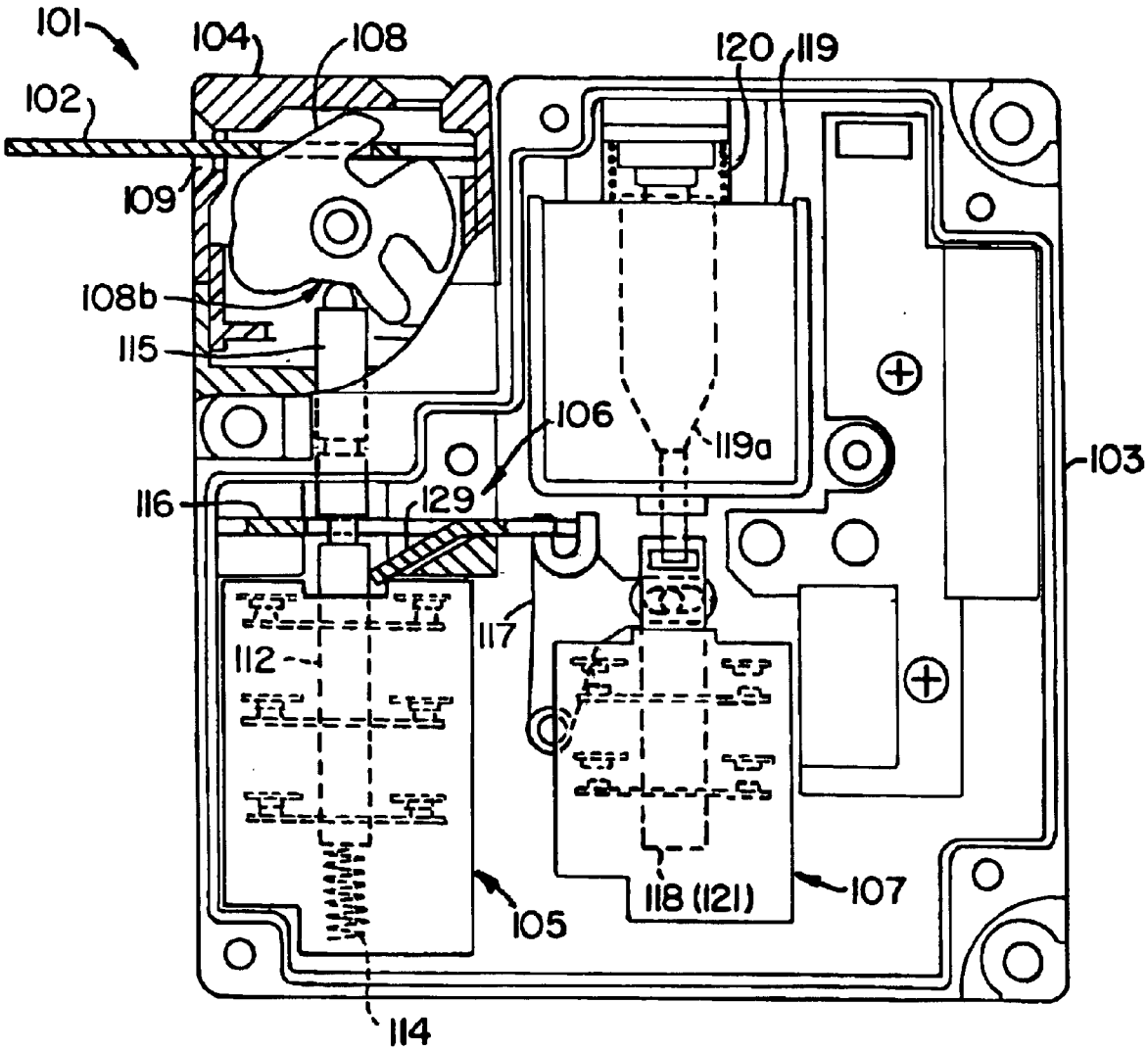
FIGS. 21A and 21B, together referred to as FIG. 21, are respectively a front view of the key switch of FIG. 17 and its circuit diagram when the key is forcibly pulled out, the locking condition is released and then the key is inserted again.
Figure 21B:
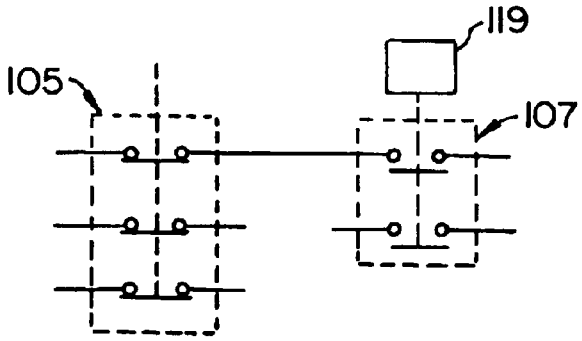

After the key 102 has been forcibly pulled out, if the door is closed and the key 102 is inserted again by somebody not knowing what has happened, the plunger 115 can be moved upward by the rotation of the rotary cam 108 but the mobile member 112 is prevented from moving upward by the deformed arm part 129, as shown in FIG. 20 such that the switching mechanism 105 is maintained in the switched-off condition. In other words, power will not be supplied even if the door is closed after it is forcibly opened.

If the door is closed after the key 102 is forcibly pulled out and the key 102 is inserted to unlock the door, the constraint on the mobile member 112 by the arm part 129 is removed because the locking member 116 is retracted but the front edge of the arm part 129 of the biased locking member 116 becomes caught by the mobile member 112 and cannot slide to the normal locking position. Thus, the monitoring mechanism 107 becomes switched off and power cannot be supplied.

Figure 22:
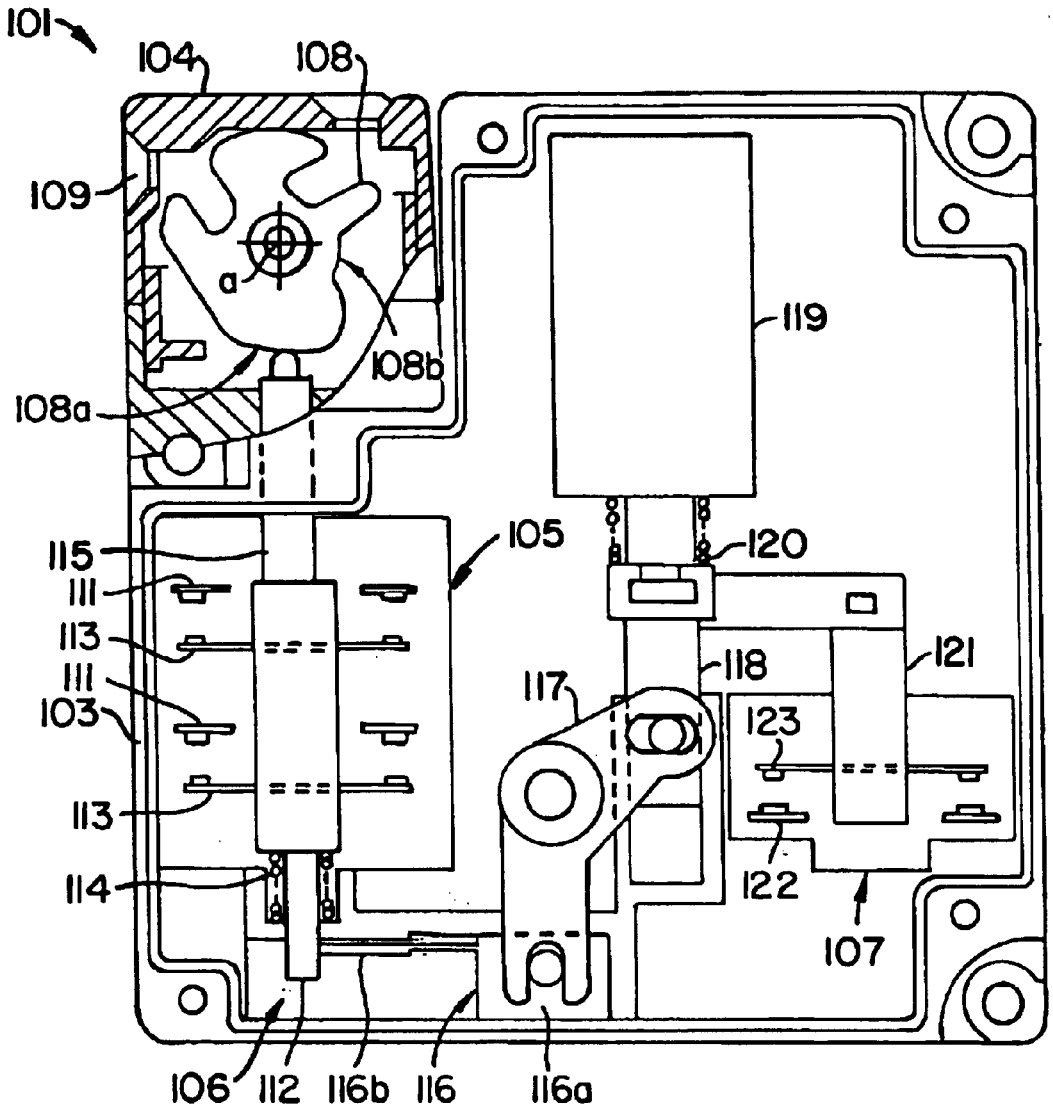
FIG. 22 is a front view of a key switch with a locking device according to a second embodiment of the invention when the key is pulled out.
Figure 23:
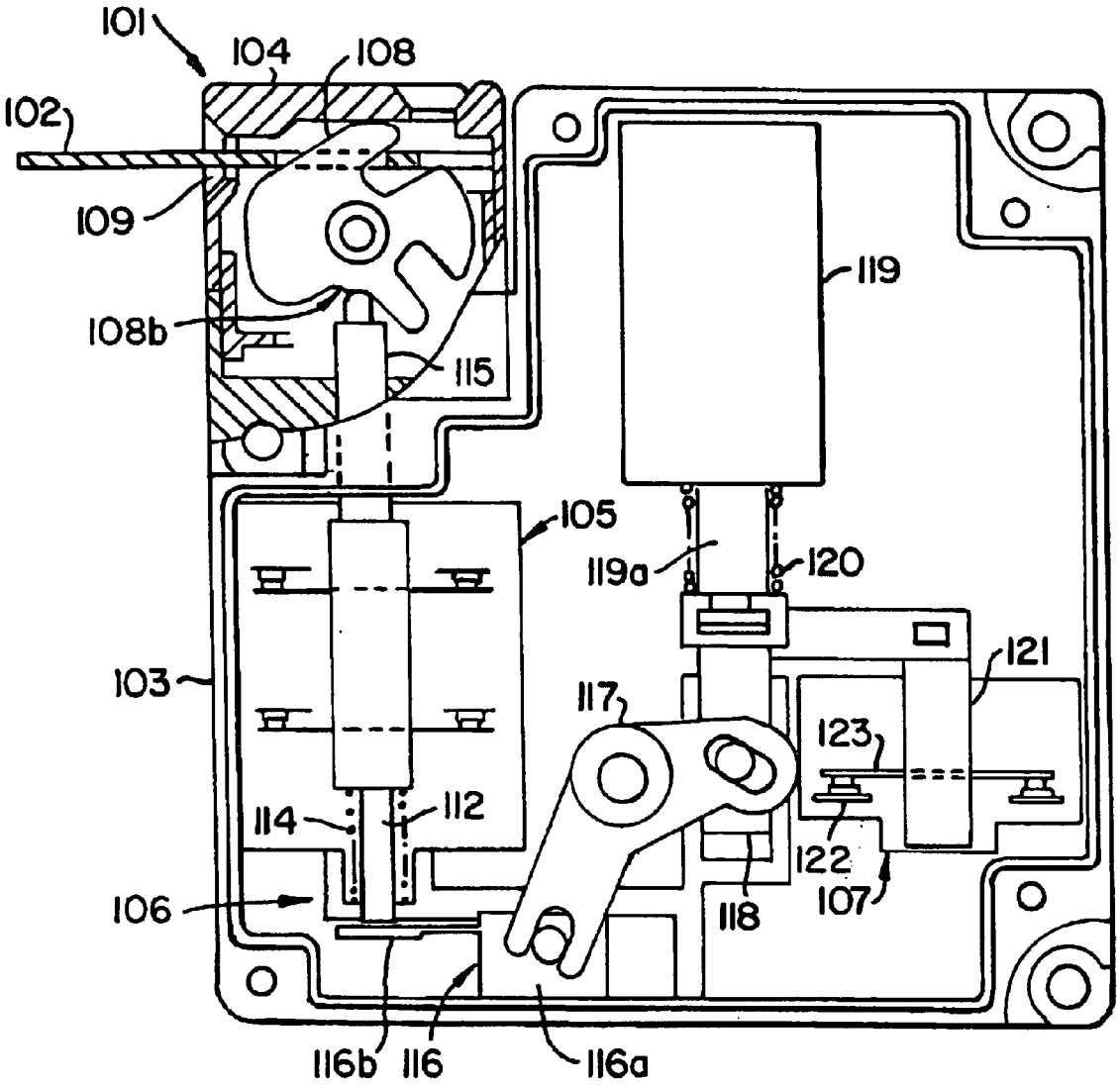
FIG. 23 is a front view of the key switch of FIG. 22 when the key is inserted.
Figure 24:
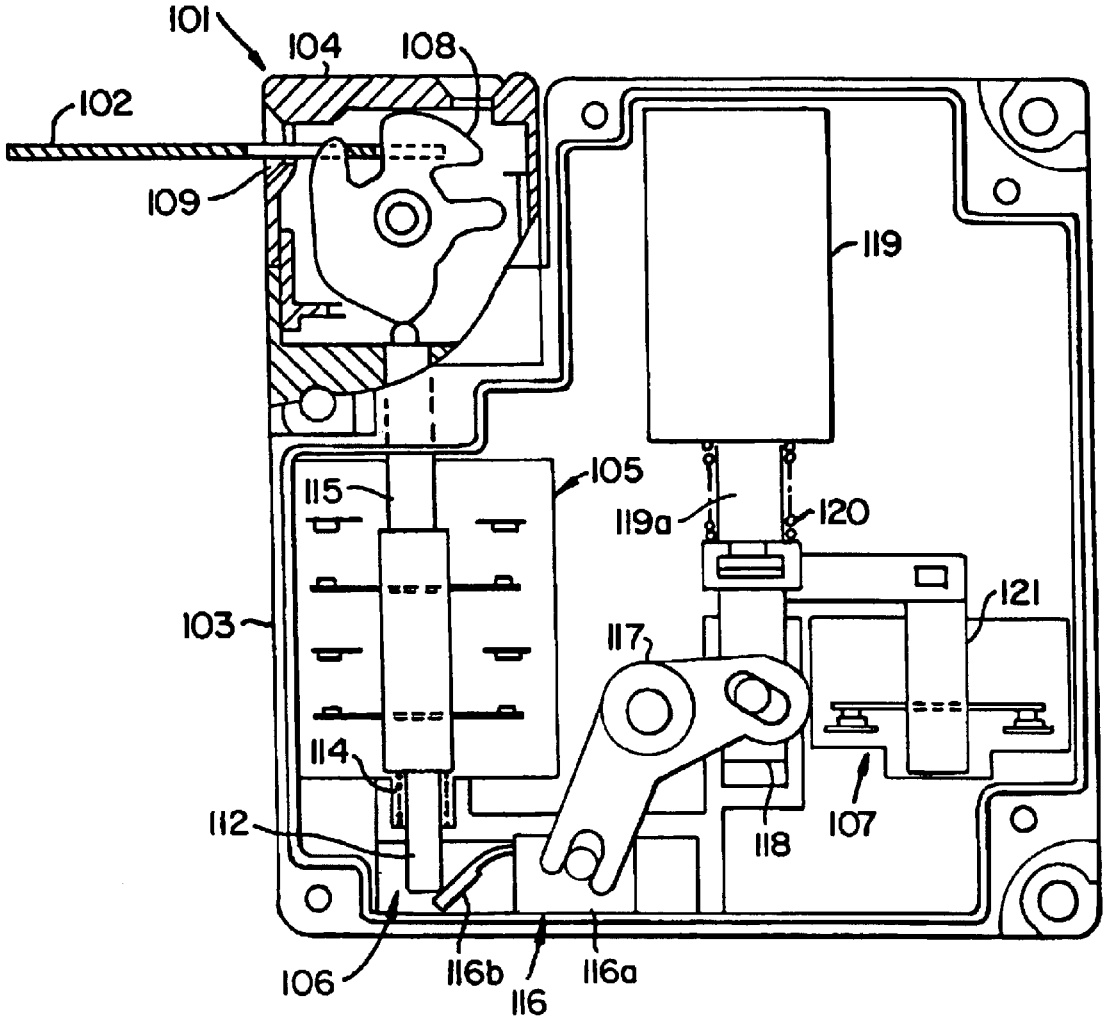
FIG. 24 is a front view of the key switch of FIG. 22 when the key is forcibly pulled out.

FIGS. 22–24 show another key switch equipped with a locking mechanism 106 according to a second embodiment of the invention. Since this key switch is different from the one described above only in the structure of the locking mechanism 106, the other components are indicated by the same numerals used above and will not be repetitiously explained.

The locking mechanism 106 according to the second embodiment of the invention is structured such that the biased locking member 116 is advanced to a position below the mobile member 112 when the key 102 is inserted and the mobile member 112 is moved to the switched-on position such that the switched-on condition is locked as shown in FIG. 23.

The locking member 106 according to this embodiment is structured so as to have a metallic receiver arm 116*b* extended from a sliding block 16*a* engagingly connected to the crank lever 117 so as to contact and support the mobile member 112. If the key 102 is forcibly pulled while the switch is in the locked condition, the mobile 112 is forcibly pushed down by the rotation of the rotary cam 108 and deforms the receiver arm 116*b* of the locking member 116 downward as shown in FIG. 24 such that the switching mechanism 105 is switched to the switched-off condition. As a result, power is switched off although the monitoring mechanism 107 is in the switched-on condition.

Figure 25:
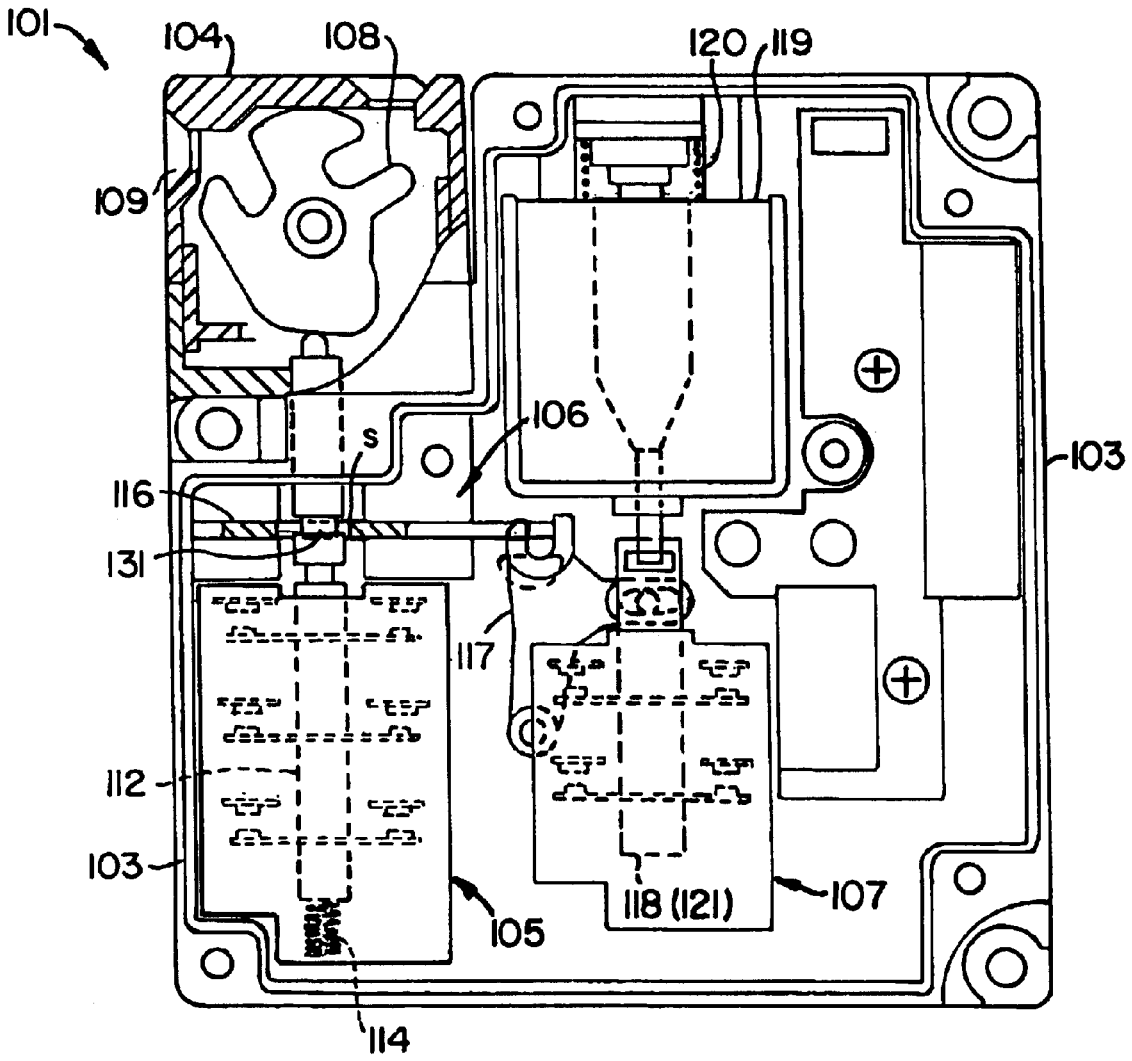
FIG. 25 is a front view of a key switch with a locking device according to a third embodiment of the invention when the key is pulled out.
Figure 26:
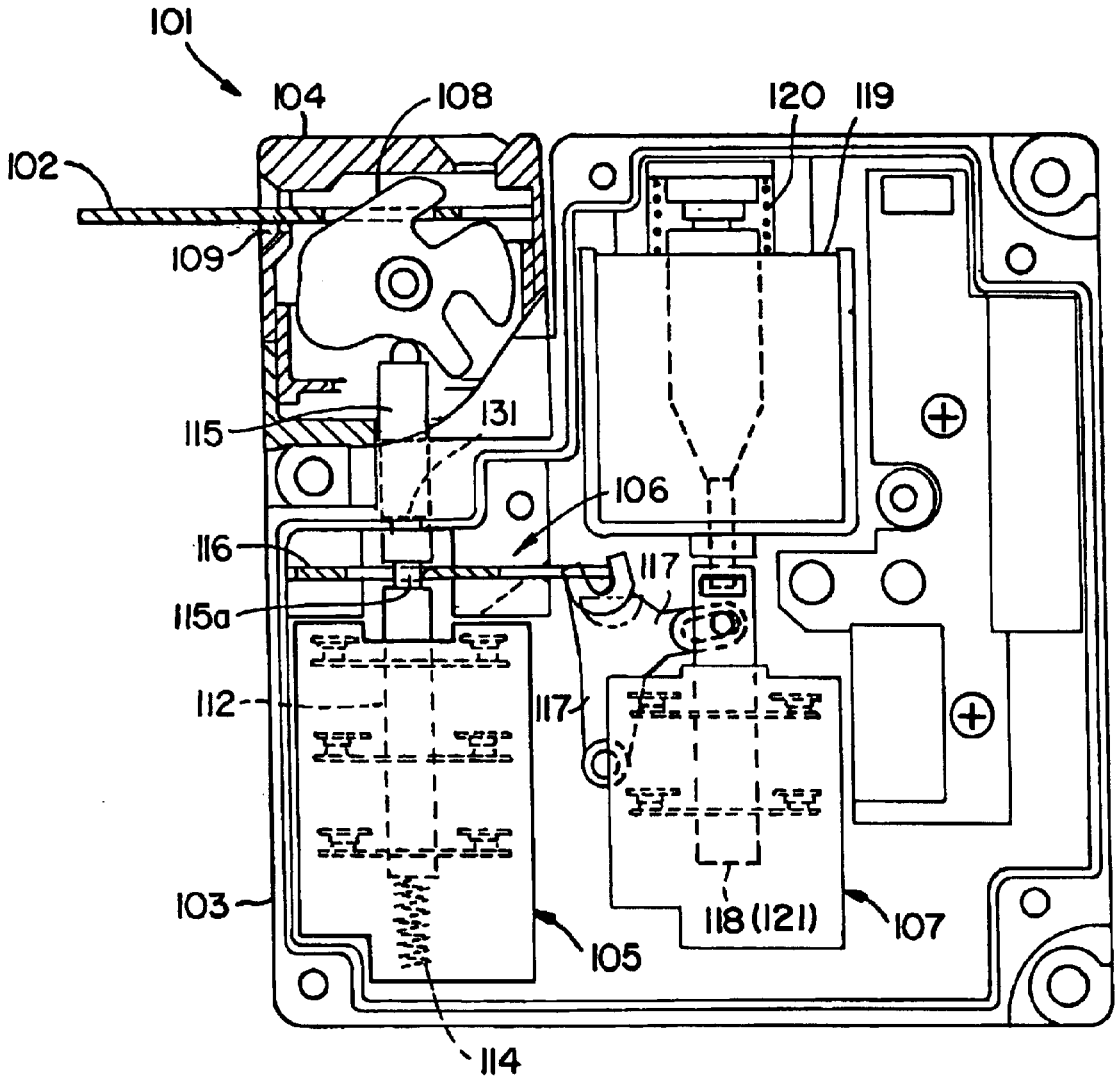
FIG. 26 is a front view of the key switch of FIG. 25 when the key is inserted.
Figure 27:
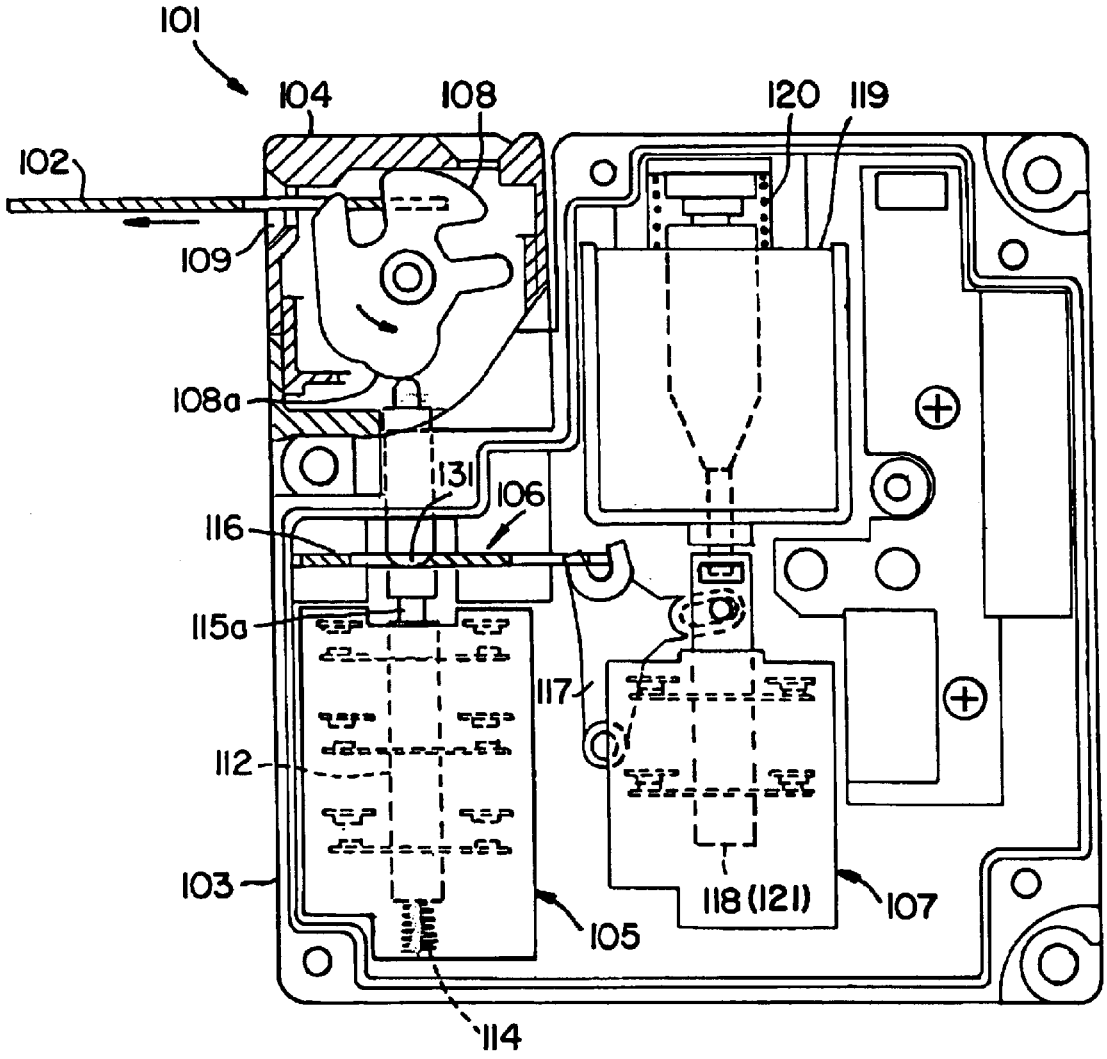
FIG. 27 is a front view of the key switch of FIG. 25 when the key is forcibly pulled out.

FIGS. 25–27 show still another key switch equipped with a locking mechanism 106 according to a third embodiment of the invention. Since this key switch is different from the one according to the first embodiment of the invention described above only in the structure of the locking mechanism 106, the other components are indicated by the same numerals used above and will not be repetitiously explained.

This locking mechanism, like the one according to the first embodiment of the invention described above, functions to lock the switching mechanism 105 at a switched-on position by engaging a small-diameter part 115*a* of the plunger 115 with an indented part 130 formed within an opening 127 through the locking member 116 made of a metallic plate, but the end surface "s" of the indented part 130 is tapered upward and a groove 131 is formed above the small-diameter part 115*a* of the plunger 115 such that if the key 102 is forcibly pulled out while the switch is locked, the plunger 115 is forcibly pulled downward and contacts the upwardly tapered surface "s" of the indented part 130. This taped surface "s" serves as a cam such that the locking member 116 is retracted against the biasing force of the biasing spring 120, and the plunger 115 and the mobile member 112 move down to the switched-off position. This causes the locking member 116 to advance again to become engaged with the groove 131 on the plunger 115, stopping the upward motion of the plunger 115. Thus, if the key 102 is forcibly pulled while the switch is locked, the switching mechanism 105 is switched to and maintained in the switched-off condition.

Figure 28A:
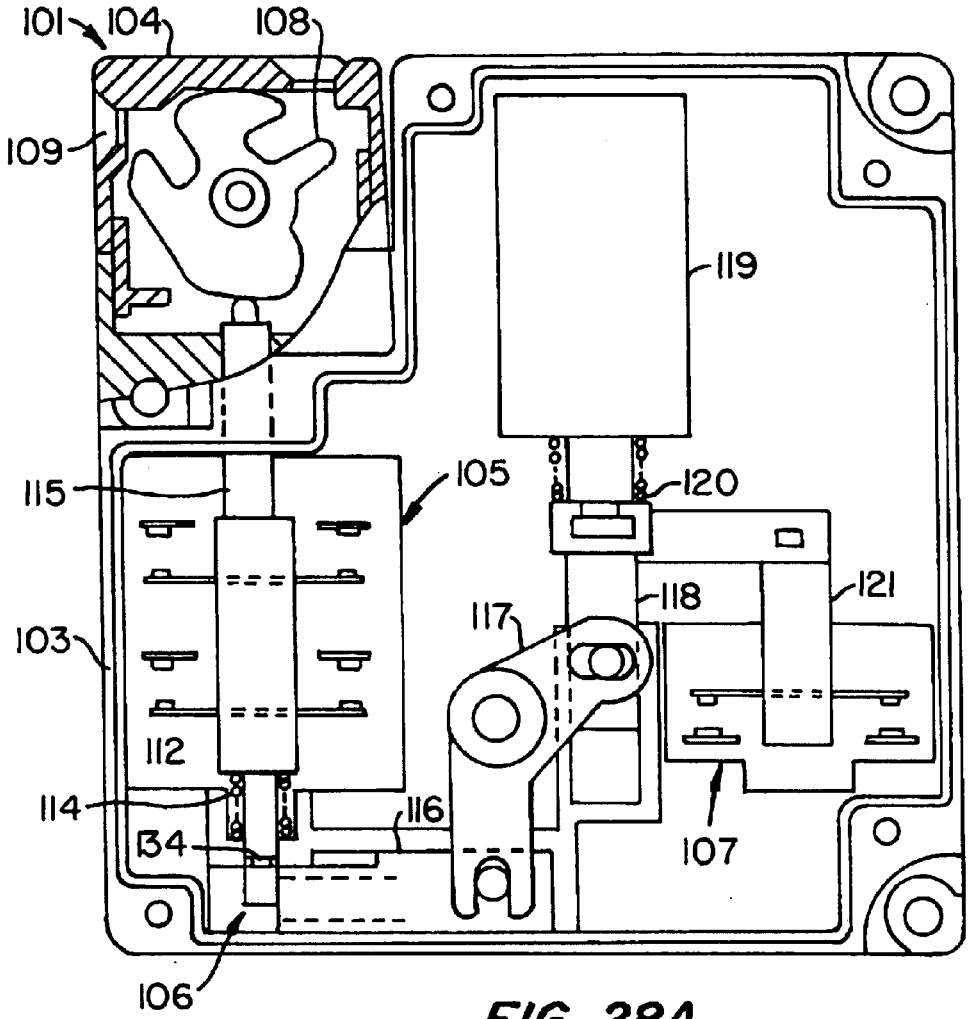
FIGS. 28A and 28B, together referred to as FIG. 28, are respectively a front view of a key switch with a locking device according to a fourth embodiment of the invention when the key is pulled out and a diagonal view of its locking part.
Figure 28B:
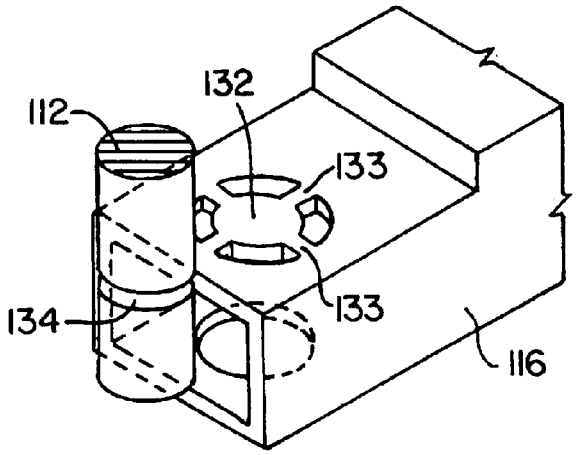
Figure 29A:
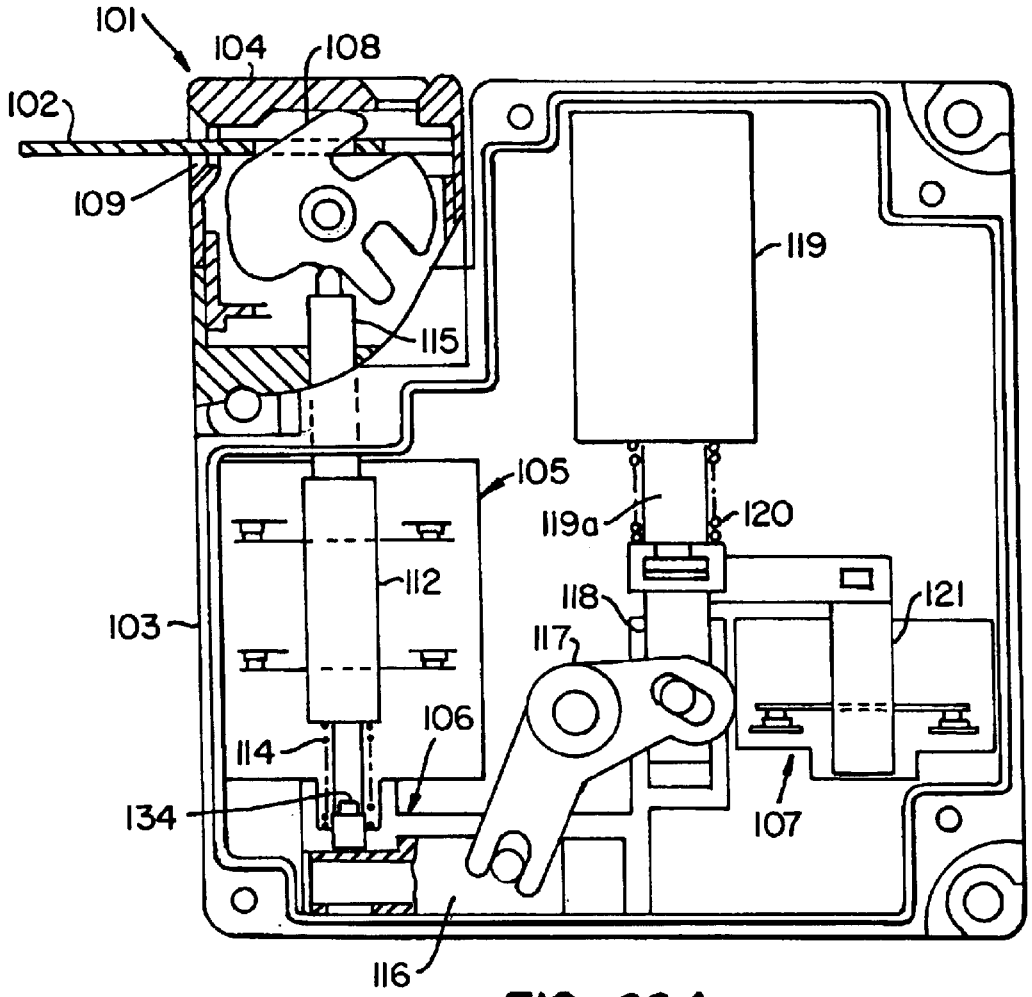
FIGS. 29A and 29B, together referred to as FIG. 29, are respectively a front view of the key switch of FIG. 28 and a diagonal view of its locking part when the key is inserted.
Figure 29B:
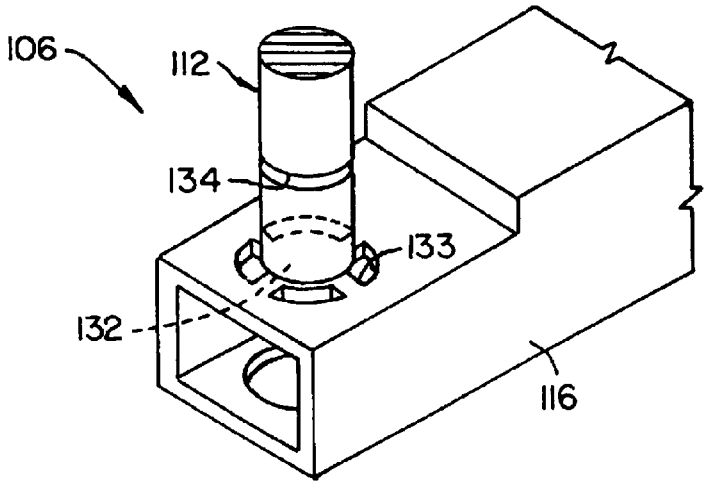
Figure 30A:
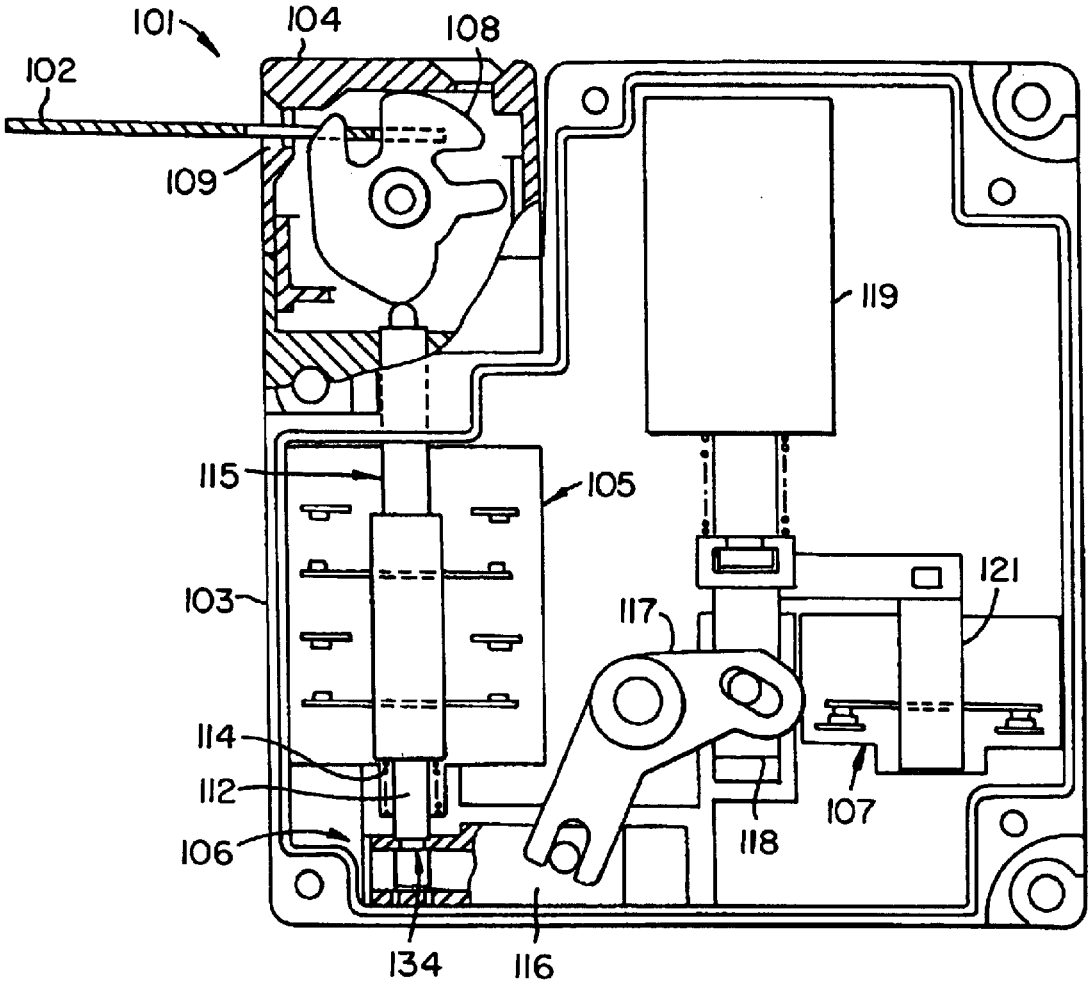
FIGS. 30A, 30B and 30C, together referred to as FIG. 30, are respectively a front view of the key switch of FIG. 28, and a diagonal view and a sectional view of its locking part when the key is forcibly pulled out.
Figure 30B:
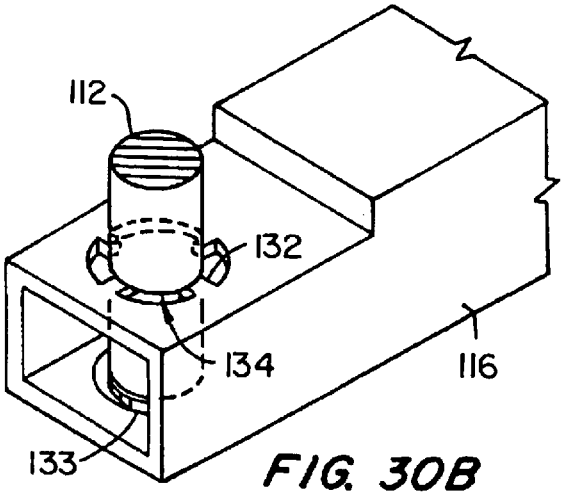
Figure 30C:
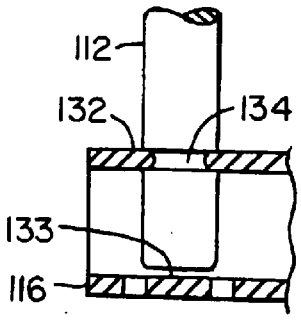

FIGS. 28–30 show still another key switch equipped with a locking mechanism 106 according to a fourth embodiment of the invention, which is similar to the one according to the second embodiment of the invention described above in that the locking member 116 is advanced below the mobile member 112 of the switching mechanism 105 so as to prevent the downward motion of the mobile member 112 which has moved up to the switched-on position.

The locking member 116 of the locking mechanism 106 according to this example is formed such that at least its front portion is hollow and a receiving part 132 supported only by narrow bridges 133 is formed on the mobile member 112 as shown in FIG. 28B. If the key 102 is forcibly pulled out while the switch is in the locked condition, the mobile member 112 is forcibly pulled downward such that an excessively large force is applied to the receiving part 132 of the locking member 116, breaking the bridges 133 and breaking off the receiving part 132. This allows the mobile member 112 to move down to the switched-off position. The mobile member 112 has a groove 134 formed around its external peripheral surface. When the mobile member 112 drops to the switched-off position, the tips of the remaining bridges engage in the groove 134 on the mobile member 112, thereby preventing the mobile member 112 from moving upward. Thus, if the key 102 is forcibly pulled out while the switch is locked, the switching mechanism 105 is switched to and maintained in the switched-off condition.

Figure 31A:
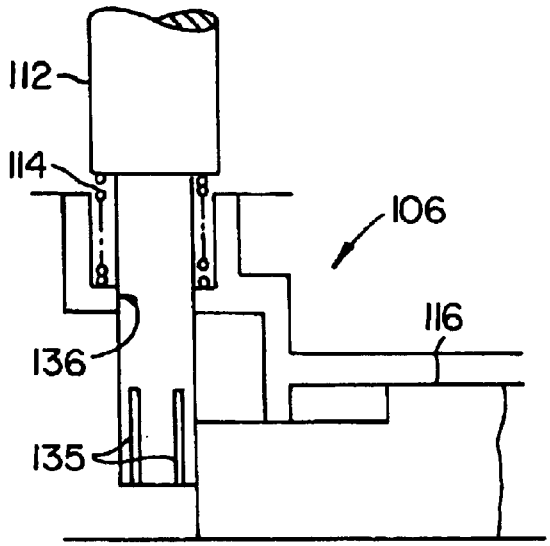
FIGS. 31A, 31B and 31C, together referred to as FIG. 31, are respectively a front view of a key switch with a locking device according to a fifth embodiment of the invention when the key is pulled out, a front view of its locking device when the key is inserted and a front view of its locking device when the key is forcibly pulled out.
Figure 31B:
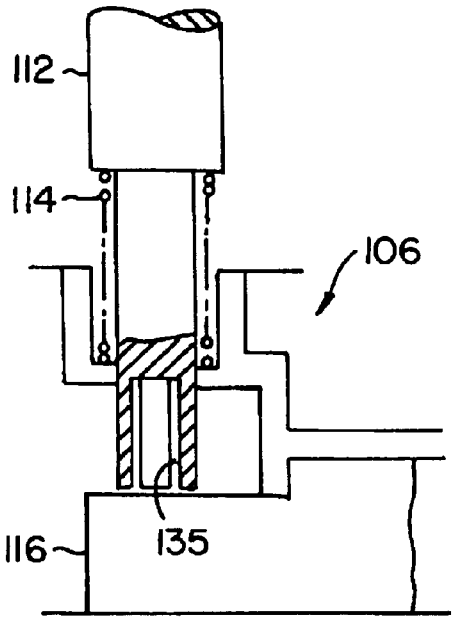

FIG. 31 shows still another key switch equipped with a locking mechanism 106 according to a fifth embodiment of the invention, which is similar to the one according to the fourth embodiment of the invention described above in that a locking member 116 is advanced below the mobile member 112 of the switching mechanism 105 to thereby prevent the downward motion of the mobile member 112 which has moved upward to the switched-on position.

Figure 31C:
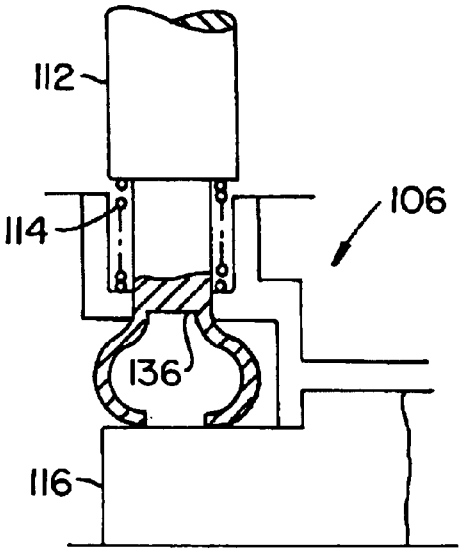

The locking member 116 of the locking mechanism 106 according to this example is of a simple block form. The bottom end part of the mobile member 112 is cylindrically formed with a plurality of slits 135 around the circumference. If the key 102 is forcibly pulled out while the switch is locked, the mobile member 112 is strongly pulled downward and the bottom end part of the mobile member 112 becomes deformed as shown in FIG. 31C, allowing the mobile member 112 as a whole to move downward to the switched-off position. As the bottom portion with the slits 135 is crushed, the mobile member 112 becomes incapable of passing through the guide grooves 136 for allowing the vertical motion of the mobile member 112 and hence the mobile member 112 is prevented from moving upward. In this example, too, the switching mechanism 105 switches to the switched-off condition if the key 102 is forcibly rotated while the switch is locked.

Figure 32A:
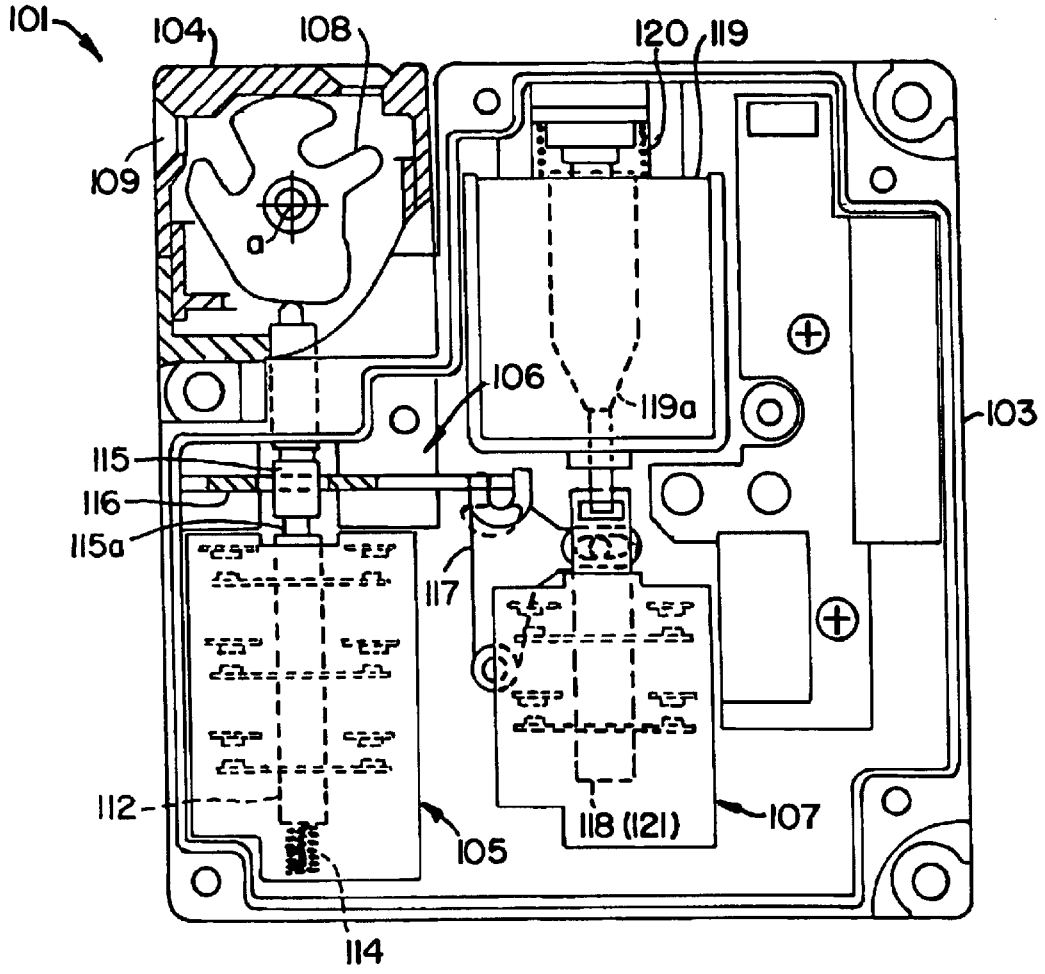
FIGS. 32A and 32B, together referred to as FIG. 32, are respectively a front view of a key switch with a locking device according to a sixth embodiment of the invention and a plan view of its locking device when the key is pulled out.
Figure 32B:
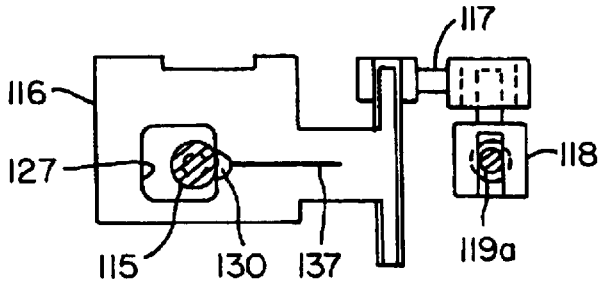
Figure 33B:
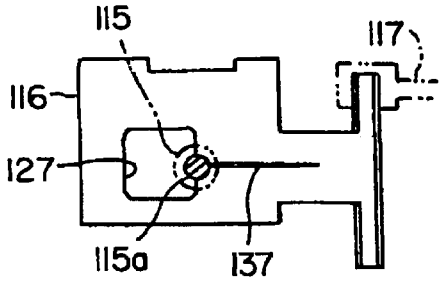
FIGS. 33A and 33B, together referred to as FIG. 33, are respectively a front view of the key switch of FIG. 32 and its locking device when the key is inserted.
Figure 33A:
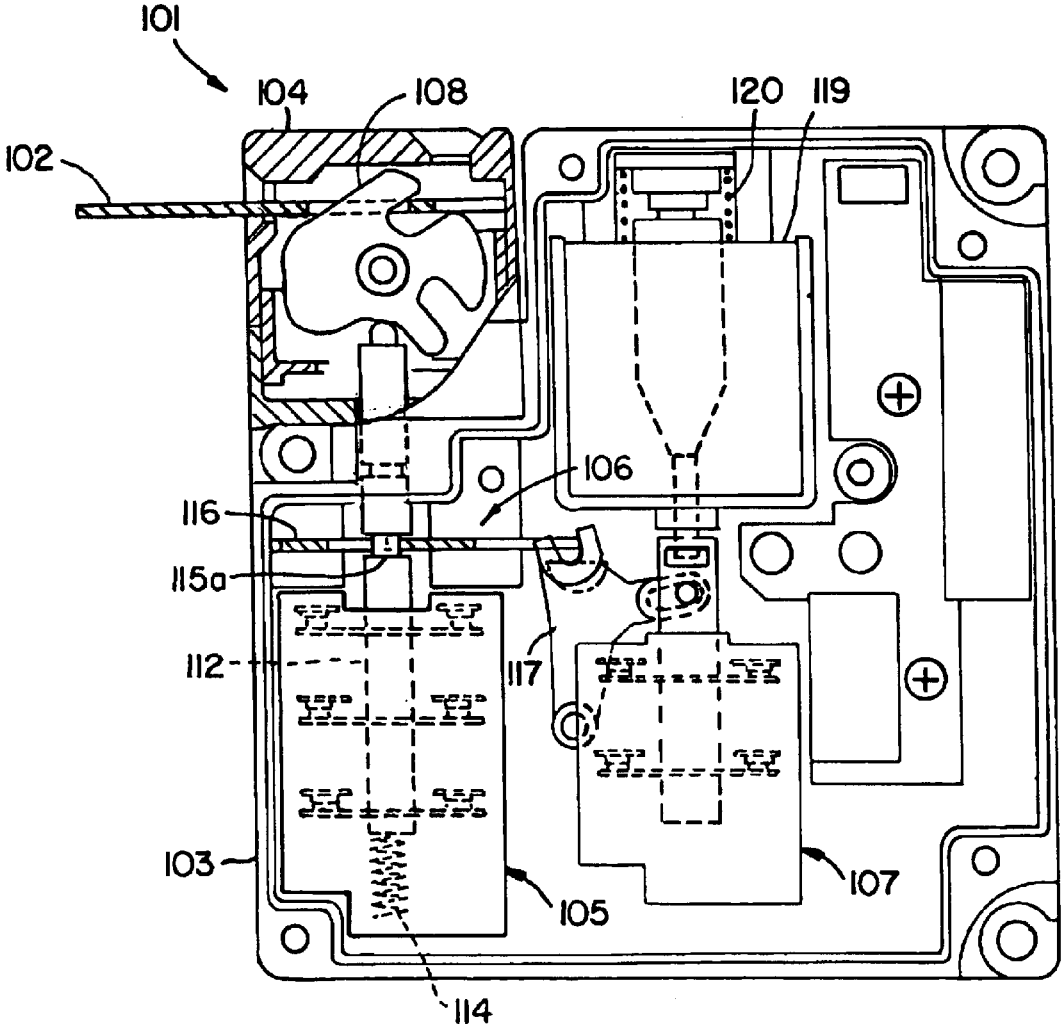
Figure 34:
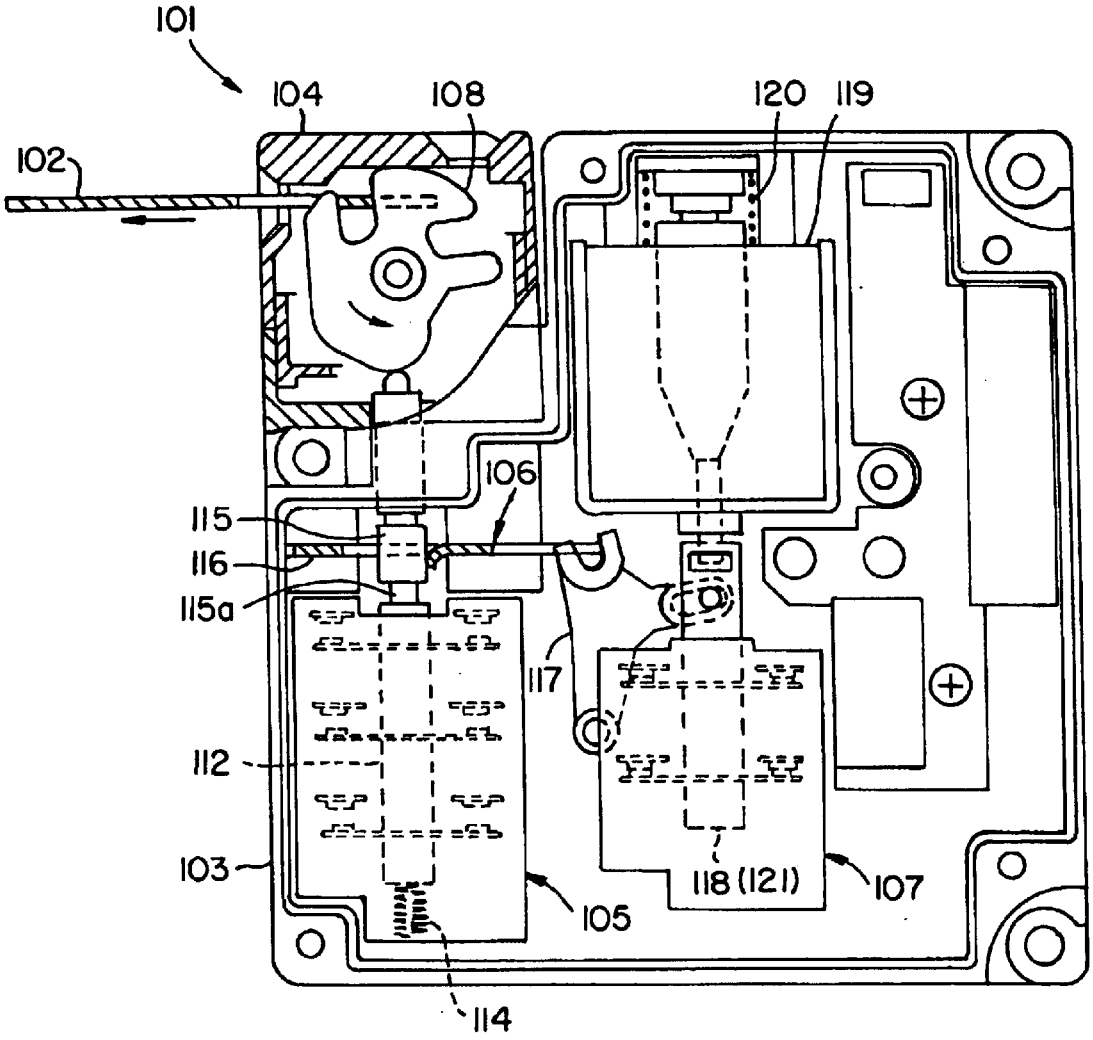
FIG. 34 is a front view of the key switch of FIG. 32 when the key is forcibly pulled out.

FIGS. 32–34 show still another key switch equipped with a locking mechanism 106 according to a sixth embodiment of the invention. Since this key switch is the same in basic structure as the one according to the first embodiment of the invention described above, corresponding components are indicated by the same numerals used above and will not be repetitiously explained.

The locking mechanism 106 according to this example, like that according to the first embodiment of the invention, locks the switching mechanism 105 at the switched-on position by engaging in an indentation 130 formed on an edge abutting an opening 127 through a locking member 116 made of a metallic plate at a small-diameter part 115*a* of a plunger 115 but is characterized in that a slit 137 is also formed from a deep part of the indentation 130, as shown in FIGS. 32B and 33B. If the key 102 is forcibly pulled out while the switch is locked, the plunger 115 is strongly pulled downward, and portions of the locking member 116 around the indentation 130 are deformed downward, as shown in FIG. 34, allowing the plunger 115 and the mobile member 112 to move downward to the switched-off position.

FIG. 35 shows a portion of still another locking mechanism 116 according to a seventh embodiment of this invention which is similar to the locking mechanism according to the fourth embodiment described above, causing a locking member 116 to advance below the mobile member 112 of the switching mechanism 105 to prevent the downward motion of the mobile member 112 which has moved upward to the switched-on position.

Figure 35A:
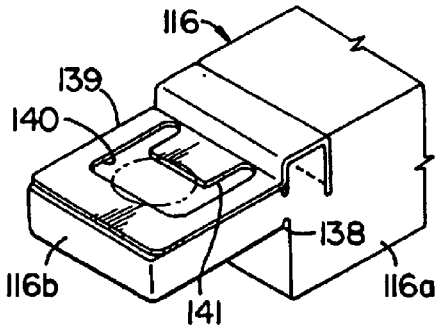
FIGS. 35A, 35B, 35C and 35D, together referred to as FIG. 35, are respectively a front view of a locking member according to a seventh embodiment of this invention of a key switch and front views of its locking device when the key is pulled out, when the key is inserted and when the key is forcibly pulled out.
Figure 35B:
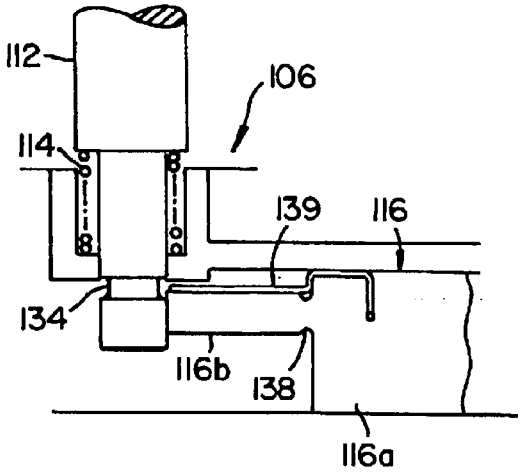
Figure 35C:
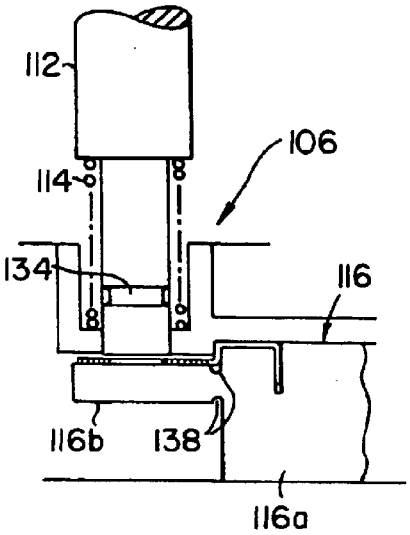
Figure 35D:
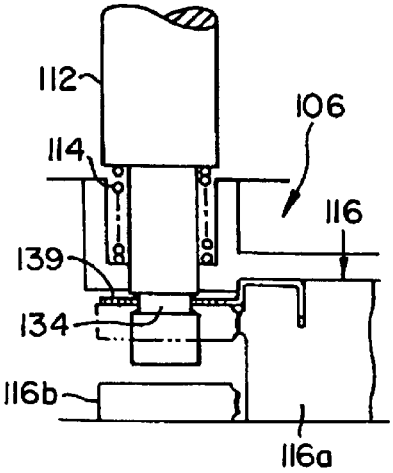

The locking member 116 of the locking mechanism 106 according to this example has a receiver arm 116*b* extended from the slide block 116*a* engagingly connected to the crank lever 117 for contacting and supporting the mobile member 112. Notches 138 are formed at the base of the receiver arm 116*b*, as shown in FIGS. 35A, 35B and 35C such that the receiver arm 116*b* will break off if an excessive force is applied thereon by the mobile member 112, as shown in FIG. 35D. Numeral 139 indicates a plate spring disposed on and along the upper surface of the receiver arm 116*b*. If the key 102 is forcibly pulled out while the switch is locked, the mobile member 112 is forced to move downward by the rotation of the rotary cam 108, breaking off the receiver arm 116*b* as shown in FIG. 35D. The switching mechanism 105 is thereby switched to the switched-off condition and the supply of power is stopped although the monitoring mechanism 107 is in the switched-on condition.

As the receiver arm 116*b* is thus broken off, the mobile member 112 penetrates through an opening 140 formed through the plate spring 139 and a tongue-like protruding piece 141 into this opening 140 as shown in FIG. 35A engages in a groove 134 formed on the mobile member 112. The mobile member 112 is thus prevented from moving upward and the switching mechanism 105 is switched to and maintained in the switched-off condition.

Figure 36A:
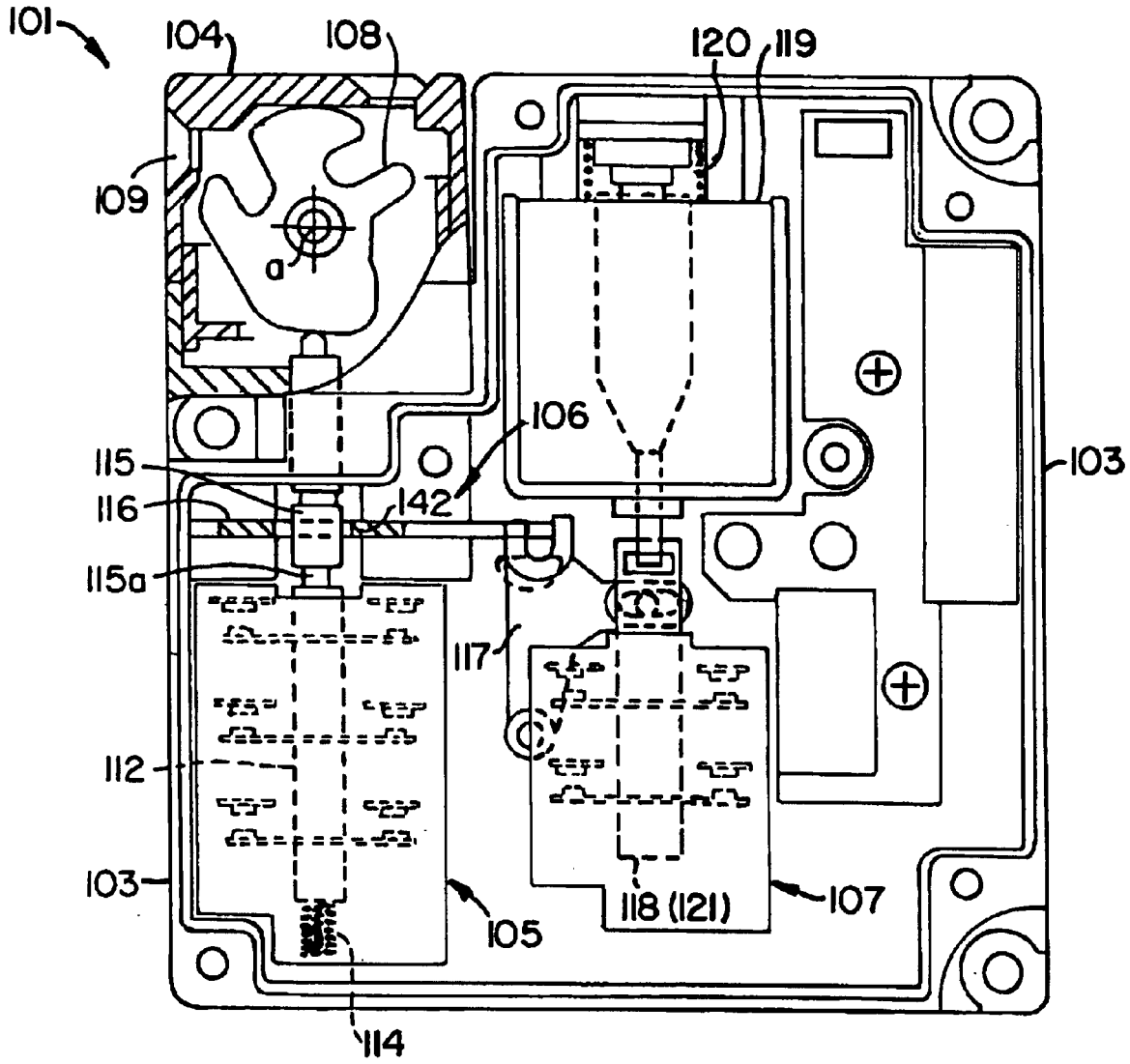
FIGS. 36A and 36B, together referred to as FIG. 36, are respectively a front view of a key switch with a locking device according to an eighth embodiment of the invention and a plan view of its locking device when the key is pulled out.
Figure 36B:
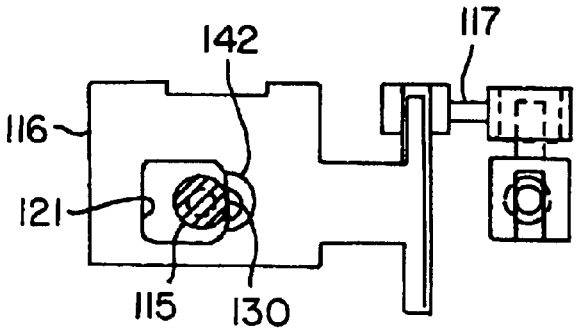
Figure 37A:
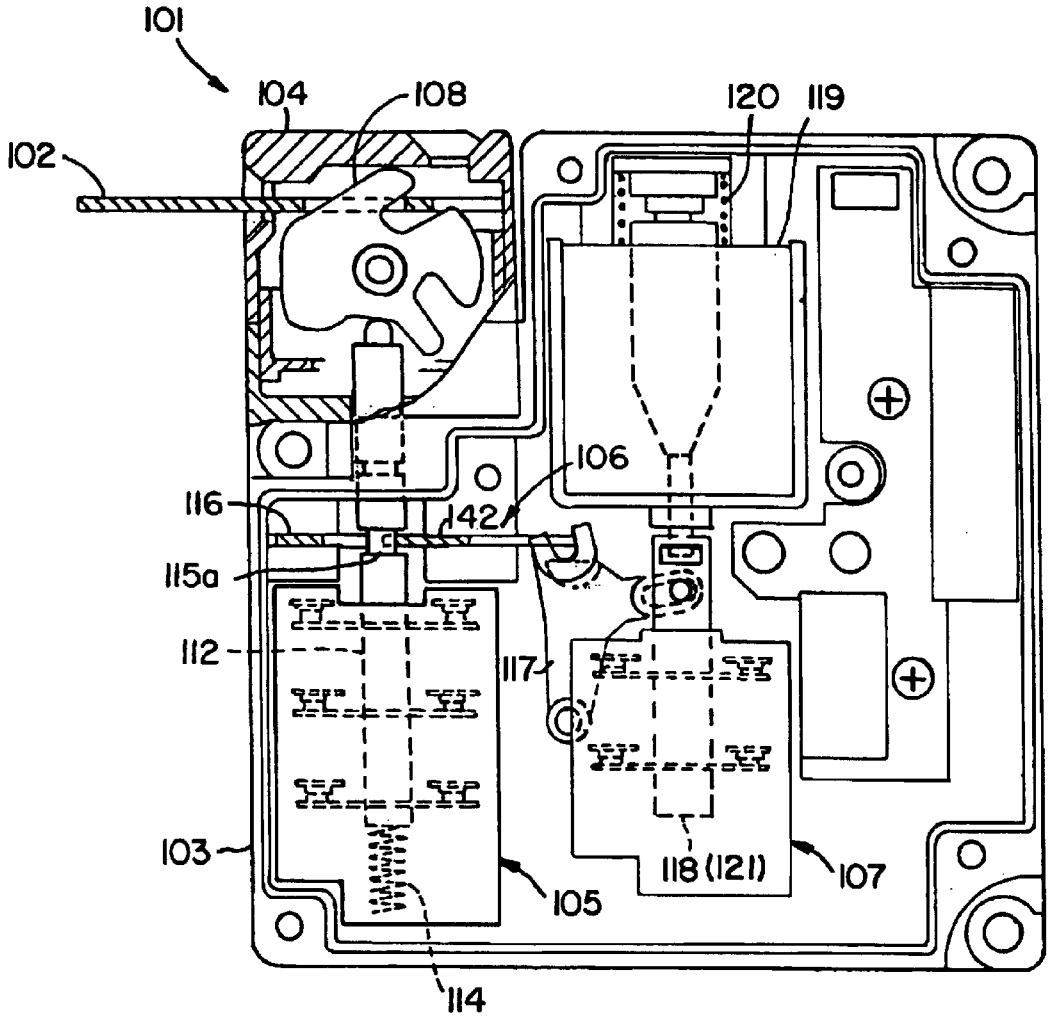
FIGS. 37A and 37B, together referred to as FIG. 37, are respectively a front view of the key switch of FIG. 36 and a plan view of its locking device when the key is inserted.
Figure 37B:
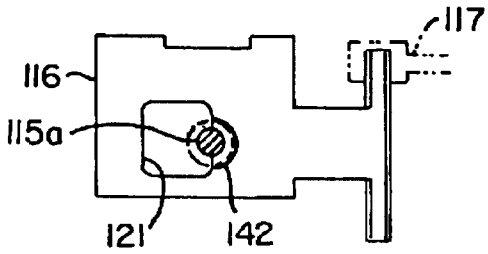
Figure 38:
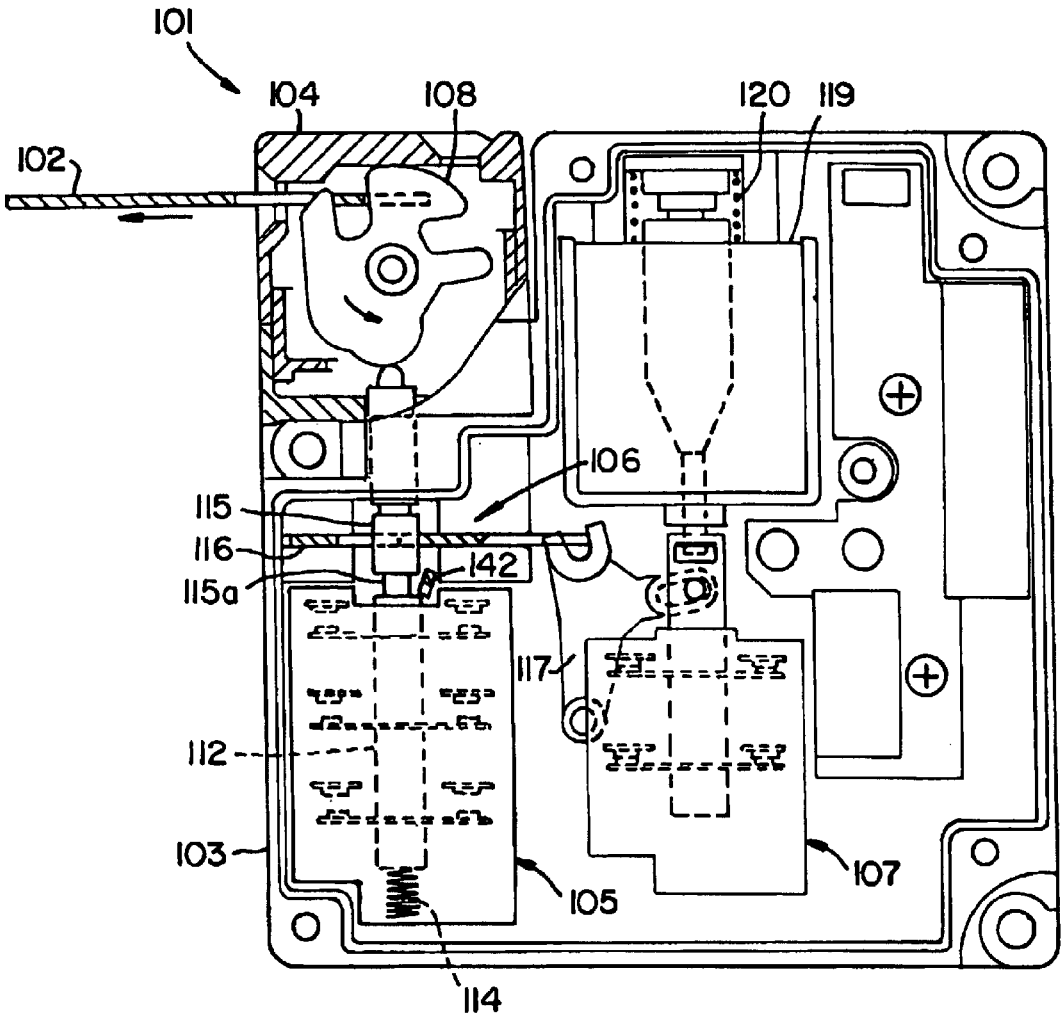
FIG. 38 is a front view of the key switch of FIG. 36 when the key is forcibly pulled out.

FIGS. 36–38 show still another key switch equipped with a locking mechanism 106 according to an eighth embodiment of the invention. Since this key switch is the same in basic structure as the one according to the first embodiment of the invention described above, corresponding components are indicated by the same numerals used above and will not be repetitiously explained.

The locking mechanism 106 according to this example, like that according to the first embodiment of the invention, locks the switching mechanism 105 in the switched-on condition by engaging an indentation 130 formed on an edge abutting an opening 127 through a locking member 116 made of a metallic plate at a small-diameter part 115*a* of a plunger 115 but is characterized in that an adjoining portion 142 of the locking member 116 to the indentation 130 is made as another component pressured into the locking member 116 or affixed to it by a self-locking nut. When the key 102 is forcibly pulled out while the switch is locked, the plunger 115 is strongly pulled down, and a small-diameter part 115*a* formed around the plunger 115 presses the adjoining portion 142 of the locking member 116 is dropped off, as shown in FIG. 38. The plunger 115 and the mobile member 112 thereby move down to the switched-off position.

Figure 39A:
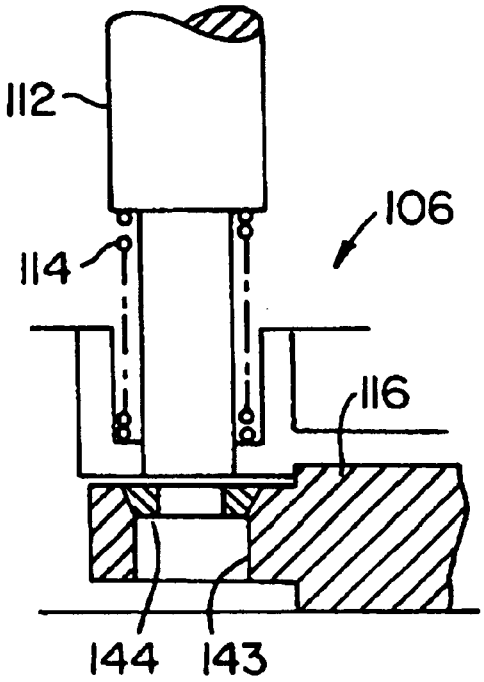
FIGS. 39A and 39B, together referred to as FIG. 39, are respectively a front view of a key switch equipped with a locking device according to a ninth embodiment of the invention when the key is inserted and a front view of its locking device when the key is forcibly pulled out.
Figure 39B:
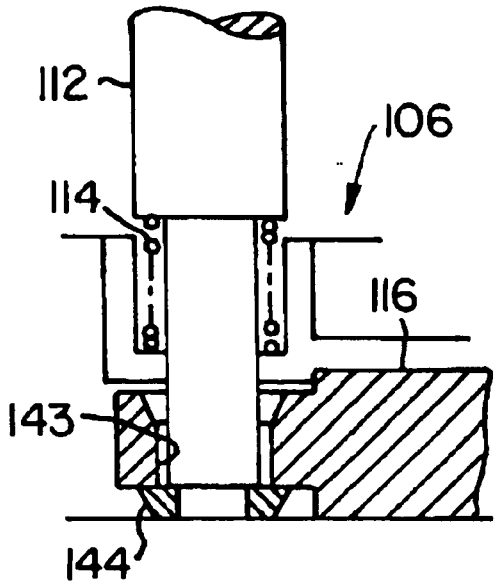

FIG. 39 shows a portion of still another locking mechanism 116 according to a ninth embodiment of this invention which is similar to the locking mechanism according to the fourth embodiment described above, causing a locking member 116 to advance below the mobile member 112 of the switching mechanism 105 to prevent the downward motion of the mobile member 112 which has moved upward to the switched-on position.

The locking member 116 of the locking mechanism 106 according to this example has a throughhole 143 formed through a front end part for allowing the mobile member 116 to pass through and an annular receiving member 144 is engagingly attached near the upper end part of this throughhole 143 for receiving and supporting the bottom end part of the mobile member 112. If the key 102 is forcibly pulled out while the switch is locked, an excessively large load is applied to and drops off the receiving member 144, allowing the mobile member 112 to move downward to the switched-off position.

Figure 40A:
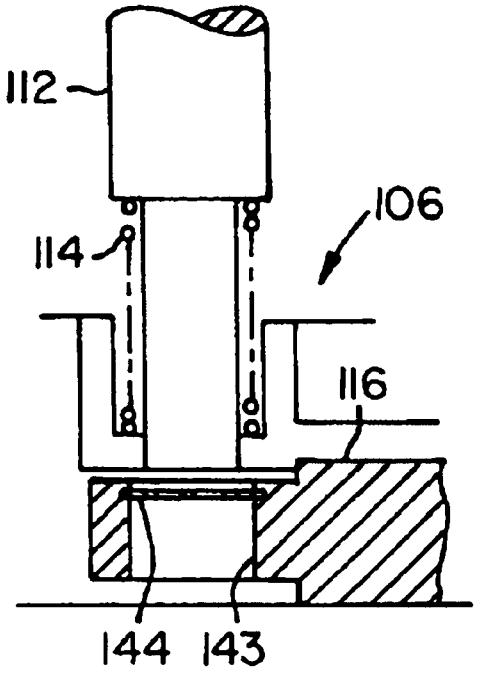
FIGS. 40A and 40B, respectively referred to as FIG. 40, are respectively a front view of a variation of the locking device of FIG. 39 when the key is inserted and a front view of its locking device when the key is forcibly pulled out.
Figure 40B:
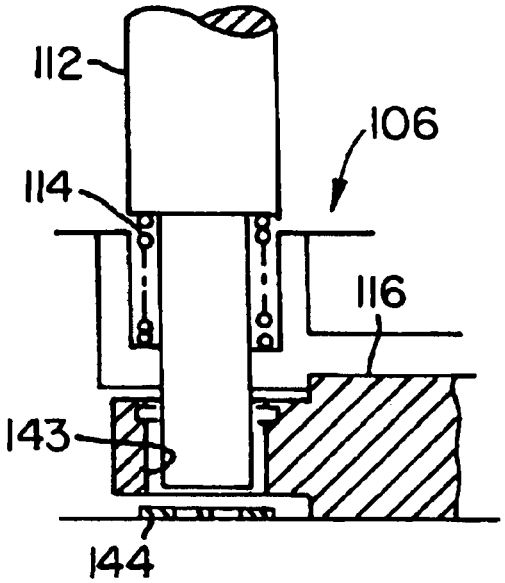

The annular receiver member 144 may be made of a hard resin material or a C-shaped metal ring with notches on its circumference. FIG. 40 shows an E-shaped stop ring serving as the receiver member 144.

Figure 41A:
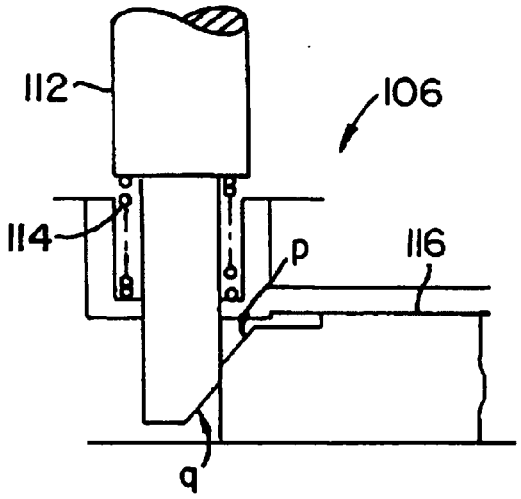
FIGS. 41A, 41B and 41C, together referred to as FIG. 41, are front views of a locking device according to a tenth embodiment of the invention respectively when the key is pulled out, when the key is inserted and when the key is forcibly pulled out.

FIG. 41 shows a portion of still another locking mechanism 116 according to a tenth embodiment of this invention which is similar to the locking mechanism according to the fourth embodiment described above, causing a locking member 116 to advance below the mobile member 112 of the switching mechanism 105 to prevent the downward motion of the mobile member 112 which has moved upward to the switched-on position.

Figure 41B:
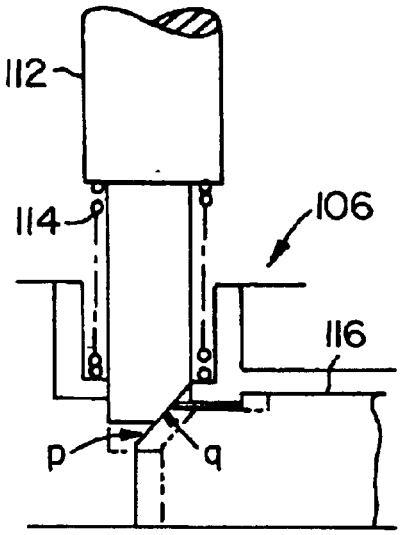
Figure 41C:
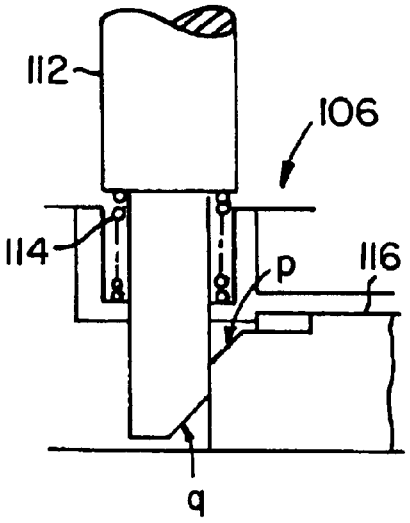
Figure 42A:
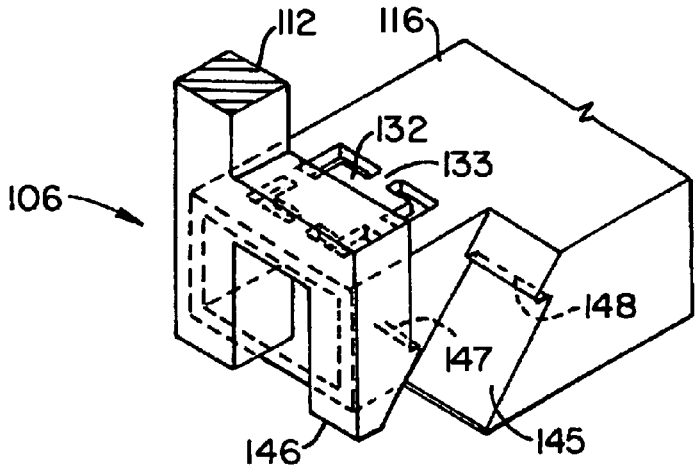
FIGS. 42A, 42B and 42C, together referred to as FIG. 42, are diagonal views of a locking device according to an eleventh embodiment of this invention respectively when the key is pulled out, when the key is inserted and when the key is forcibly pulled out.
Figure 42B:
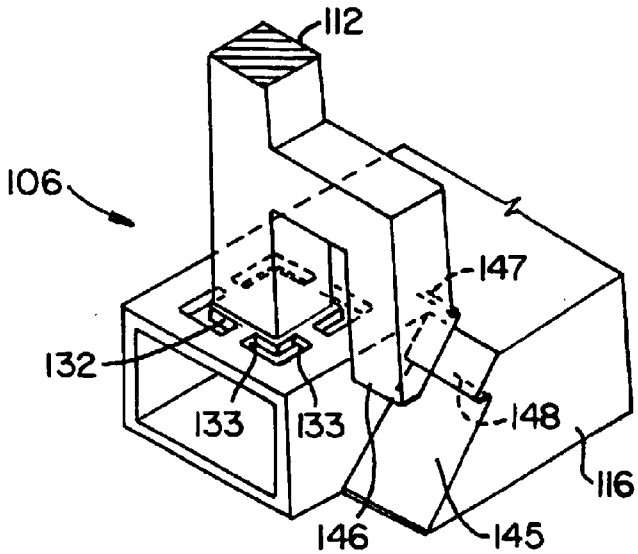
Figure 42C:
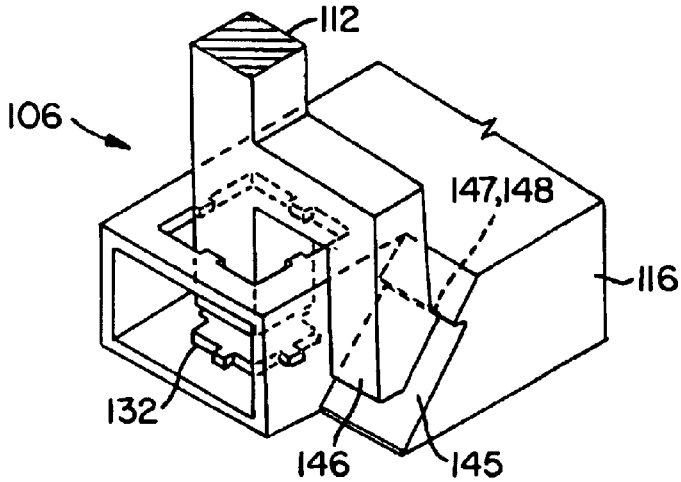

The locking member 116 of the locking mechanism 106 according to this example has a tapered surface "p" at its front end part. A tapered surface "q" is also formed at the lower end part of the mobile member 116. The locking member 116, when advanced to the locking position, receives and supports the mobile member 112 through the tapered surfaces "p" and "q" in a locked condition, as shown in FIG. 41(B). If the key 102 is forcibly pulled out while the switch is locked, the mobile member 112 is strongly pulled downward. Since the tapered surfaces "p" and "q" function like a cam, the locking member 116 is thereby retracted against the biasing force thereon, as shown in FIG. 41(C), allowing the mobile member to move downward to the switched-off position. FIG. 42 shows still another key switch equipped with a locking mechanism 106 according to an eleventh embodiment of the invention. This key switch is similar to the one according to the second embodiment of the invention and causes a locking member 116 to advance below the mobile member 112 of the switching mechanism 105 to prevent the downward motion of the mobile member 112 which has moved upward to the switched-on position. With the locking member 116 of this locking mechanism, a receiver part 132 of the mobile member 112 is supported by narrow bridges 133, and a sloped engaging part 145 is provided at its side. The mobile member 112 is correspondingly provided with an engaging leg 146 extending downward from one side of its lower part. If the key 102 is forcibly pulled out while the switch is locked, an excessively large force is applied to the receiver part 132 of the locking member 116 to break the bridges 133 and cause the receiving part 132 to drop, allowing the mobile member 112 to move down to the switched-off position. The engaging leg 146 connected to the mobile member 112 applies a force on the sloped engaging part 145 to cause the locking member 116 to be retracted against the biasing force thereon until a hooking part 147 on the engaging leg 146 engages in a groove 148 formed on the sloped engaging part 145 so as to prevent the mobile member 112 from moving upward. Thus, if the key 102 is forcibly pulled while the switch is locked, the switching mechanism 105 is switched to and held in the switched-off condition.

Figure 43A:
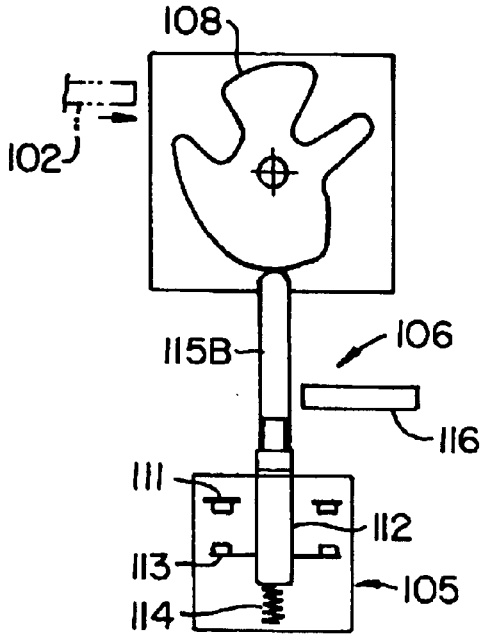
FIG. 43 is a schematic front view of a key switch with a locking device according to a twelfth embodiment of the invention when the key is pulled out.
Figure 43B:
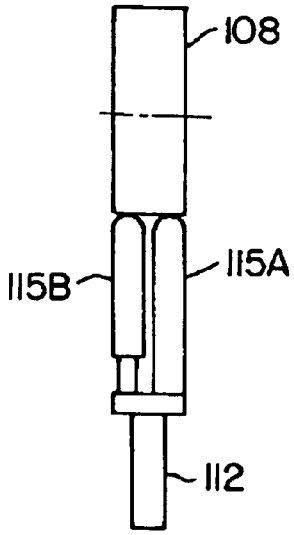
Figure 44A:
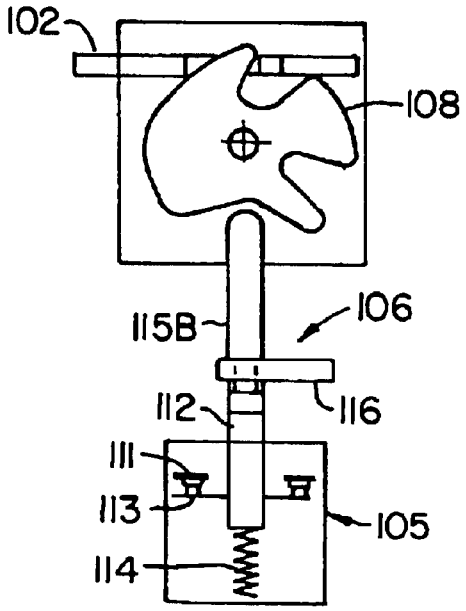
FIG. 44 is a schematic front view of the key switch of FIG. 43 when the key is inserted.
Figure 44B:
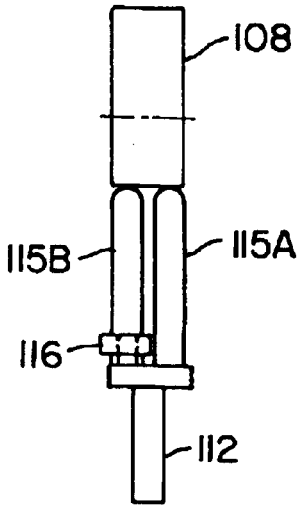
Figure 45A:
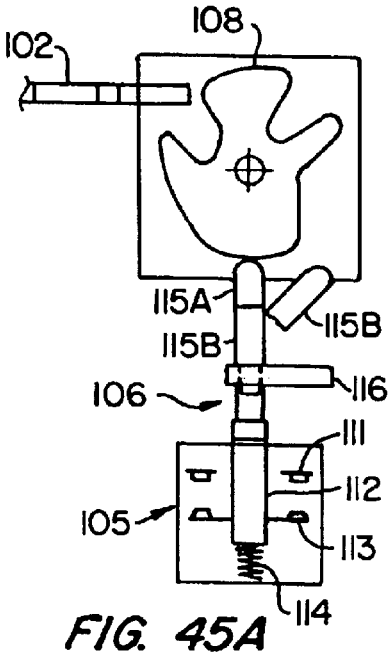
FIG. 45 is a schematic front view of the key switch of FIG. 43 when the key is forcibly pulled out.
Figure 45B:
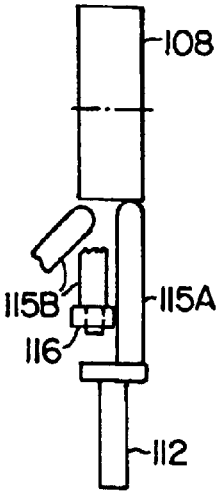

FIGS. 43–45 show still another key switch equipped with a locking member 106 according to a twelfth embodiment of this invention, characterized as having two plungers 115A and 115B contacting the top end part of the mobile member 112 of the switching mechanism 105. The locking member 116 of the locking mechanism engages with only one of the plungers (115B) which is made more fragile than the locking member 116. If the key 102 is forcibly pulled out while the switch is locked, a downward force is applied to both plungers 115A and 115B. As a result, the fragile one of the plungers (115B) will break but the other plunger 115A will push the mobile member 112 to the switched-off position.

As an alternative to the twelfth embodiment, although not separately illustrated, the two plungers 115A and 115B may be arranged coaxially one inside the other, the locking member being engaged only with the outside plunger or two rotary cams being provided individually for the two plungers.

Figure 46A:
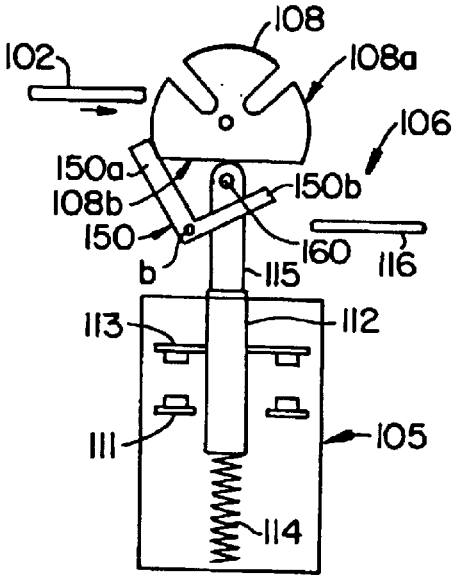
FIGS. 46A, 46B and 46C, together referred to as FIG. 46, are schematic front views of a key switch with a locking device according to a thirteenth embodiment of the invention respectively when the key is pulled out, when the key is inserted and when the key is forcibly pulled out.
Figure 46B:
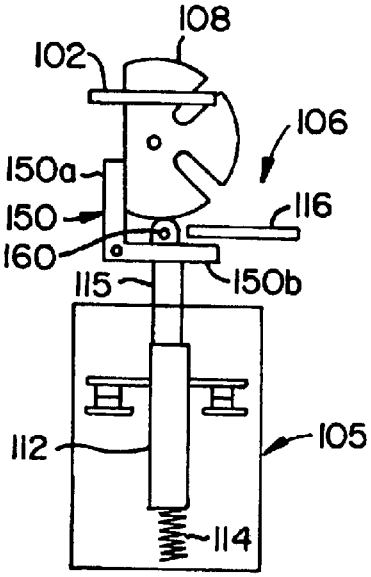

FIG. 46 shows still another key switch equipped with a locking mechanism 106 according to a thirteenth embodiment of the invention characterized as becoming switched off as the mobile member 112 of the switching mechanism 105 and the plunger 115 are moved upward by a small-diameter part 108*b* of the rotary cam 108 when the key 102 is pulled out and switched on as the plunger 115 is pushed down by a large-diameter part 108*a* of the rotary cam 108 when the key 102 is inserted and the rotary cam 108 is thereby rotated. Its locking mechanism 106 comprises an L-shaped lock lever 150 rotatable around an axis "b" and a planar locking member 116 which is slidable sideways.

One (first) end part 150*a* of the L-shaped lock lever 150 contacts the rotary cam 108 and is biased in the counter-clockwise direction, the locking member 116 applying force from above on the other (second) end part 150*b*. In a switched-on condition shown in FIG. 46B, the second end part 150*b* engages with the locking member 116 to prevent the lock lever 150 and the rotary cam 108 from rotating in the clockwise direction such that a switched-off condition is maintained and the key 102 cannot be pulled out.

Figure 46C:
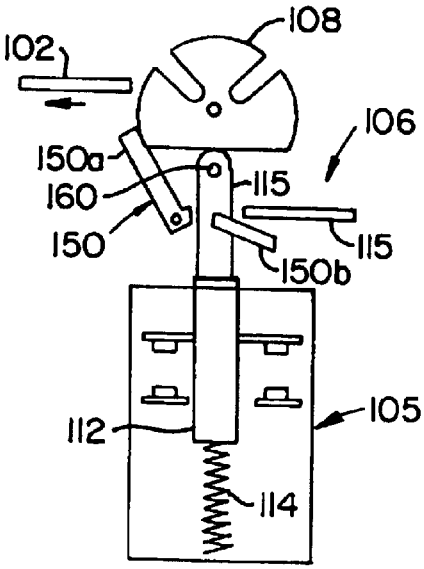

If the key 102 is forcibly pulled out in this condition, the rotary cam 108 is rotated in the clockwise direction, forcing the lock lever 150 to also rotate in the clockwise direction and thereby breaking off the second end part 150*b* of the lock lever 150 engaged with the locking member 116, as shown in FIG. 46C. The rotary cam 108 rotates to bring about the switched-off condition. The plunger 115 is provided with a protruding rib 160 engaging with the second end part 150*b* of the lock lever 150 such that the contact points can be forcibly separated even if they are fused together when the switch is unlocked and the key 102 is pulled out.

Although the invention has been described above with reference to only a limited number of embodiments, they are not intended to limit the scope of the invention. Features of some of these embodiments may be combined. Many modifications and variations are further possible within the scope of the invention. In summary, this aspect of the present invention provides reliable switches such that even if the key is forcibly pulled out while the switch is in the locked condition, the switching mechanism can be switched to the correct contact condition as of the time when the key was inadvertently pulled out. Thus, if such a switch is used as an electromagnetically locking door switch, situations allowing the door to open while machine tools inside are powered can be avoided.

What is claimed is:

1. A switch comprising:

a main case including a switching mechanism subjected to a biasing force;

a head case attached to said main case and containing an operating mechanism for said switching mechanism, said switching mechanism and said operating mechanism being correlated such that said switching means is kept in a first switched condition by opposing against said biasing force when no external operation is being effected on said operating mechanism and that said switching mechanism is displaced by said biasing force to be in a second switched condition when an external operation is effected on said operating mechanism; and a forcing means included in said main case for setting said switching mechanism in said first switched condition by a forced displacement operation on said switching mechanism, said forcing means being released from said force displacement operation when said head case is properly connected to said main case, said forcing means carrying out said forced displacement operation when said head case is not properly connected to said main case.

2. The switch of claim 1 wherein said switching mechanism includes fixed terminals, mobile terminals, a mobile member supporting said mobile terminals, a returning spring applying a force on said mobile member so as to bring about said second switched condition where said mobile terminals contact said fixed terminals, said first switched condition being realized by moving said mobile member against said force by said returning spring to separate said mobile terminals away from said fixed terminals; wherein said operating mechanism comprises a plunger which contacts said mobile member; and wherein said forcing means serves to forcibly displace said plunger.

3. The switch of claim 2 wherein said forcing means comprises a forcing member which forces said plunger and a biasing member for biasing said forcing member towards said plunger, said forcing member being retracted against said forcing member to a retracted position not preventing said plunger from being displaced when said head case is normally connected to said main case, said biasing member causing said forcing member to forcibly displace said plunger against said returning spring when said head case is separated from said main case.

4. The switch of claim 3 wherein said forcing member comprises a spring member having an operating part which operates on said plunger, said spring member being elastically deformed by contacting a portion of said head case connected to said main case such that said operating part is retracted to said retracted position, said operating part causing said plunger to be forcibly displaced against said returning spring when the contacting portion of said head case becomes separated from said spring member, said head case being connectable to said main case in a plurality of different connection conditions, said head case being operable from outside in different directions according to said connection conditions, said spring member being elastically deformable in any of said connecting conditions by causing said spring member to contact a portion of said head case.

5. The switch of claim 4 wherein said spring member includes a lever for contacting said portion of said head case, said spring member being attached to said main case and comprising a spring plate, said lever and said operating part being integrally formed.

6. The switch of claim 3 wherein said forcing member comprises a cam and said biasing member comprises a biasing spring, said cam being held at a non-interfering position so as not to prevent said plunger from being displaced when said head case is connected to said main case, said cam being biased by said biasing spring to cause said plunger to be forcibly displaced against said returning spring when said head case is separated from said main case.

7. The switch of claim 1 wherein said switching mechanism includes fixed terminals, mobile terminals, a mobile member supporting said mobile terminals, a returning spring applying a force on said mobile member so as to bring about said second switched condition where said mobile terminals contact said fixed terminals elastically, said first switched condition being realized by moving said mobile member against said force by said returning spring to separate said mobile terminals away from said fixed terminals; wherein said operating mechanism comprises a plunger which contacts said mobile member; and wherein said forcing means includes a link for applying force directly on said mobile terminals elastically supported by said mobile member to thereby forcibly separate said mobile terminals from said fixed terminals.

8. The switch of claim 1 wherein said operating mechanism in said head case comprises a rotary cam which allows to be rotated by a key inserted from outside.

9. A switch comprising:

a switching mechanism including fixed terminals, mobile terminals opposite said fixed terminals, a mobile member supporting said mobile terminals and a returning spring, said switching mechanism being in a switched-on condition when said mobile member is displaced by said returning spring to thereby cause said mobile terminals to contact said fixed terminals, said switching mechanism being in a switched-off condition when said mobile member is displaced against said returning spring to thereby separate said mobile terminals from said fixed terminals;

an operating mechanism including a key normally for causing said switching mechanism to be at a switched-off position in said switched-off condition when said key is pulled out and to be displaced against said returning spring to a switched-on position in said switched-on condition when said key is inserted; and a locking mechanism for maintaining said switching mechanism locked in said switched-on condition and releasing said switching mechanism from the locked condition if a load greater than a specified magnitude is applied to said key while said switching mechanism is in said locked condition, thereby setting said switching mechanism and said operating mechanism in said switched-off condition.

10. The switch of claim 9 further comprising a plunger adapted to be displaced by said operating mechanism and to move said mobile member in coordination therewith, wherein said locking mechanism functions to cause said locked condition by engaging a locking member with a mobile component selected from the group consisting of said mobile member and said plunger, at least a portion of said locking member is more easily breakable than said mobile component engaged with said locking member so as to be damaged and to release said locked condition if a load greater than a preset magnitude is applied thereto.

11. The switch of claim 10 wherein said locking member has an engaging part at which said locking member engages with said plunger, said engaging part being bent so as to deform said locking member by a load greater than said preset magnitude.

12. The switch of claim 11 wherein said engagement part, when bent, engages with said mobile component at said switched-off position and thereby prevents said mobile member from being displaced to said switched-on position by said returning spring.

13. The switch of claim 11 wherein said locking member, when said engagement member is bent and deformed, contacts said mobile component at said switched-on position and is prevented from advancing to a normal locking position where said locking member would lock with said mobile component.

14. The switch of claim 10 wherein said locking member has an engaging part at which said locking member engages with said plunger, said engaging part being broken off by a load greater than said preset magnitude.

15. The switch of claim 10 wherein said locking member has a contacting part at which said locking member contacts said mobile member to lock said switching mechanism in said switched-on position, said contact part being deformed or breaking off by a load greater than said preset magnitude, said mobile member having a groove, said locking mechanism having a holding part, said holding part engaging in said groove when said mobile member moves to said switched-off position after said contact part is deformed or broken off.

16. The switch of claim 10 wherein said locking member contacts said mobile member to thereby lock said switching mechanism in said switched-on position, said locking member retracting against said returning spring to allow said mobile member to be displaced to said switched-off position and said displaced mobile member being engaged to and held by said locking member when a load greater than a preset magnitude is applied.

17. The switch of claim 9 further comprising a plurality of plungers adapted to be displaced by said operating mechanism and to move said mobile member in coordination therewith, said locking mechanism locking said switching mechanism by engaging said locking member with one of said plungers, the engaged plunger being deformed to unlock said switching mechanism when a load greater than said specified magnitude is applied to said key while said switching mechanism is locked.

18. The switch of claim 9 further comprising an electromagnetic solenoid for locking and unlocking said switching mechanism and terminals which undergo switching operations accordingly as said switching mechanism is locked and unlocked.

* * * * *